US012458096B2

(12) United States Patent
Neilson et al.

(10) Patent No.: US 12,458,096 B2
(45) Date of Patent: Nov. 4, 2025

(54) IMPACT MITIGATING STRUCTURE

(71) Applicant: HEXR LTD, London (GB)

(72) Inventors: Henry Neilson, London (GB); James Cook, London (GB); Adam Levy, London (GB); Robin Spicer, London (GB)

(73) Assignee: HEXR LTD, London (GB)

( * ) Notice: Subject to any disclaimer, the term of this patent is extended or adjusted under 35 U.S.C. 154(b) by 98 days.

(21) Appl. No.: 18/245,892

(22) PCT Filed: Sep. 20, 2021

(86) PCT No.: PCT/GB2021/052441
§ 371 (c)(1),
(2) Date: Mar. 19, 2023

(87) PCT Pub. No.: WO2022/058756
PCT Pub. Date: Mar. 24, 2022

(65) Prior Publication Data

US 2024/0008578 A1 Jan. 11, 2024

(30) Foreign Application Priority Data

| | | |
|---|---|---|
| Sep. 18, 2020 | (GB) | 2014786 |
| Jul. 9, 2021 | (GB) | 2109980 |
| Jul. 13, 2021 | (EP) | 21185448 |
| Jul. 23, 2021 | (EP) | 21187554 |
| Jul. 23, 2021 | (EP) | 21187556 |
| Jul. 27, 2021 | (EP) | 21188100 |
| Aug. 3, 2021 | (GB) | 2111217 |
| Sep. 6, 2021 | (EP) | 21195162 |

(51) Int. Cl.
*A42B 3/06* (2006.01)

(52) U.S. Cl.
CPC ..... *A42B 3/064* (2013.01)

(58) Field of Classification Search
CPC ..... A42B 3/125; A42B 3/064; A42B 3/06
See application file for complete search history.

(56) References Cited

U.S. PATENT DOCUMENTS

| | | | | |
|---|---|---|---|---|
| 9,756,891 | B1 | 9/2017 | McGhie | |
| 2009/0077723 | A1* | 3/2009 | Mead | F16F 13/04 2/455 |
| 2013/0122256 | A1* | 5/2013 | Kleiven | B32B 5/16 428/158 |

(Continued)

FOREIGN PATENT DOCUMENTS

| | | |
|---|---|---|
| CN | 103284392 | 9/2013 |
| EP | 3541221 | 9/2019 |
| WO | 2019125282 | 6/2019 |

*Primary Examiner* — Jillian K Pierorazio
(74) *Attorney, Agent, or Firm* — JMB Davis Ben-David

(57) ABSTRACT

A helmet includes an impact mitigating structure (100). The impact mitigating structure includes a first inner layer (102), a second outer layer (104) and a reactive layer (105) positioned between the first inner layer and the second outer layer. The reactive layer includes multiple elements (106) held between the first inner layer and second outer layer. The reactive layer is arranged such that, when the second layer is subject to an impact, the multiple elements of the reactive layer are configured to roll to facilitate movement of the first inner layer and the second outer layer with respect to each other.

29 Claims, 21 Drawing Sheets

(56) References Cited

U.S. PATENT DOCUMENTS

2015/0128335 A1* 5/2015 Dehni ..... C08G 18/7664 2/24
2016/0081416 A1* 3/2016 Knight ..... A41D 13/015 2/412
2016/0120256 A1* 5/2016 Golnaraghi ..... F16F 7/12 188/371
2016/0302496 A1* 10/2016 Ferrara ..... A42B 3/128
2016/0309828 A1* 10/2016 Knight ..... A42B 3/064
2016/0316847 A1* 11/2016 Weber ..... A42B 3/064
2017/0055621 A1* 3/2017 Knight ..... A42B 3/20
2017/0164678 A1 6/2017 Allen
2017/0188648 A1* 7/2017 Larrabee ..... A42B 3/125
2017/0280809 A1* 10/2017 Knight ..... A42B 3/125
2017/0318891 A1* 11/2017 Walterspiel ..... A42B 3/125
2017/0347736 A1* 12/2017 Penner ..... A42B 3/145
2018/0035740 A1* 2/2018 Knight ..... A42B 3/14
2018/0042326 A1* 2/2018 Mini Townson ..... F16F 13/005
2018/0049484 A1* 2/2018 Markison ..... A41D 13/015
2018/0049485 A1* 2/2018 Markison ..... A42B 3/124
2018/0049503 A1* 2/2018 Markison ..... B32B 27/08
2018/0049504 A1* 2/2018 Markison ..... A41D 1/04
2018/0092422 A1* 4/2018 Knight ..... A42B 3/08
2018/0255862 A1* 9/2018 Ho ..... A42B 3/064
2019/0159540 A1* 5/2019 Pradeep ..... A42B 3/125
2019/0232601 A1* 8/2019 Kleiven ..... B32B 3/10
2019/0297985 A1* 10/2019 Weber ..... A42B 3/064
2019/0313726 A1* 10/2019 Walterspiel ..... A42B 3/283
2020/0178636 A1 6/2020 Halldin et al.
2020/0237044 A1* 7/2020 Walterspiel ..... A42B 3/064
2020/0253314 A1* 8/2020 Weber ..... A42B 3/064
2020/0305534 A1* 10/2020 Chilson ..... B32B 3/04
2020/0329802 A1* 10/2020 Kleiven ..... A42B 3/124
2021/0045487 A1* 2/2021 Weber ..... A42B 3/064
2021/0059345 A1* 3/2021 Halldin ..... A42B 3/125
2021/0076768 A1* 3/2021 Halldin ..... A42B 3/125
2021/0093035 A1* 4/2021 Liu ..... A42B 3/14
2021/0137201 A1* 5/2021 Leon ..... A42B 3/125

* cited by examiner

IMPACT MITIGATING STRUCTURE

CROSS-REFERENCE TO RELATED APPLICATIONS

This is the US National Stage of International Patent Application No. PCT/GB2021/052441 filed Sep. 20, 2021, which claims priority to British Patent Application No. GB 2014786.4 filed on Sep. 18, 2020, British Patent Application No. GB 2109980.9 filed on Jul. 9, 2021, British Patent Application No. GB 2111217.2 filed on Aug. 3, 2021, European Patent Application No. EP 21185448.4 filed on Jul. 13, 2021, European Patent Application No. EP 21187554.7 filed on Jul. 23, 2021, European Patent Application No. EP 21187556.2 filed on Jul. 23, 2021, European Patent Application No. EP 21188100.8 filed on Jul. 27, 2021, and European Patent Application No. EP 21195162.9 filed on Sep. 6, 2021.

This invention relates to an impact mitigating structure, in particular an impact mitigating structure having multiple layers.

Injury to a person or damage to an object can occur when the person or object is subjected to an impact of sufficient magnitude. Considerable developmental effort has been expended to produce impact mitigating structures, and in particular helmets and body armour, which provide protection from potentially damaging or injurious impacts.

Head injuries, which can be incurred as a result of participation in sports such as cycling, horse riding or rock climbing, are a common cause of serious brain injuries. A brain trauma may occur as a consequence of either a focal impact upon the head, a sudden acceleration or deceleration within the cranium, or a combination of both impact and movement. Impact protection is therefore important in preventing brain injuries as a result of impacts to the head.

Head protection, in the form of helmets, is designed to reduce the forces experienced by a user's head during an impact. Generally, a helmet comprises at least one impact absorbing layer which is designed to absorb a portion of the forces to which the helmet is subjected during an impact. Body armour similarly protects other parts of a body.

However, helmets and body armour often do not provide adequate protection during an impact against both linear and tangential forces. As oblique impacts are common, impacts will often include both linear and tangential components. Tangential forces in particular result in the rotational acceleration of the brain, which has been linked to bridging vein rupture. In turn, this may be responsible for subdural haematomas, and diffuse axonal injuries. Tangential forces during an impact may also result in neck injuries.

It is an aim of the present invention to provide improved impact mitigating structures.

When viewed from a first aspect the invention provides a helmet comprising an impact mitigating structure, the impact mitigating structure comprising:

- a first inner layer;
- a second outer layer; and
- a reactive layer positioned between the first inner layer and the second outer layer, the reactive layer comprising a plurality of elements held between the first inner layer and second outer layer;
- wherein the reactive layer is arranged such that, when the second layer is subject to an impact, the plurality of elements of the reactive layer are configured to roll to facilitate movement of the first inner layer and the second outer layer with respect to each other.

Thus the invention provides a helmet including an impact mitigating structure. The impact mitigating structure is formed from a plurality of layers (a reactive layer sandwiched between inner (first) and outer (second) layers), where the reactive layer facilitates the movement of other (e.g. impact absorbing) layers with respect to each other. When the helmet, in particular the second (outer) layer of the impact mitigating structure, is subject to an impact (e.g. exceeding a threshold), at least a portion of the force from the impact is transferred to the reactive layer. This causes the plurality of (e.g. discrete) elements to roll. This rolling motion of the plurality of elements of the reactive layer allows the second layer to move (e.g. slide or rotate) with respect to the first (inner) layer, and/or vice versa. This movement of the layers may occur during and after the impact.

The skilled person will appreciate that the provision of the reactive layer in the impact mitigating structure, which facilitates movement of the first and second layers relative to each other, owing to the rolling of the plurality of elements between the first and second layers, helps to transfer some of the energy from the impact into movement of the layers relative to each other. This helps to transfer energy from the impact (e.g. into the reactive layer), such that the amount of energy transferred through to the head that the helmet is protecting is reduced.

The reactive layer helps to convert energy from the impact into linear and/or rotational movement of the layers relative to each other. In particular, the energy from the impact may be transferred to the (e.g. plurality of elements of the) reactive layer (where, for example, it is converted into kinetic and/or potential energy in the (e.g. plurality of elements of the) reactive layer) such that the energy is not dissipated by layers of the helmet and/or transmitted through to a layer of the helmet adjacent the user's head. Thus preferably the (e.g. plurality of elements of the) reactive layer are configured to receive kinetic and/or potential energy (from the energy of an impact), when the impact mitigating structure is subject to an impact. This helps to reduce the linear and rotational forces that are transmitted through the impact mitigating structure, e.g. to the body that the impact mitigating structure may be trying to protect. As will be appreciated, for a helmet protecting the head of a wearer, this can help to reduce the likelihood of head and brain injuries.

Transferring the energy to the reactive layer (owing to mechanical work being done on the reactive layer) and/or isolating the inner layer from forces experienced by the outer layer in an impact contrasts with conventional helmets that dissipate energy within (e.g. between layers of) a helmet, e.g. through deformation of connectors or friction between layers, or do not isolate the inner layer. This often results in a significant amount of energy being transferred from the initial kinetic energy of the head and helmet involved in the impact to the inner layer.

Furthermore, in at least preferred embodiments, the arrangement of the reactive layer, with the plurality of elements being held in place, may be configured to introduce (or set) a particular threshold at which the plurality of elements start to roll (e.g. are disrupted), to allow the layers move relative to each other. This helps to provide a helmet having an impact mitigating structure that is particularly suited to its use and can be used to help to increase the amount of energy transfer into the movement of the layers relative to each other.

Preferably the first inner layer, the second outer layer and/or the reactive layer are configured such that, when the impact mitigating structure is subject to an impact, the majority of the rotational energy of the impact (i.e. the component of the energy of the impact that causes rotation of the layers of the helmet relative to each other) is transferred to the second outer layer and/or the reactive layer. The transfer of energy to the second outer layer and/or the reactive layer, rather than through to inner layer(s) of the helmet, is considered to be novel and inventive in its own right and thus when viewed from a further aspect the invention provides a helmet comprising an impact mitigating structure, the impact mitigating structure comprising:

a first inner layer;

a second outer layer;

a third intermediate layer positioned between the first inner layer and the second outer layer;

wherein the first inner layer, the second outer layer and/or the third intermediate layer are configured such that, when the impact mitigating structure is subject to an impact, the majority of the rotational energy of the impact is transferred to the second outer layer and/or the third intermediate layer.

Thus, in this aspect of the invention, the incoming rotational kinetic energy to the impact (of the head and the helmet) is transferred to (e.g. absorbed) a separate intermediate layer (e.g. the reactive layer), that is disposed between inner and outer layers of an impact mitigating structure, or the second outer layer, and not to the other layers or components between the layers of the impact mitigating structure. Thus, preferably, the minority (e.g. substantially none) of the rotational energy of the impact is dissipated between any of the layers of the impact mitigating structure.

It will be appreciated that the helmet and impact mitigating structure of this aspect of the invention may comprise any (e.g. all) of the optional and preferred features outlined herein with regard to any of the other aspects and embodiments of the invention.

Preferably the (e.g. first inner layer, second outer layer and/or reactive layer of the) impact mitigating structure is configured to substantially decouple and/or isolate (mechanically) the first inner layer from the second outer layer. This helps to avoid rotational energy being transferred between the outer and inner layers of the impact mitigating structure, thus helping to prevent rotational energy from the impact being transferred through to the head of the wearer of the helmet.

This is considered to be novel and inventive in its own right and thus when viewed from a further aspect the invention provides a helmet comprising an impact mitigating structure, the impact mitigating structure comprising:

a first inner layer;

a second outer layer;

a third intermediate layer positioned between the first inner layer and the second outer layer;

wherein the first inner layer, the second outer layer and/or the third intermediate layer are configured to substantially decouple and/or isolate the first inner layer from the second outer layer.

This decouples and/or isolates the inner layer from the other layers of the helmet, and helps to prevent generating a rotational impulse that acts on inner layer of the helmet (which is preferably configured to be worn against a head), and thus on the head.

Rather than dissipating rotational kinetic energy between the layers of the helmet (as is the case in conventional helmets), the reactive layer gains kinetic and/or potential energy from the rotational energy of the impact. This may, for example, result in random and disordered free motion of a plurality of elements of the reactive layer, e.g. in any orientation and around any axis. This energy can be thought of as internal energy similar to that which molecules and particles attain.

It will be appreciated that the helmet and impact mitigating structure of this aspect of the invention may comprise any (e.g. all) of the optional and preferred features outlined herein with regard to any of the other aspects and embodiments of the invention. Preferably the inner layer, the outer layer and/or the third intermediate layer are substantially decoupled and/or isolated from each other such that the one or more (e.g. all) of the first inner layer, the second outer layer and/or the third intermediate layer move substantially freely relative to each other, when the impact mitigating structure is subject to an impact (e.g. having at least the particular force).

This is considered to be novel and inventive in its own right and thus when viewed from a further aspect the invention provides a helmet comprising an impact mitigating structure, the impact mitigating structure comprising:

a first inner layer;

a second outer layer;

a third intermediate layer positioned between the first inner layer and the second outer layer;

wherein the first inner layer, the second outer layer and/or the third intermediate layer are configured to move substantially freely relative to each other, when the impact mitigating structure is subject to an impact.

It will be appreciated that the helmet and impact mitigating structure of this aspect of the invention may comprise any (e.g. all) of the optional and preferred features outlined herein with regard to any of the other aspects and embodiments of the invention.

The first layer, the second layer and the reactive layer may have any suitable and desired geometries, both individually and collectively. Preferably one or more (e.g. each) of the first layer, the second layer and the reactive layer has a thickness that is less than their other two dimensions (e.g. across the surface area of the respective layer). Preferably one or both of the first layer and the second layer has a thickness that is greater than the thickness of the reactive layer. As discussed below, this may depend on the nature and function of the first and/or second layers. Preferably the thickness of one or more (e.g. each) of the first layer, the second layer and the reactive layer is substantially constant.

In a preferred embodiment, one or more (e.g. all) of the first layer, the second layer and the reactive layer are arranged substantially parallel to each other. Thus preferably the reactive layer is sandwiched between the first layer and the second layer, such that the first layer, the second layer and the reactive layer are stacked on top of each other. While the reactive layer may extend over substantially the same surface area as the first and/or second layers, preferably one or both of the first layer and the second layer extend over a greater surface area (e.g. in directions perpendicular to their thickness) than the surface area over which the reactive layer extends. In some embodiments, the reactive layer extends over surface areas of the (impact mitigating structure of the) helmet where any impact may occur.

In a preferred embodiment, one or more (e.g. each) of the first layer, the second layer and the reactive layer is (e.g. doubly) curved (e.g. over the surface area of the respective layer). Preferably the shape and curvature of the first layer, the second layer and the reactive layer is such that the layers conform to each other. Preferably the first layer has a convex surface facing the reactive layer (and preferably a concave surface on its opposite surface facing away from the reactive layer, e.g. facing a user's head). Preferably the second layer has a concave surface facing the reactive layer (and preferably a convex surface on its opposite surface facing away from the reactive layer, e.g. facing away from the user's head). Preferably the reactive layer has a concave surface facing the first layer and a convex surface facing the second layer.

In one embodiment the first layer comprises a single (e.g. continuous and/or integrally formed) layer. In one embodiment the second layer comprises a single (e.g. continuous and/or integrally formed) layer. In one embodiment the first layer comprises a plurality of (e.g. discrete) segments, sections or portions that together form the first layer. In one embodiment the second layer comprises a plurality of (e.g. discrete) segments, sections or portions that together form the second layer.

This is considered novel and inventive in its own right and thus when viewed from a further aspect the invention provides a helmet comprising an impact mitigating structure, the impact mitigating structure comprising:

a first inner layer; and a second outer layer;

wherein one or both of the first inner layer and the second outer layer comprise a plurality of discrete portions;

wherein the impact mitigating structure further comprises a reactive layer positioned between the first inner layer and the second outer layer, wherein the reactive layer comprises a plurality of elements held between the first inner layer and the second outer layer; and wherein the reactive layer is arranged such that, when the second layer is subject to an impact, the plurality of elements of the reactive layer are configured to roll to facilitate movement of at least one of the plurality of discrete portions relative to at least one of the other of the plurality of discrete portions.

It will be appreciated that the helmet and impact mitigating structure of this aspect of the invention may comprise any (e.g. all) of the optional and preferred features outlined herein with regard to any of the other aspects and embodiments of the invention.

The reactive layer may be arranged in any suitable and desired way between (e.g. one or more portions of) the first inner layer and (e.g. one or more portions of) the second outer layer. In one embodiment the reactive layer comprises a plurality of (e.g. discrete) segments, sections or portions that together form the reactive layer. For example, the plurality of elements of the reactive layer may be distributed in separate regions to provide the plurality of (e.g. discrete) segments, sections or portions that together form the reactive layer. Thus there may be one or more regions (e.g. segments, sections or portions) between the first and second layers (e.g. between the plurality of (e.g. discrete) segments, sections or portions of the reactive layer) over which there are no reactive elements.

When two or more of the first layer, the second layer and the reactive layer comprise a plurality of (e.g. discrete) segments, sections or portions that together form the respective layers, these plurality of (e.g. discrete) segments, sections or portions in the respective layers may correspond to (e.g. align with) each other. Thus, the arrangement (e.g. shape and/or size) of the plurality of (e.g. discrete) segments, sections or portions in two or more of the first layer, the second layer and the reactive layer may correspond to (e.g. align with and/or be the same as) each other.

When the first layer and/or the second layer (and, e.g., the reactive layer) comprise a plurality of (e.g. discrete) segments, sections or portions, preferably the plurality of (e.g. discrete) segments, sections or portions of the first layer and/or the second layer are arranged such that, when one or more of the plurality of (e.g. discrete) segments, sections or portions the second layer is subject to an impact, the plurality of elements of the reactive layer are configured to roll to facilitate movement of one or more of the plurality of (e.g. discrete) segments, sections or portions of the first layer and/or the second layer with respect to each other.

Thus, for example, one or more of the plurality of (e.g. discrete) segments, sections or portions of the second layer may be arranged to move (e.g. independently) relative to other(s) of the plurality of (e.g. discrete) segments, sections or portions of the second layer and/or to move (e.g. independently) relative to the (e.g. plurality of (e.g. discrete) segments, sections or portions of the) first layer. Similarly, one or more of the plurality of (e.g. discrete) segments, sections or portions of the first layer may be arranged to move (e.g. independently) relative to other(s) of the plurality of (e.g. discrete) segments, sections or portions of the first layer and/or to move (e.g. independently) relative to the (e.g. plurality of (e.g. discrete) segments, sections or portions of the) second layer.

The impact mitigating structure may comprise any suitable and desired number of reactive (and other) layers. In a set of embodiment, the impact mitigating structure comprises at least two reactive layers. Preferably, the impact mitigating structure comprises further layers. For example, a first reactive layer may be positioned between the first (inner) layer and an third (intermediate) layer, and a second reactive layer may be positioned between the third (or a fourth intermediate) layer and the second layer. The additional layers may also comprise one or more low friction layers, as described herein, e.g. arranged between the other layers of the impact mitigating structure. There may be multiple layers between or surrounding each reactive and/or low friction layer.

The further reactive layer(s) may be arranged in any suitable and desired configuration, e.g. substantially the same as (e.g. identical to) the first reactive layer. The further (intermediate) layers may be arranged in any suitable and desired configuration, e.g. substantially the same as (e.g. identical to) the first layer and/or the second layer.

The impact mitigating structure may comprise any suitable and desirable number of plural elements. In some embodiments, the number of elements of the plurality of elements is between 5 and 100,000, e.g. between 50 and 10,000, e.g. between 100 and 1,000. In a set of embodiments, the number of elements may be proportional to the size (e.g. surface area) of (one or more of the layers of) the impact mitigating structure. For example, a larger impact mitigating structure may comprise a larger number of elements. In a set of embodiments, the ratio of the surface area of the reactive layer over which the plurality of elements are provided to the surface area of the reactive layer is between 0.05 and 0.5, e.g. between 0.1 and 0.4, e.g. approximately 0.25.

In a set of embodiments, the ratio of the volume of the reactive layer that is occupied by the plurality of elements to the (total) volume of the reactive layer (i.e. the relative density of the plurality of elements) is between 0.15 to 0.6, e.g. between 0.2 and 0.5, e.g. between 0.3 and 0.4. This helps to control the amount of rotation transferred through the helmet to the head of a wearer, preferably to reduce (e.g. minimise) the rotational force transferred through to the wearer's head and brain as a result of an impact, e.g. such that the counter rotation of the wearer's head is reduced (e.g. minimised).

Thus, preferably the relative density of the size of the plurality of elements in the reactive layer is configured to reduce (e.g. minimise) the rotational force transferred through to the wearer's head and brain as a result of an impact.

The plurality of elements may be formed from any suitable and desirable elements that facilitate the movement of one layer of the impact mitigating structure with respect to another. The individual elements of the plurality of elements may vary in form (e.g. shape, size) between themselves or, in some embodiments, the plurality of elements are substantially identical to each other. This may help to improve the consistency of the behaviour of the reactive layer across the impact mitigating structure.

Each element of the plurality of elements may comprise a polyhedron (e.g. having (only) straight edges and flat faces). Preferably the elements are at least partially rounded, e.g. at least half of the surface area of the elements is rounded. Thus, in some embodiments the elements do not comprise any straight edges or flat faces. Rounded elements are able to rotate more easily (e.g. roll relative to the first and/or second layers) to facilitate the movement of the first and/or second layers.

In some embodiments, the elements are (substantially) spheroidal, e.g. spherical. Spheroidal elements can rotate (e.g. roll) in multiple (e.g. any) directions, which helps to improve the movement of the first and/or second layer in an impact (e.g. independently of the direction of the impact) and thus helps to more effectively reduce the transfer of forces through the impact mitigating structure. Such an effect may still be observed for elements having at least a partially rounded surface area.

In one embodiment one or more (e.g. all) of the plurality of elements (e.g. each) have a dimension in one direction that is greater than a dimension in a different (e.g. perpendicular) direction. Thus, for example, one or more of the plurality of elements (e.g. each) have a minimum dimension that is smaller than a maximum dimension of the respective element. The plurality of elements may be shaped in any suitable and desired way to provide this (e.g. non-spherical) shape.

In one embodiment one or more (e.g. all) of the plurality of elements are (substantially) prismatic, e.g. cylindrical (preferably with a (substantially) circular cross-section).

This is considered novel and inventive in its own right and thus when viewed from a further aspect the invention provides a helmet comprising an impact mitigating structure, the impact mitigating structure comprising:

- a first inner layer;
- a second outer layer; and
- a plurality of cylindrical elements held between the first inner layer and the second outer layer;
- wherein the plurality of cylindrical elements are arranged such that, when the second layer is subject to an impact, the plurality of cylindrical elements are configured to roll in a direction perpendicular to the respective axes of the cylindrical elements to facilitate movement of the first inner layer and the second outer layer with respect to each other.

It will be appreciated that the helmet and impact mitigating structure of this aspect of the invention may comprise any (e.g. all) of the optional and preferred features outlined herein with regard to any of the other aspects and embodiments of the invention. Thus, for example, when the second layer is subject to an impact, the plurality of cylindrical elements form part of a reactive layer between the first inner layer and the second outer layer.

Preferably the dimension of the prism (e.g. cylinder) along the (main, projection) axis of the prism (e.g. cylinder) is greater than the dimension of the prism (e.g. cylinder) perpendicular to the (main, projection) axis of the prism (e.g. cylinder). Thus, for example, when the plurality of elements comprise a plurality of cylinders, the length of the cylinders along their axis of symmetry is greater than the diameter of the circle forming the cross-section of the cylinders (perpendicular to the axis). As with the plurality of elements in general, the plurality of cylinders may have a plurality of different sizes and shapes (e.g. ratios of lengths to diameters). Similarly, as with the plurality of elements in general, the plurality of cylinders may comprise a low friction material. The cylinders may be formed from a low friction material or may comprise a low friction coating.

When the plurality of elements have a dimension in one direction that is greater than a dimension in a different (e.g. perpendicular) direction, preferably the plurality of elements are arranged (e.g. distributed and/or positioned) in the reactive layer with the directions of their greater dimensions not (e.g. all) aligned with each other. Thus, for example, when the plurality of elements comprise a plurality of cylinders, preferably the axes of symmetry of the cylinders are not (e.g. all) aligned with each other. Having the plurality of elements non-aligned, such that they are arranged to roll in different directions, when the second layer is subject to an impact, to facilitate movement of the first inner layer and the second outer layer with respect to each other, helps to control the amount and/or direction of rolling of the plurality of elements and thus the amount and/or direction of the friction between the first and second layers.

The elements of the plurality of elements may have any suitable and desired size. The Applicant has appreciated that the size of the elements may be chosen depending on the intended application of the impact mitigating structure (e.g. helmet, armour). In some embodiments, the elements (each) have a maximum size (e.g. diameter) of between 0.1 mm and 4 mm, e.g. between 0.5 mm and 3 mm, e.g. between 1 mm and 2 mm. Preferably the elements (each) have a (maximum) size that is greater than a quarter (e.g. greater than a half) of the thickness of the reactive layer, e.g. greater than a quarter (e.g. greater than a half) of the thickness of the separation between the first layer and the second layer.

In some embodiments the plurality of elements each have substantially the same shape, size and/or dimensions. In some embodiments the plurality of elements have a plurality of different shapes, sizes and/or dimensions. For example, the plurality of elements may comprise a plurality of larger elements (having one particular size) and a plurality of smaller elements (having a different, smaller particular size).

The size, and e.g. (relative) density, of the plurality of elements is preferably configured so to reduce (e.g. minimise) the rotational force transferred through to the wearer's head and brain as a result of an impact, e.g. such that the counter rotation of the wearer's head is reduced (e.g. minimised).

The first layer and the second layer may be spaced from each other by any suitable and desired distance. In one embodiment the spacing between the first layer and the second layer (e.g. at least over a region between which the reactive layer is provided) is substantially constant. In this embodiment the spacing between the first layer and the second layer is variable (e.g. at least over a region between which the reactive layer is provided). Thus, for example, there may be a region over which the spacing between the first layer and the second layer is less than the spacing between the first layer and the second layer over a different region.

When the spacing between the first layer and the second layer is variable, preferably the size of the plurality of elements is variable (e.g. to match the spacing of the of the first and second layers). Thus, for example, the plurality of elements may be smaller in a first region over which the spacing between the first layer and the second layer is smaller and the plurality of elements may be larger (than the size of the plurality of elements in the first region) in a second region over which the spacing between the first layer and the second layer is larger (than the spacing in the first region).

This is considered to be novel and inventive in its own right and thus when viewed from a further aspect the invention provides a helmet comprising an impact mitigating structure, the impact mitigating structure comprising:

a first inner layer;

a second outer layer;

wherein the first inner layer is spaced from the second outer layer by a first spacing over a first region between the first inner layer and the second outer layer;

wherein the first inner layer is spaced from the second outer layer by a second spacing over a second region between the first inner layer and the second outer layer;

wherein the first spacing is greater than the second spacing; and wherein the impact mitigating structure comprises a plurality of rollable elements held between the first inner layer and the second outer layer;

wherein the plurality of rollable elements comprise a first plurality of rollable elements arranged over the first region between the first inner layer and the second outer layer;

wherein the plurality of rollable elements comprise a second plurality of rollable elements arranged over the second region between the first inner layer and the second outer layer; and wherein the first plurality of rollable elements are larger than the second plurality of rollable elements.

It will be appreciated that the helmet and impact mitigating structure of this aspect of the invention may comprise any (e.g. all) of the optional and preferred features outlined herein with regard to any of the other aspects and embodiments of the invention. Thus, preferably the are arranged such that, when the second layer is subject to an impact, the plurality of elements (which, e.g., form part of a reactive layer) are configured to roll to facilitate movement of the first inner layer and the second outer layer with respect to each other. Preferably the first plurality of rollable elements have a greater maximum dimension (e.g. diameter) than the second plurality of rollable elements. Preferably the first plurality of rollable elements have a greater minimum dimension than the second plurality of rollable elements.

The elements may be formed from any suitable and desirable material. The elements may comprise a substantially incompressible fluid. The elements may comprise a non-Newtonian fluid. Preferably the elements are substantially (e.g. wholly) solid (i.e. the elements are incompressible and have a fixed shape). For example, the elements may be formed from a material having a Shore A hardness of greater than 50, e.g. greater than 100. Materials with this hardness are not easily compressed or deformed. Using substantially incompressible (i.e. solid) elements improves the rolling (e.g. rotation) of the elements during an impact, which helps to improve the movement of the first and second layers with respect to each other. Preferably the plurality of elements are stiff, e.g. having a Young's modulus greater than 0.1 GPa, e.g. greater than 1 GPa, e.g. greater than 10 GPa.

In a set of embodiments, the plurality of elements comprise a low friction material. The elements may be formed from a low friction material, or may comprise a low friction coating. Any suitable and desirable low friction material and/or coating may be used. In a set of embodiments, the coefficient of friction is less than 0.6, e.g. less than 0.4, e.g. less than 0.2, e.g. less than 0.1, e.g. approximately 0.05. In some embodiments, the low friction material and/or coating comprises nylon. The low friction material may improve the rolling (e.g. rotation) of the elements (e.g. relative to each other and/or the first and/or second layers) during and/or after an impact to the impact mitigation structure, by allowing the plurality of elements to roll (e.g. rotate) more smoothly during and/or after the impact. This may facilitate increased and/or smoother movement of the first and second layers with respect to each other during and/or after an impact.

In one set of embodiments one or more (e.g. all) of the plurality of elements, the first layer and the second layer comprise a high friction material and/or coating. This may help to facilitate a torque between the plurality of elements and the first and/or second layer, when the impact mitigating structure is subject to an impact and the plurality of elements come into contact with the first and/or second layer. This torque (which, e.g., overcomes the rolling resistance) helps the plurality of elements to roll (rather than to slip and slide against the first and/or second layer, for example) to facilitate the movement of the first and second layers relative to each other.

Thus, instead of providing a low friction layer between the first and second layers to facilitate movement of the layers relative to each other, for example, the Applicant has appreciated that movement of the first and second layers relative to each other is greatly improved by the rolling of the plurality of elements, which itself is facilitated by the friction between the plurality of elements and the first and/or second layer.

This is considered to be novel and inventive in its own right and thus when viewed from a further aspect the invention provides a helmet comprising an impact mitigating structure, the impact mitigating structure comprising:

a first inner layer;

a second outer layer; and a plurality of elements held between the first inner layer and second outer layer;

wherein one or more of the plurality of elements, the first inner layer and the second outer layer comprise a high friction material and/or coating such that, when the impact mitigating structure is subject to an impact, the plurality of elements are configured to contact one or both first inner layer and the second outer layer, such that the high friction material causes the plurality of elements to roll to facilitate movement of the first inner layer and the second outer layer with respect to each other.

It will be appreciated that the helmet and impact mitigating structure of this aspect of the invention may comprise any (e.g. all) of the optional and preferred features outlined herein with regard to any of the other aspects and embodiments of the invention. Thus, preferably, the plurality of elements form at least part of a reactive layer.

In preferred embodiments, the plurality of elements are held directly against (e.g. in contact with) the first and/or second layer, preferably with no intermediate layer or interface (e.g. low friction layer and/or (e.g. flexible layer) retaining structure) between. This helps to exploit the friction between the plurality of elements and the first and/or second layer, to initiate rolling of the plurality of elements on the first and/or second layer. Preferably the first and/or second layer, with which the plurality of elements contact, comprises a hard layer (e.g. harder than an impact absorbing layer of the impact mitigating structure, where provided).

In one set of embodiments one or more (e.g. all) of the plurality of elements, the first layer and the second layer comprise a textured or structured surface. The textured or structured surface of the plurality of elements may be complementary to the textured or structured surface of the first and/or second layer, which contact each other when the impact mitigating structure is subject to an impact. For example, the one or more (e.g. all) of the plurality of elements, the first layer and the second layer may comprise a rack and pinion, cogs, interlinking elements, a ratchet and spindle that are configured to engage with each other when the impact mitigating structure is subject to an impact. Again, this helps to facilitate a torque between the plurality of elements and the first and/or second layer, when the impact mitigating structure is subject to an impact.

In a set of embodiments, the hardness of the plurality of elements is greater than the hardness of the first layer and/or the second layer. However, as outlined below, the first and/or second layer may comprise a harder coating (or additional hard layer) to interface with the plurality of elements. The hardness of the elements compared with the first layer and/or second layer helps to improve the rolling (e.g. rotation) of the elements (e.g. relative to each other and/or the first and/or second layers) during and/or after an impact to the impact mitigation structure, by reducing (e.g. substantially eliminating) the deformation of the elements during an impact.

The plurality of elements may have different shapes, sizes and/or be formed from different materials. However, preferably the elements are substantially identical in one or more (e.g. all) of their shape, size and material.

The plurality of elements may be held between the first and second layers in any suitable and desired way. Preferably the reactive layer is arranged such that, when the second layer (or, e.g., reactive layer) is subject to an impact, the plurality of elements of the reactive layer are configured to translate (be displaced) to facilitate movement of the first inner layer and the second outer layer with respect to each other, e.g. in addition to the plurality of elements being configured to roll when subject to an impact.

In a preferred embodiment the plurality of elements of the reactive layer are held in a particular (e.g. fixed) arrangement (e.g. array) between the first and second layers. Thus the plurality of elements may be held (e.g. fixed) in the particular arrangement during normal use of the helmet but then disrupted (and, e.g., freed) from the particular arrangement in an impact, to allow the plurality of elements to roll to allow the first and second layers to move relative to each other.

Preferably the plurality of elements are configured to be released (e.g. from the particular arrangement) when the impact mitigating structure is subject to an impact. Preferably the plurality of elements are configured to roll after they have been released. Thus, in this way, the plurality of elements of the reactive layer are configured to "react" to the impact, facilitating the movement (e.g. sliding) of (at least a portion of) the first inner layer and (at least a portion of) the second outer layer with respect to each other, e.g. through providing a low friction interface (i.e. the reactive layer once the plurality of elements have been released) between the first and second layers.

This is considered novel and inventive in its own right and thus when viewed from a further aspect the invention provides a helmet comprising an impact mitigating structure, the impact mitigating structure comprising:

- a first inner layer;
- a second outer layer; and
- a plurality of elements held between the first inner layer and second outer layer;
- wherein the plurality of elements are held in a particular arrangement between the first inner layer and second outer layer;
- wherein the plurality of elements are retained in the particular arrangement when the impact mitigating structure is subject to an impact below a particular threshold force;
- wherein at least some of the plurality of elements are released from the particular arrangement when the impact mitigating structure is subject to an impact above particular threshold force; and
- wherein the released elements are configured to facilitate movement of the first inner layer and second outer layer with respect to each other.

It will be appreciated that the helmet and impact mitigating structure of this aspect of the invention may comprise any (e.g. all) of the optional and preferred features outlined herein with regard to any of the other aspects and embodiments of the invention. Thus, preferably, the plurality of elements form at least part of a reactive layer. Preferably the force of the impact that is assessed against the particular (threshold) force is the tangential component of the force of the impact, e.g. that causes rotation of the layers of the helmet relative to each other. Thus preferably the particular (e.g. threshold) force is a tangential component (with respect to the (e.g. layers of the) impact mitigating structure) of a force having a particular (e.g. threshold) tangential value. It is this component of the force that acts to rotate the helmet and thus, potentially, the head of the wearer.

Preferably the particular arrangement of the plurality of elements of the reactive layer is configured to be disrupted (e.g. to allow the plurality of elements to roll) when the second layer is subject to an impact to facilitate movement of the first inner layer and the second outer layer with respect to each other.

In a set of embodiments, the reactive layer is arranged to allow the plurality of elements to (e.g. be released and to) roll (to allow the first and second layers to move relative to each other) when the (e.g. second layer of the) impact mitigating structure is subject to an impact having at least a particular (e.g. predetermined, threshold) force (e.g. an oblique force). Thus preferably the reactive layer is arranged to allow the particular arrangement of the plurality of elements to be (e.g. released and) disrupted when the (e.g. second layer of the) impact mitigating structure is subject to an impact having at least a particular (e.g. predetermined, threshold) force (e.g. an oblique force). Thus preferably the reactive layer is configured to hold the plurality of elements in position (e.g. in a fixed or particular arrangement, e.g. against the first and/or second layers) until the impact mitigating structure is subject to an impact having at least a particular (e.g. predetermined, threshold) force (e.g. an oblique force). This helps to retain the plurality of elements (e.g. in their particular arrangement) during normal use and to roll (e.g. be disrupted from the particular arrangement) when subject to an (e.g. sufficiently large) impact (i.e. greater than or equal to the particular (e.g. tangential) force).

In some embodiments, the plurality of elements are arranged to be (e.g. released and) displaced from the location at which they are held when the (e.g. second layer of the) impact mitigating structure is subject to an impact, e.g. when the plurality of elements are disrupted (e.g. released) from the particular arrangement. For example, the elements may move freely away from their (previously) fixed position, e.g. in addition to rolling. In a set of embodiments, the plurality of elements are arranged to roll when they are disrupted from the particular arrangement. For example, when the second layer is subjected to an impact the plurality of element may be arranged to roll (e.g. rotate) at a fixed location (in the reactive layer.

Preferably the reactive layer is configured such that, when the impact mitigating structure is subject to an impact (e.g. having at least the particular force), the plurality of elements are substantially not constrained and are able to move freely. Preferably the plurality of elements are configured to have substantially random and disordered free motion, e.g. in any orientation and around any axis, when they are disrupted. Preferably the reactive layer is configured such that the plurality of elements are free to move in three dimensions when they are disrupted (e.g. freed by the impact). Preferably the (e.g. plurality of elements of the) reactive layer are configured to substantially prevent geometric locking of the inner and/or outer layers, when the impact mitigating structure is subject to an impact.

Preferably the (e.g. plurality of elements of the) reactive layer is configured such that, when the impact mitigating structure is subject to an impact (e.g. having at least the particular force), the plurality of elements are released from the reactive layer with a maximum speed of 200 $ms^{-1}$ and/or an average speed of 80 $ms^{-1}$. Preferably the (e.g. plurality of elements of the) reactive layer is configured such that, when the impact mitigating structure is subject to an impact (e.g. having at least the particular force), the plurality of elements have a substantially constant rolling resistance that is substantially independent of their speed.

The particular force required for the plurality of elements to be disrupted may be chosen to have any suitable and desired value (e.g. such that the first and second layers move relative to each other as the result of a sufficiently large impact). In one embodiment the particular (e.g. predetermined, threshold) force is between 10 and 100 N, e.g. between 30 N and 70 N, e.g. approximately 50 N. The particular force may, for example be chosen such that it reflects the lowest range of forces acting on the impact mitigating structure which may cause damage (e.g. an injury) to the body that the impact mitigating structure is protecting, or such that it reflects the maximum force the user protected by the helmet can exert on the impact mitigating structure (e.g. during normal use, other than undergoing an impact). Having a relatively low value for the particular force helps to reduce the amount of energy that is transferred into the impact mitigating structure from the impact to initiate operation of the reactive layer, which helps to reduce the energy that is transferred through to the user.

The plurality of elements may be held in any desirable and suitable arrangement. Preferably the particular arrangement comprises a fixed (e.g. spatial) arrangement of the plurality of elements. For example, the plurality of elements may be held in this fixed arrangement (e.g. such that the plurality of elements have a defined position relative to each other) until the plurality of elements are disrupted by an impact. In one embodiment the particular arrangement comprises a (e.g. regular) array. Thus, the plurality of elements may be distributed (e.g. spaced) uniformly within (e.g. across) the reactive layer. For example, the plurality of elements may be distributed (e.g. spaced) according to a geometric distribution (pattern). However, other patterns and separations of the plurality of elements are envisaged.

The fixed (e.g. spatial) arrangement, e.g. as well as the size and/or relative) density, of the plurality of elements is preferably configured so to reduce (e.g. minimise) the rotational force transferred through to the wearer's head and brain as a result of an impact, e.g. such that the counter rotation of the wearer's head is reduced (e.g. minimised).

The particular arrangement in which the plurality of elements are held in the reactive layer may be such that reactive layer comprises a plurality of layers (e.g. each) of a plurality of elements. Preferably the plurality of layers of elements are arranged to lie substantially parallel to each other, e.g. extending substantially perpendicular to the thickness of the reactive layer. Preferably the plurality of layers of elements overlap each other (e.g. across the majority, e.g. substantially the whole, of their surface area of the layers). In one embodiment the reactive layer comprises only a single layer of a plurality of elements.

The plurality of elements may be held (e.g. in the particular arrangement) between the first and second layers by any suitable and desirable retaining means. In one embodiment the first and/or second layers themselves are arranged to hold the plurality of elements (e.g. in the particular arrangement) between the first and second layers (e.g. during normal use). In one set of embodiments, the impact mitigating structure comprises a support structure and/or a retaining structure arranged to hold the plurality of elements (e.g. in the particular arrangement) between the first and second layers (e.g. during normal use). Preferably the support structure and/or the retaining structure is arranged to (e.g. release the plurality of elements to) allow the plurality of elements to roll when the (e.g. second layer of the) impact mitigating structure is subject to an impact (e.g. having at least the particular force).

The plurality of elements may be held (e.g. in the in the particular arrangement) in the support structure and/or the retaining structure between the first and second layers by any suitable and desirable retaining means. For example, the elements may be held in the support structure and/or the retaining structure by one or more of: gravity, electrostatics, friction, grooves, one or more magnets and an adhesive.

This is considered novel and inventive in its own right and thus when viewed from a further aspect the invention provides a helmet comprising an impact mitigating structure, the impact mitigating structure comprising:

- an inner impact absorbing layer; and
- an outer reactive layer positioned over at least a portion of the impact absorbing layer;
- wherein the reactive layer comprises a support structure and/or a retaining structure and a plurality of elements held in the support structure and/or the retaining structure; and
- wherein the support structure and/or the retaining structure are configured such that, when the reactive layer is subject to an impact, the plurality of elements of the reactive layer roll to facilitate movement of the reactive layer and the impact absorbing layer with respect to each other.

Thus it will be seen that the present invention also provides a helmet including an impact mitigating structure having an inner impact absorbing layer (e.g. similar to the first inner layer described herein) and an outer reactive layer on the impact absorbing layer (e.g. without an additional second outer layer). The reactive layer provides a support structure and/or a retaining structure for the plurality of elements, to hold them in the support structure and/or the retaining structure on the first layer, e.g. in the particular arrangement. When the (e.g. reactive layer) of the impact mitigating structure is subject to an impact, the plurality of elements are configured to roll, facilitating movement of the reactive layer relative to the impact absorbing layer. Again, this helps to transfer some of the energy from the impact into movement of the layers relative to each other. This helps to absorb, deflect and/or dissipate energy from the impact, such that it is not transferred through to the impact absorbing layer and the head that the helmet is trying to protect.

It will be appreciated that the helmet and impact mitigating structure of this aspect of the invention may comprise any (e.g. all) of the optional and preferred features outlined herein with regard to any of the other aspects and embodiments of the invention. For example, preferably the plurality of elements are held in the support structure and/or the retaining structure by one or more of: gravity, electrostatics, friction, grooves, one or more magnets and an adhesive. Preferably the plurality of elements are held in a particular arrangement in the support structure and/or the retaining structure. Preferably the (e.g. particular arrangement of the) plurality of elements of the reactive layer are (is) configured to be disrupted (e.g. to allow the plurality of elements to roll) when the reactive layer is subject to an impact, to facilitate movement of the reactive layer and the impact absorbing layer with respect to each other.

In one embodiment the retaining structure is arranged to retain the plurality of elements (e.g. within the retaining structure) when the impact mitigating structure is subject to an impact (e.g. having at least the particular force). This helps to prevent the plurality of elements from being released, e.g. into the face of a wearer of the helmet, when the impact mitigating structure is subject to an impact. Thus preferably the retaining structure at least partially encapsulates and/or surrounds the plurality of elements. The retaining structure may surround the plurality of elements on one side, with the first or the second layer surrounding the plurality of elements on the other side. Thus, for example, the retaining structure may be arranged to retain the plurality of elements against the first or the second layer. Preferably the retaining structure extends over at least a portion of the first layer or the second layer, e.g. to retain the plurality of elements against the first layer or the second layer respectively.

In some embodiments the retaining structure substantially fully encapsulates and/or surrounds the plurality of elements. This helps to prevent the plurality of elements from being released when the impact mitigating structure is subject to an impact, and may allow the retaining structure including the plurality of elements to be manufactured as a separate component.

This is considered to be novel and inventive in its own right and thus when viewed from a further aspect the invention provides a helmet comprising an impact mitigating structure, the impact mitigating structure comprising:

an inner impact absorbing layer; and an outer reactive layer positioned over at least a portion of the impact absorbing layer;

wherein the reactive layer comprises a retaining structure and a plurality of elements held in the retaining structure;

wherein the retaining structure substantially fully encapsulates and/or surrounds the plurality of elements;

wherein the retaining structure is configured such that, when the reactive layer is subject to an impact, the plurality of elements of the reactive layer roll to facilitate movement of the reactive layer and the impact absorbing layer with respect to each other; and wherein the retaining structure is configured such that, when the reactive layer is subject to an impact, the plurality of elements are retained in the retaining structure.

It will be appreciated that the helmet and impact mitigating structure of this aspect of the invention may comprise any (e.g. all) of the optional and preferred features outlined herein with regard to any of the other aspects and embodiments of the invention.

When the retaining structure at least partially (e.g. substantially fully) encapsulates and/or surrounds the plurality of elements, preferably the retaining structure is configured to allow the first and/or second layers to engage with at least some (e.g. all) of the plurality of elements (e.g. through the (e.g. retaining layer(s) of the) retaining structure) when the impact mitigating structure is subject to an impact (e.g. having a force that is greater than or equal to the particular (e.g. tangential) force).

Preferably the retaining structure comprises two layers, wherein the plurality of elements are retained (e.g. sandwiched) between the two layers of the retaining structure. Thus, preferably, the retaining structure comprises a first retaining layer between the plurality of elements and the first layer of the impact mitigating structure, and a second retaining layer between the plurality of elements and the second layer of the impact mitigating structure.

The two layers of the retaining structure are preferably joined (e.g. sealed) together around (e.g. their perimeter and) the plurality of elements, e.g. by an adhesive, heat pressing or ultrasonic welding. Thus, the retaining structure may take the form of a pouch or bag that contains (and retains) the plurality of elements.

In some embodiments, the impact mitigating structure comprises both a support structure (e.g. arranged to hold the plurality of elements in the particular arrangement) and a retaining structure (e.g. arranged to retain the plurality of elements when the impact mitigating structure is subject to an impact). For example, the support structure may hold the plurality of elements (e.g. in the particular arrangement) and the retaining structure may retain the support structure on the first or second layer.

Preferably the plurality of elements of the reactive layer are configured to be released from the (e.g. particular arrangement of the) reactive layer (e.g. from the particular arrangement, e.g. from the support structure and/or within the retaining structure) when the reactive layer is subject to an impact, to facilitate movement of the reactive layer and the impact absorbing layer with respect to each other. In some embodiments the movement of the reactive layer and the impact absorbing layer with respect to each other simply comprises the plurality of elements rolling (e.g. in a fixed location) but preferably comprises displacement of one or more (e.g. all) of the plurality of elements (e.g. from the particular arrangement), the support structure and the retaining structure of the reactive layer, with respect to the impact absorbing layer.

The plurality of elements may be attached to, embedded and/or encased in the support structure and/or the retaining structure such that the plurality of elements are held in a particular arrangement. Preferably the support structure and/ or the retaining structure is arranged to maintain the plurality of elements in the particular arrangement unless (and until) the impact mitigating structure is subject to a force which is greater than or equal to the particular force.

In some embodiments, the support structure and/or the retaining structure is formed by (e.g. a portion or features of) the first layer and/or the second layer, e.g. that are complementary to the plurality of elements. The first layer and/or the second layer may comprise (e.g. together provide) the support structure and/or the retaining structure (e.g. a housing or (e.g. flexible) layer) which holds the plurality of elements in the particular arrangement, e.g. (sandwiched) between the first and second layers. In a set of embodiments, the first layer and/or the second layer may be arranged such that the plurality of elements are disrupted (when the impact mitigating structure is subject to an impact) by the (e.g. support structure of the) first layer and/or the second releasing the plurality of elements from (being contained by or between) the (e.g. housing formed by the) first layer and/or the second layer.

In a set of embodiments, the reactive layer comprises a support structure (e.g. separate from the first layer and the second layer) arranged to hold the plurality of elements in the particular arrangement. In these embodiments, preferably the support structure is held (e.g. sandwiched) between the first layer and the second layer. The support structure may be held between the first layer and the second layer in any suitable and desired way. For example, the support structure may simply be sandwiched (e.g. held by friction) between the first and second layers. In some embodiments the support structure is attached to the first layer and/or the second layer, e.g. by an adhesive or by bonding.

In a set of embodiments, the support structure (whether as part of the first layer, the second layer or the reactive layer) comprises a plurality of locating points arranged to hold the plurality of elements (respectively) in the support structure, e.g. in the particular arrangement. In one embodiment, the (e.g. plurality of locating points of the) support structure comprises a plurality of recesses (e.g. in the surface of the support structure). The plurality of recesses may be formed by a plurality of projections from the surface of the support structure.

Preferably each of the plurality of recesses is arranged to hold a respective element of the plurality of elements in a particular (e.g. fixed) location (i.e. in the recess) such that the plurality of elements are held in the support structure, e.g. in the particular arrangement. Thus preferably the plurality of recesses are arranged to allow the plurality of elements to roll, e.g. to release the plurality of elements from the (e.g. particular arrangement in the) support structure, when the impact mitigating structure is subject to an impact. Preferably the plurality of recesses are arranged to allow the plurality of elements translate (e.g. be displaced) and/or rotate freely to roll, when the impact mitigating structure is subject to an impact.

In one embodiment the (e.g. plurality of locating points of the) support structure comprises a plurality of connectors for connecting the plurality of elements to the support structure to hold the plurality of elements in the (e.g. particular arrangement in the) support structure. Preferably each element of the plurality of elements is connected to a respective connector of the plurality of connectors. Preferably the plurality of elements are arranged to disconnect (e.g. separate or break) from the plurality of connectors when the (e.g. second layer of the) impact mitigating structure is subject to an impact, such that the plurality of elements are able to roll and/or, e.g., are disrupted (e.g. released) from the particular arrangement, e.g. such the plurality of elements can translate (e.g. be displaced) and/or rotate freely.

As discussed above, in some embodiments, the plurality of elements comprise plural discrete elements, e.g. when held in the (e.g. particular arrangement in the) support structure (and when released from the particular arrangement). However, in some embodiments the plurality of elements are connected (e.g. integrally) to the plurality of connectors and thus, for example, to the support structure.

The plurality of connectors may comprise a plurality of projections from the surface of the support structure, to which the plurality of elements are connected. In one embodiment the plurality of elements are attached (e.g. impregnated or bonded) directly to the (e.g. support structure of the) first layer and/or the second layer. Thus, for example, the plurality of elements may be formed (e.g. directly, integrally) on the first layer and/or the second layer. Preferably the plurality of elements are arranged to disconnect (e.g. separate or break) from the (e.g. support structure of the) first layer and/or the second layer when the (e.g. second layer of the) impact mitigating structure is subject to an impact, such that the plurality of elements are allowed to roll (e.g. be disrupted (e.g. released) from the (e.g. particular arrangement in the) support structure. In these embodiments the plurality of elements may be disrupted by the force of the impact overcoming (e.g. breaking) the chemical and/or physical bond between the plurality of elements and the (e.g. support structure of the) first layer and/or the second layer.

In one embodiment the support structure comprises a rigid structure, e.g. formed from a (e.g. thermo)polymer. This may be the same material from which the first layer and/or second layer (or, e.g., a coating thereof) is formed.

In one set of embodiments the support structure (e.g. of the reactive layer) comprises a flexible or compressible layer, such as a gel, a foam or an adhesive. For example, the plurality of elements may be impregnated or embedded in a gel, a foam or an adhesive to hold the plurality of elements in the (e.g. particular arrangement in the) support structure. The flexible or compressible layer preferably has a thickness that is greater than the (e.g. maximum) dimension of the plurality of elements, e.g. a thickness between 0.1 mm and 5 mm, e.g. between 1 mm and 4 mm, e.g. between 2 mm and 3 mm.

In one set of embodiments, the retaining structure comprises a flexible (e.g. polymer, textile or metal) layer (such as a wrapping or retaining layer) formed over or around the plurality of elements to hold the plurality of elements in the (e.g. particular arrangement in the) retaining structure. In one set of embodiments, the retaining structure comprises two flexible (e.g. polymer, textile or metal) retaining layers that substantially fully encapsulate and/or surround the plurality of elements. The flexible layer(s) may hold the support structure (itself holding the plurality of elements) in the impact mitigating structure.

The flexible (e.g. textile) layer(s) may comprise a flexible material such as fabric, mesh, textile or cloth. When the flexible layer(s) has one or more (preferably a plurality of) holes therein (e.g. in a mesh or textile), preferably the dimension(s) of (each of) the one or more holes is less than the dimension(s) of (each of) the plurality of elements, preferably such that the plurality of elements do not pass through the hole(s) of the flexible layer(s). This helps to retain the plurality of elements within the retaining structure. The flexible or compressible layer(s) preferably has a thickness that is less than the (e.g. maximum) dimension of the plurality of elements, e.g. a thickness less than 2 mm, e.g. less than 1 mm, e.g. less than 0.5 mm, e.g. less than 0.1 mm.

When the plurality of elements are held in place (during normal use) by a gel, a foam or an adhesive, preferably the plurality of elements are configured to be released from the gel, foam or adhesive when the impact mitigating structure is subject to an impact, e.g. above a particular (threshold) force. Preferably the plurality of elements are configured to be released from the gel, foam or adhesive by rolling (e.g. away from the gel, foam or adhesive), e.g. rather than a bond with the gel, foam or adhesive being ruptured.

The way in which the plurality of elements are held in place may be configured so to release the plurality of elements when the impact mitigating structure is subject to an impact (e.g. having a force that is greater than or equal to the particular force). Preferably the plurality of elements are (e.g. each) held in place (e.g. to one or more other surfaces, layers and/or other components of the impact mitigating structure) by a bond (e.g. adhesive), wherein one or more (e.g. all) of the plurality of elements are configured to be released from the respective bonds (e.g. when the impact mitigating structure is subject to an impact having a force that is greater than or equal to the particular force) by peeling away from the respective bonds.

This is considered to be novel and inventive in its own right and thus when viewed from a further aspect the invention provides a helmet comprising an impact mitigating structure, the impact mitigating structure comprising:

a first inner layer;

a second outer layer; and one or more connectors that extend between the first inner layer and the second outer layer;

wherein first inner layer and/or the second outer layer are configured to peel away from the one or more connectors, when the impact mitigating structure is subject to an impact, e.g. having a force that is greater than or equal to the particular force.

It will be appreciated that the helmet and impact mitigating structure of this aspect of the invention may comprise any (e.g. all) of the optional and preferred features outlined herein with regard to any of the other aspects and embodiments of the invention.

For example, the one or more connectors (that are attached to one or both of the first inner layer and the second outer layer, and preferably connect the first inner layer to the second outer layer) may comprise a plurality of elements and/or the manner in which they are held in place. Thus preferably the plurality of elements are attached to one or both of the first inner layer and the second outer layer by respective (e.g. adhesive) bonds, wherein the one or more (e.g. all) of the plurality of elements and/or the respective bonds are configured to peel away from the first inner layer and/or the second outer layer, when the impact mitigating structure is subject to an impact (e.g. having a force that is greater than or equal to the particular force).

Preferably the (peeling of the) one or more connectors are configured to release one or both of the first inner layer and the second outer layer from the connectors, and thus from each other, when the impact mitigating structure is subject to an impact (e.g. having a force that is greater than or equal to the particular force). Preferably the one or more connectors are configured to release by rotating, e.g. the one or more connectors are configured to be rotated by the impact. In one embodiment the one or more connectors comprise an hourglass shape.

Preferably, the flexible layer(s) of the retaining structure is arranged to stretch (e.g. in a tangential direction) when the impact mitigating structure is subject to an impact. This may help to prevent tearing of the flexible layer(s) in an impact and thus helps to retain the plurality of elements within the retaining structure. Thus preferably the flexible layer(s) of the retaining structure is arranged to not to tear, fracture, rupture and/or break (i.e. remain intact), when the impact mitigating structure is subject to an impact, so as to retain the plurality of elements therein.

The flexible layer(s) may be arranged to stretch elastically (and thus be arranged to return substantially to its original shape after being stretched) or the flexible layer(s) may be arranged to stretch plastically (and thus be arranged not to return to its original shape after being stretched).

Thus, preferably, the support structure and/or the retaining structure is arranged to recover substantially to its original shape and/or position after the impact mitigating structure is subject to an impact.

In some embodiments, the flexible layer(s) of the retaining structure is arranged to tear when the impact mitigating structure is subject to an impact, e.g. above a particular (threshold) force. The flexible layer(s) may be arranged to tear after stretching (e.g. after certain amount of stretching) or the flexible layer(s) may be arranged to tear substantially without stretching (e.g. in a tangential direction).

The (e.g. flexible layer(s) of the) retaining structure may be attached to the remainder of the impact mitigating structure in any suitable and desired way. In one embodiment the retaining structure is attached to the same part of the impact mitigating structure as the part of the impact mitigating structure adjacent the reactive layer. Thus, for example, when the reactive layer is adjacent the first layer and/or the second layer (and, e.g., comes into contact with the first layer and/or the second layer respectively, e.g. when the impact mitigating structure is subject to an impact), preferably the retaining structure is attached to the first layer and/or the second layer respectively.

In one embodiment, the retaining structure is attached to the part of the impact mitigating structure that is on the opposite side of the retaining structure from the plurality of elements, e.g. the part of the impact mitigating structure adjacent the retaining structure. Thus, for example, when the retaining structure is adjacent the first layer and/or the second layer, preferably the retaining structure is attached to the first layer and/or the second layer respectively of the impact mitigating structure. When the retaining structure comprises first and second retaining layers between the plurality of elements and the first and second layers respectively of the impact mitigating structure, preferably the first and/or second retaining layers are attached to the first layer and/or the second layer respectively of the impact mitigating structure.

The retaining structure may (e.g. instead of or as well) be attached to the impact absorbing layer (e.g. through or via a harder outer layer).

The retaining structure may be bonded to the remainder of the impact mitigating structure, e.g. to any suitable and desired part thereof. The retaining structure may be bonded by ultrasonic welding or heat pressing, for example.

The retaining structure may be clamped to the remainder of the impact mitigating structure, e.g. the (e.g. flexible layer of the) retaining structure may be clamped between the first and second layers, or between the first (or second) layer and the impact absorbing layer. The retaining structure may be integrally formed with the remainder of the impact mitigating structure, e.g. the (e.g. flexible layer of the) retaining structure may be integrally formed with one or more of the first layer, the second layer and the impact absorbing layer.

The retaining structure may be attached to the remainder of the impact mitigating structure by an adhesive, e.g. the (e.g. flexible layer(s) of the) retaining structure may be attached to the first and/or second layers of the impact mitigating structure by an adhesive. When the retaining structure comprises one or more (e.g. flexible) retaining layers, the retaining layer(s) may be attached to the rest (e.g. the first and/or second layers) of the impact mitigating structure during the assembly process of manufacturing the impact mitigating structure. For example, the various components of the (e.g. reactive layer of the) impact mitigating structure may be assembled and then attached together, such that the retaining layer is secured (by any suitable and desired means) to the remainder of the impact mitigating structure.

The retaining structure may be attached to the remainder of the impact mitigating structure by one or more fasteners, e.g. that fasten the retaining structure to one or more of the first layer, the second layer and the impact absorbing layer. The retaining structure may be attached to the remainder of the impact mitigating structure via one or more (e.g. interlinked) notches and/or protrusions in the remainder of the impact mitigating structure. For example, the retaining structure may be attached to one or more of the first layer, the second layer and the impact absorbing layer via one or more notches and/or protrusions in these layers. Two or more of the first layer, the second layer and the impact absorbing layer may comprise complementary notch(es) and protrusion(s) (e.g. that extend into the notch(es) respectively) between which the retaining structure is secured.

When the impact mitigating structure comprises a first layer, a second layer and a retaining structure, for example, the first and second layers may be attached to each other directly, the first and second layers may be attached to each other via an intermediate component, and/or the first and second layers may be attached to each other via the (e.g. retaining structure of the) reactive layer.

In one set of embodiments the first and second layers are attached to each other directly, e.g. by heat pressing, ultrasonic welding or an adhesive.

In one set of embodiments the first and second layers are attached to each other via an intermediate component, e.g. by one or more struts and/or spacers that extend between the first and second layers. In one embodiment the strut(s) and/or spacer(s) are compressible and are preferably configured to be compressed when the impact mitigating structure is subject to an impact, e.g. such that the first and/or second layers contact at least some (e.g. all) of the plurality of elements (e.g. when the impact mitigating structure is subject to an impact having a force that is greater than or equal to the particular force).

Thus preferably the (e.g. strut(s) and/or spacer(s) are sized such that) the first and second layers are spaced from each other by a distance that is greater than the corresponding dimension of the plurality of elements, at least over the area over which the plurality of elements are distributed, e.g. the strut(s) and/or spacer(s) are arranged to space the first and/or second layers from the plurality of elements. The first and second layers may be spaced from each other (e.g. at the strut(s) and/or spacer(s)) by any suitable and desired distance, e.g. between 1 mm and 5 mm, e.g. between 2 mm and 4 mm, e.g. approximately 3 mm.

Spacing the first and second layers from each other by more than the size of the plurality of elements helps to reduce the friction between the first and/or second layers and the plurality of elements. Providing a strut or spacer to attach the first and second layers to each other, while spacing the first and second layers from each other at and around these attachment points, also helps to reduce the friction between the first and second layers at or near to these attachments points (e.g. where there may not be any of the plurality of elements in the immediate vicinity), when the impact mitigating structure is subject to an impact. This may help to reduce the risk of geometric locking between the first and second layers, when they move relative to each other when the impact mitigating structure is subject to an impact.

The strut(s) and/or spacer(s), when compressible, may be formed from foam (e.g. foam tape), for example. The foam tape may be arranged to peel away from the first and/or second layer, when the impact mitigating structure is subject to an impact (e.g. having a force that is greater than or equal to the particular force). The peeling of the foam tape (as opposed, for example, to the foam tape shearing) may help to control the particular force at which the first and second layers are displaced relative to each other to disrupt the plurality of elements.

In one embodiment the strut(s) and/or spacer(s) are (e.g. hinged and) arranged to pivot (e.g. at either or both ends where they attach to the first and second layers) when the impact mitigating structure is subject to an impact. This helps to allow the (e.g. retaining and/or support structure of the) reactive layer to move across and/or between the (e.g. doubly curved) surface(s) of the first and/or second layers.

This is considered to be novel and inventive in its own right and thus when viewed from a further aspect the invention provides a helmet comprising an impact mitigating structure, the impact mitigating structure comprising:

- a first inner layer;
- a second outer layer;
- a reactive layer positioned between the first inner layer and the second outer layer, the reactive layer comprising a plurality of elements held between the first inner layer and second outer layer; and
- one or more struts and/or one or more spacers that extend between the first inner layer and the second outer layer;
- wherein the reactive layer is arranged such that, when the second layer is subject to an impact, the one or more struts and/or one or more spacers are configured to pivot such that one or both of the first inner layer and the second outer layer contacts the reactive layer, such that the plurality of elements of the reactive layer are configured to roll to facilitate movement of the first inner layer and the second outer layer with respect to each other.

It will be appreciated that the helmet and impact mitigating structure of this aspect of the invention may comprise any (e.g. all) of the optional and preferred features outlined herein with regard to any of the other aspects and embodiments of the invention.

Preferably at least part of the (e.g. retaining and/or support structure of the) reactive layer is flexible, e.g. the (e.g. retaining and/or support structure of the) reactive layer comprises one or more hinge lines extending across at least part (e.g. all) of the (e.g. retaining and/or support structure of the) reactive layer. Preferably the (e.g. retaining and/or support structure of the) reactive layer is arranged to bend at at least some (e.g. all) of the one or more hinge lines, when the impact mitigating structure is subject to an impact. This may help the (e.g. retaining and/or support structure of the) reactive layer to flex, in an impact, so that it conforms to the (e.g. doubly curved) surface(s) of the first and/or second layers as they move relative to each other.

This is considered to be novel and inventive in its own right and thus when viewed from a further aspect the invention provides a helmet comprising an impact mitigating structure, the impact mitigating structure comprising:

a first inner layer;

a second outer layer; and a reactive layer positioned between the first inner layer and the second outer layer, the reactive layer comprising a plurality of elements held between the first inner layer and second outer layer;

wherein the first inner layer is curved;

wherein the second outer layer is curved;

wherein the reactive layer comprises one or more hinge lines extending across the at least part of the reactive layer;

wherein the reactive layer is arranged such that, when the second layer is subject to an impact, the reactive layer facilitates movement of the first inner layer and the second outer layer with respect to each other and the bends at at least some of the one or more hinge lines so to conform to the curved first inner layer and the curved second layer as they move relative to each other.

It will be appreciated that the helmet and impact mitigating structure of this aspect of the invention may comprise any (e.g. all) of the optional and preferred features outlined herein with regard to any of the other aspects and embodiments of the invention.

The hinge lines in the reactive layer may comprise a sprung (e.g. crimped) portion of the reactive layer, e.g. of the (e.g. flexible layer(s) of the) retaining structure. This may allow the reactive layer to extend (stretch) as well as flex, when the impact mitigating structure is subject to an impact.

Preferably the strut(s) and/or spacer(s) are configured (e.g. have a thickness or diameter) such that the plurality of elements roll over the strut(s) and/or spacer(s) when the strut(s) and/or spacer(s) pivot when the impact mitigating structure is subject to an impact.

In one embodiment the first and second layers are attached to each other at one or more points around (e.g. outside of) the perimeter of the (e.g. retaining structure of the) reactive layer. In one set of embodiments, the first and second layers are attached to each other (e.g. at one or more points) via the (e.g. retaining structure of the) reactive layer, e.g. away from the perimeter of the (e.g. retaining structure of the) reactive layer. In some embodiments the first and second layers are attached to each other both around the perimeter of and via the reactive layer.

The point(s) at which the first and second layers are attached to each other may comprise discrete (spaced apart) point(s) and/or continuous point(s) (e.g. extending along a line). These line(s) may, for example, define separate regions of the reactive layer.

In some embodiments, the strut(s) and/or spacer(s) extend through the (e.g. retaining structure of the) reactive layer. In some embodiments the one or more points at which the first and second layers are attached to each other correspond to, or are located on, the one or more hinge lines of the reactive layer. Thus, preferably the strut(s) and/or spacer(s) extend through the one or more hinge lines of the (e.g. retaining structure of the) reactive layer.

The attachment of the first and second layers to each other, e.g. via the strut(s) and/or spacer(s), may define the hinge line(s) of the (e.g. retaining structure of the) reactive layer. Thus, in some embodiments, the strut(s) and/or spacer(s) are arranged to pivot on, and the (e.g. retaining structure of the) reactive layer is arranged to bend at, the hinge line(s) of the (e.g. retaining structure of the) reactive layer.

While a single support structure and/or a single retaining structure may be used to hold the plurality of elements, e.g. in the particular arrangement, in a set of embodiments the impact mitigating structure comprises a plurality of (e.g. discrete) support structures and/or a plurality of (e.g. discrete) retaining structures, each arranged to hold a plurality of elements in (e.g. a respective particular arrangement in) the respective support structure and/or retaining structure. This may help to increase the particular force required to disrupt the plurality of elements or may help to allow only some of the plurality of elements to be disrupted at a time (e.g. depending on the nature of the impact). This may help to control the magnitude of the particular force that is necessary to disrupt the plurality of elements or to control the movement of the first and second layers relative to each other to be localised to the location of the impact.

Thus, the reactive layer may comprise a plurality of discrete portions, each comprising a plurality of elements and, e.g., a respective support and/or retaining structure. The discrete portions of the reactive layer may be defined (and delineated) by the one or more hinge lines of the reactive layer. One or more (e.g. all) of the discrete portions of the reactive layer, and of the support and/or retaining structures may comprise any or each of the preferred and optional features outlined herein with respect to the individual reactive layer, support and/or retaining structure.

When the (e.g. second layer or reactive layer of the) impact mitigating structure is subject to an impact (e.g. that is greater than or equal to the particular force), the (e.g. particular arrangement of the) plurality of elements may be configured to roll (e.g. be disrupted to allow them to roll) in any suitable and desirable manner to facilitate the movement of the first layer and the second layer (or the reactive layer) with respect to the each other, e.g. depending on how the plurality of elements are held, e.g. in the particular arrangement, the support structure and/or the retaining structure, according to one or more of the embodiments described herein.

In a set of embodiments, the support structure is arranged to break (e.g. fracture and/or disintegrate) when the (e.g. second layer or reactive layer of the) impact mitigating structure is subject to an impact, e.g. having a force that is greater than or equal to the particular (e.g. threshold) force. Preferably the plurality of elements are arranged to be released from the particular arrangement (e.g. and thus free to move) when the support structure breaks. Preferably the plurality of elements are arranged to move freely (e.g. translate and/or rotate) when they are disrupted (e.g. released) from the particular arrangement, to enable the first layer and the second layer to move (e.g. slide) with respect to each other (or the first layer relative to the reactive layer).

In one embodiment one or more (e.g. all) of the plurality of elements are connected together (e.g. comprise connectors extending therebetween), e.g. in, as part of, in addition to or instead of the support structure and/or the retaining structure. In one embodiment one or more (e.g. all) of the plurality of elements is connected to one or more (e.g. all) of the other(s) of the plurality of elements. Thus, for example, pairs of elements may be connected, a (e.g. linear) string of elements may be connected, or a (two dimensional or three dimensional) web or array of elements may be connected.

This is considered novel and inventive in its own right and thus when viewed from a further aspect the invention provides a helmet comprising an impact mitigating structure, the impact mitigating structure comprising:

a first inner layer;

a second outer layer; and a plurality of elements held between the first inner layer and second outer layer;

wherein the plurality of elements are held in a between the first inner layer and second outer layer by a plurality of connectors extending between the plurality of elements and one or more of the first inner layer, the second outer layer and others of the plurality of elements;

wherein the plurality of connectors are configured to release at least some of the plurality of elements when the impact mitigating structure is subject to an impact; and wherein the released elements are configured to facilitate movement of the first inner layer and the second outer layer with respect to each other.

It will be appreciated that the helmet and impact mitigating structure of this aspect of the invention may comprise any (e.g. all) of the optional and preferred features outlined herein with regard to any of the other aspects and embodiments of the invention. Thus, preferably, the plurality of elements form at least part of a reactive layer.

The one or more (e.g. all) of the plurality of elements may be connected together in any suitable and desired way. In one embodiment the elements are connected together by one or more of string(s), cord(s), thread(s), spring(s), tape(s), webbing, mechanical fixture(s) (e.g. latch, hook or gate) and rod(s). The connection(s) between the elements may be one or more of: flexible, rigid, plastic, elastic, brittle and frangible. Thus the connection(s) between the elements may be configured to do one or more of stretch, deform, detach, fracture, snap and rupture, when the impact mitigating structure is subject to an impact, e.g. exceeding a threshold. Preferably this acts to release the plurality of elements when the impact mitigating structure is subject to an impact.

In some embodiments the connection(s) between the elements are configured to remain intact (e.g. one or more of not stretch, deform, fracture, snap or rupture) when the impact mitigating structure is subject to an impact. In these embodiments the plurality of elements may be configured to be released (e.g. from the particular arrangement) in a different way, e.g. from being released from the support structure, within the retaining structure or, e.g., from a connection to the first and/or second layer.

The connection(s) between the elements may be taut (and, e.g., not able to be extended) or slack (and, e.g., able to be extended, e.g. tightened, e.g. when the impact mitigating structure is subject to an impact). Having the connection(s) taut or slack may help to control the (e.g. tensile) force at which the connection(s) stretch, deform, fracture, snap or rupture, when the impact mitigating structure is subject to an impact.

In some embodiments the connection(s) between the elements extend through or are connected to one or more of the other components (e.g. layers) of the impact mitigating structure. The connection(s) between the elements may be configured to be at least partially released from the other components (e.g. layers) of the impact mitigating structure, when the impact mitigating structure is subject to an impact, e.g. exceeding a threshold, e.g. in addition to the connection(s) between the elements being configured to do one or more of stretch, deform, fracture, snap and rupture. In some embodiments the connection(s) between the elements may be configured to be at least partially retained through or being connected to one or more of the other components (e.g. layers) of the impact mitigating structure, when the impact mitigating structure is subject to an impact, e.g. exceeding a threshold.

In one embodiment one or more (e.g. all) of the plurality of elements are configured to be at least partially retained by the support structure, when the impact mitigating structure is subject to an impact, e.g. exceeding a threshold. In this embodiment, preferably the one or more (e.g. all) of the plurality of elements are configured to roll relative to (e.g. at least partially within) the support structure. For example, the support structure may comprise a housing for one or more (e.g. all) of the plurality of elements, wherein the plurality of elements are configured to roll relative to (e.g. at least partially within) the housing.

Preferably one or more portions of the one or more (e.g. all) of the plurality of elements is exposed (e.g. protrudes from) the (e.g. housing of the) support structure, wherein the exposed portion(s) of the one or more (e.g. all) of the plurality of elements is configured to contact (and, e.g., roll against) one or both of the first layer and the second layer.

This is considered novel and inventive in its own right and thus when viewed from a further aspect the invention provides a helmet comprising an impact mitigating structure, the impact mitigating structure comprising:

a first inner layer;

a second outer layer; and a plurality of elements held between the first inner layer and second outer layer;

wherein the plurality of elements are held in a housing between the first inner layer and second outer layer such that at least a portion of the plurality of elements is exposed to one or both of the first inner layer and second outer layer;

wherein the exposed portions of the plurality of elements are configured to come into contact with one or both of the first inner layer and second outer layer when the impact mitigating structure is subject to an impact; and wherein the plurality of elements are configured to roll in the housing to facilitate movement of the first inner layer and the second outer layer with respect to each other.

It will be appreciated that the helmet and impact mitigating structure of this aspect of the invention may comprise any (e.g. all) of the optional and preferred features outlined herein with regard to any of the other aspects and embodiments of the invention. Thus, preferably, the plurality of elements form at least part of a reactive layer.

The first layer and the second layer may, for example, be designed to perform different (or similar) functions in the impact mitigating structure. In a set of embodiments, one or both of the first layer and the second layer comprises an impact (energy) absorbing layer. In at least preferred embodiments, such an impact absorbing layer is designed to provide a degree of protection against bulk forces exerted in an impact. Thus preferably, the impact absorbing layer is arranged to absorb at least a portion of the normal component of the forces exerted on the impact mitigating structure during an impact.

The impact absorbing layer(s) (the first and/or second layer) may be formed from any suitable and desired material, such as expanded polystyrene (EPS). In a preferred set of embodiments, the impact absorbing layer(s) (the first and/or second layer) comprises a hollow cell structure, e.g. comprising a plurality of hexagonal cells (in cross section). Preferably, at least a plurality of the cells tessellate with each other. For example, the impact absorbing layer(s) (the first and/or second layer) may comprise a micro-truss lattice or an out-of-plane honeycomb.

Preferably, the impact absorbing layer comprises a hard coating or layer (e.g. shell) on the surface (of the first and/or second layer) between which (e.g. in contact with) the reactive layer is positioned, e.g. having (approximately) the same hardness as the plurality of elements. Preferably the coating or layer has a hardness greater than the hardness of the first and/or second layer (e.g. the impact absorbing layer) on which the coating or layer is provided. For example, the impact absorbing layer may be coated in (or have attached to it) a polycarbonate layer (which may, for example, be harder than the material of the impact absorbing layer). This may help the plurality of elements to roll, and thus the impact absorbing layer to move relatively to the reactive layer, first layer and/or second layer (as applicable).

When the impact mitigating structure comprises a support structure or a retaining structure, preferably the support structure or the retaining structure is arranged to hold the plurality of elements (e.g. in the support structure) adjacent (e.g. against) the first or second layer. Preferably, the support structure or retaining structure is attached to the first or second layer such that the support structure or retaining structure holds the plurality of elements (e.g. in the support structure) adjacent (e.g. against) the first or second layer respectively.

This is considered novel and inventive in its own right and thus when viewed from a further aspect the invention provides a helmet comprising an impact mitigating structure, the impact mitigating structure comprising:

an impact absorbing layer;

a shell layer, wherein the shell layer is harder than the impact absorbing layer;

a plurality of elements arranged adjacent the shell layer; and a support structure or a retaining structure arranged to hold the plurality of elements adjacent the shell layer;

wherein the support structure, the retaining structure and/or the plurality of elements are configured such that, when the impact mitigating structure is subject to an impact, the plurality of elements contact and roll over the shell layer to facilitate movement of the shell layer and the retaining structure with respect to each other.

It will be appreciated that the helmet and impact mitigating structure of this aspect of the invention may comprise any (e.g. all) of the optional and preferred features outlined herein with regard to any of the other aspects and embodiments of the invention. For example, preferably the retaining structure is arranged to retain plurality of elements (e.g. within the retaining structure and/or between the retaining structure and the shell layer) when the elements are released after impact. Preferably the support structure and/or the retaining structure is attached to the shell layer. Preferably the support structure, the retaining structure and/or the plurality of elements together form a reactive layer. Preferably there is no intermediate layer (e.g. low friction layer and/or (e.g. flexible layer) retaining structure) between the shell layer and the plurality of elements, e.g. the plurality of elements are held directly against the shell layer by the support structure or the retaining structure. Preferably the shell layer and/or the plurality of elements comprise a high friction material and/or coating.

The shell layer, the impact absorbing layer, the support structure or the retaining structure, and the plurality of elements may be arranged relative to each other in any suitable and desired way, e.g. in accordance the embodiments outlined herein.

In some embodiments the retaining or support structure and the plurality of elements are between the impact absorbing layer and the shell layer. In some embodiments the shell layer is attached to or comprises part of the impact absorbing layer, e.g. as an (inner or outer) layer or coating of the impact absorbing layer, and the support or retaining structure and the plurality of elements are on the inside or the outside of the shell layer.

In some embodiments, the support structure or retaining structure is the innermost or outermost part of the impact mitigating structure. In some embodiments, the impact mitigating structure comprises an additional (e.g. inner or outer) layer, wherein the retaining or support structure and the plurality of elements are between the additional layer and the shell layer. Thus, in these embodiments, the additional layer may be the innermost or outermost part of the impact mitigating structure. The additional layer preferably comprises a thin and/or hard (e.g. shell) layer. Preferably this additional layer comprises the second layer as outlined herein. In such embodiments, the optional and preferable features outlined herein in relation to the second layer may apply equally to the additional layer.

In a set of embodiments, the second layer comprises a flexible (e.g. metal, polymer and/or textile) layer. Thus, in some embodiments, the second layer may act as the retaining or support structure for the plurality of elements of the reactive layer. In such embodiments, the optional and preferable features outlined herein in relation to the retaining or support structure may apply equally to the second layer.

In a set of embodiments, the second layer comprises a (e.g. resilient, hard) outer shell. When the second layer comprises an impact absorbing layer, the impact mitigating structure may comprise an (additional) outer shell, wherein the second layer is arranged (e.g. sandwiched) between the reactive layer and the outer shell. When the impact mitigating structure comprises an additional outer shell, it is the outer shell that may be subject to an impact (such that the second layer experiences (is subject to) the impact via the outer shell).

Preferably the outer shell has a thickness that is (e.g. significantly) less than a thickness of the first layer. When the impact mitigating structure comprises a second layer and an outer shell, preferably the outer shell has a thickness that is (e.g. significantly) less than a thickness of the second layer. The outer shell may thus comprise a membrane, e.g. at least partly covering the reactive layer and/or the second layer (as appropriate). Preferably the membrane comprises a double layer, e.g. covering (encasing) both sides of the (e.g. plurality of elements of the) reactive layer.

Preferably the outer shell is formed from a rigid material, such as a thermoplastic, e.g. polycarbonate, or carbon fibre, or a composite material; however, it could be made from any suitable and desired material. Preferable materials for forming the outer shell have high strength to weight ratios.

Preferably, the surfaces of the first layer and the second layer, between which the reactive layer is positioned, and, e.g., the outer shell when provided, comprise low friction surfaces, e.g. having a (relatively) large surface area. For example, one or more (e.g. all) of the first layer, the second layer and, e.g., the outer shell comprise a low friction coating and/or formed from a low friction (e.g. self-lubricating) material, at least on their adjacent surfaces. Preferably the surfaces also have a large relative overlap. Low friction surfaces and large relative overlap may help the first layer, the second layer and the reactive layer (and, e.g., the outer shell) to move relative to each other, when subject to an impact.

In one embodiment the impact mitigating structure comprises a low friction interface (e.g. layer) between one or more (e.g. all) of the first layer, the second layer and the plurality of elements. The low friction interface may be provided by one or more (e.g. all) of a (low friction) material of the first layer, the second layer and/or the plurality of elements, a (low friction) coating of the first layer, the second layer and/or the plurality of elements, and/or an additional (low friction) layer between one or more (e.g. all) of the first layer, the second layer and the plurality of elements.

The low friction interface may be arranged between (substantially) all of the first layer and the second layer, e.g. at all regions where there is the reactive layer and a plurality of elements. In some embodiments the low friction interface and/or the plurality of elements are provided in one or more discrete regions between the first and second layers (and, e.g., not provided in other region(s) between the first and second layers). The region(s) over which the low friction interface and/or the plurality of elements are provided may at least partially correspond to each other (e.g. at least partially overlap) or the region(s) over which the low friction interface and/or the plurality of elements are provided may be distinct from each other (e.g. not overlap).

This is considered novel and inventive in its own right and thus when viewed from a further aspect the invention provides a helmet comprising an impact mitigating structure, the impact mitigating structure comprising:

- a first inner layer;
- a second outer layer;
- a plurality of elements held between the first inner layer and second outer layer; and
- a low friction interface arranged between one or more of the first inner layer, the second outer layer and the plurality of elements; and
- wherein the plurality of elements and the low friction interface are configured such that, when the impact mitigating structure is subject to an impact, the plurality of elements of the reactive layer are configured to roll and/or the low friction interface is configured to act between one or more of the first inner layer, the second outer layer and the plurality of elements to facilitate movement of the first inner layer and the second outer layer with respect to each other.

It will be appreciated that the helmet and impact mitigating structure of this aspect of the invention may comprise any (e.g. all) of the optional and preferred features outlined herein with regard to any of the other aspects and embodiments of the invention. Thus, preferably, the plurality of elements and the low friction interface form at least part of a reactive layer.

Preferably, the surfaces of the first layer and the second layer, between which the reactive layer is positioned, comprise hard surfaces, e.g. having (approximately) the same hardness as the plurality of elements. For example, one or more (e.g. all) of these surface(s) of the first layer, the second layer (and, e.g., the outer shell) comprise a hard (e.g. polycarbonate) coating (or additional layer attached thereto) and/or are formed from a hard material (e.g. polycarbonate), at least on their adjacent surfaces. The hard shell(s) (e.g. layer(s)) may be provided between the first layer and/or the second layer, and the reactive layer, e.g. as opposed to the first and/or second layers comprising a coating or being formed from a hard material. Hard surfaces (e.g. having (approximately) the same hardness as the plurality of elements) may help the first layer, the second layer and the reactive layer to move relative to each other, when subject to an impact.

In a set of embodiments, the second layer (e.g., or, outer shell) is designed to absorb (e.g. carry away) at least a portion of any rotational forces exerted in an impact. In a preferred embodiment, when the second layer (e.g., or, outer shell) is subject to an impact (e.g. having a force that is greater than or equal to the particular force), the disruption (e.g. movement) of the plurality of elements allows the second layer to translate (e.g. slide) over the first layer (e.g. with the plurality of elements moving therebetween). Preferably the plurality of elements are arranged to rotate, which may help the second layer to translate (e.g. slide) over the first layer with reduced resistance.

The second layer (e.g., or, outer shell) may be arranged to resist fracturing during an impact (e.g. exceeding the threshold force). However, in some embodiments, the second layer (e.g., and/or, outer shell) is arranged to fracture during an impact (e.g. having a force that is greater than or equal to the particular force), for example if the second layer (e.g., and/or, outer shell) is (e.g. relatively) thin and/or rigid.

The first layer and the second layer (e.g., and/or, outer shell) may be arranged to (e.g. completely) separate when the impact mitigating structure is subject to an impact (e.g. having a force that is greater than or equal to the particular force), e.g. to allow continued movement of the layers relative to each other. Preferably the (e.g. second) outer layer is arranged to detach from the remainder of the impact mitigating structure (so that the can no longer transfer any energy to the remainder of the impact mitigating structure) when the impact mitigating structure is subject to an impact (e.g. having a force that is greater than or equal to the particular force).

Thus preferably the outer layer is attached to remainder of the impact mitigating structure, such that the outer layer is configured to detach from the remainder of the impact mitigating structure when the impact mitigating structure is subject to an impact (e.g. having a force that is greater than or equal to the particular force). Preferably the reactive layer and/or the outer layer are configured such that the outer layer moves substantially freely away from the remainder of impact mitigating structure after the outer layer has detached from the impact mitigating structure. This helps to deflect the impact from the remainder of the impact mitigating structure (e.g. that is attached to the head of a wearer) and reduce the chance of geometric locking of the outer layer on the remainder of the impact mitigating structure, so that the energy of the impact that is transferred to the remainder of the impact mitigating structure is reduced.

When the impact mitigating structure comprises a retaining structure, e.g. attached to the outer layer, preferably the outer layer is configured to detach from the (e.g. (second) retaining layer of the) retaining structure when the impact mitigating structure is subject to an impact (e.g. having a force that is greater than or equal to the particular force). This helps to allow the outer layer to separate from the remainder of the impact mitigating structure, while the retaining structure may remain intact and thus retain the plurality of elements, in an impact.

Thus, in some embodiments the retaining structure is arranged to remain attached to (part of) the remainder of the impact mitigating structure (e.g. to the (first) inner layer), when the impact mitigating structure is subject to an impact (e.g. having a force that is greater than or equal to the particular force), e.g. when the outer layer detaches from the remainder of the impact mitigating structure.

In some embodiments, e.g. when the retaining structure comprises one or more flexible layers, the outer layer is arranged to (e.g. stretch and/or deform and) remain attached to the remainder of the impact mitigating structure (e.g. including to the (e.g. (second) retaining layer of the) retaining structure) when the outer layer is displaced relative to the remainder of the impact mitigating structure by less than a particular (threshold) distance, e.g. during a first phase of an impact. Preferably the outer layer is configured to detach from the (e.g. (second) retaining layer of the) retaining structure when the outer layer is displaced relative to the remainder of the impact mitigating structure by at least a particular (threshold) distance, e.g. during a second phase of an impact.

The particular (threshold) distance may be any suitable and desired distance, e.g. between 5 mm and 100 mm, e.g. between 10 mm and 80 mm, e.g. between 20 mm and 70 mm, e.g. between 40 mm and 60 mm, e.g. approximately 50 mm.

Thus, in some embodiments (e.g. when the impact mitigating structure is subject to an impact having a force that is greater than or equal to the particular force), the outer layer is arranged to attached to the remainder of the impact mitigating structure (and the retaining structure is arranged to deform and/or stretch to accommodate this displacement) at displacements less than the particular (threshold) distance and then detach from the remainder of the impact mitigating structure at the particular (threshold) distance. This helps to provide contact between the various different components of the impact mitigating structure, such that the reactive layer is able to facilitate movement of the first and second layers relative to each other in the first phase of the impact, and to then allow the outer surface to continue to move away from the remainder of impact mitigating structure and the retaining structure to retain the plurality of elements in the second phase of the impact.

Preferably the manner in which the outer layer is attached to the remainder of the impact mitigating structure (e.g. according to any one of the embodiments as outlined herein) is configured to facilitate this two phase behaviour.

The timescale over which the impact acts on the impact mitigating structure, e.g. before the outer layer detaches from the remainder of the impact mitigating structure, may be any suitable and desired timescale. In one set of embodiments the impact mitigating structure is configured such that the outer layer detaches from the remainder of the impact mitigating structure, when the impact mitigating structure is subject to an impact (e.g. having a force that is greater than or equal to the particular force), after less than 50 ms, e.g. after less than 20 ms, e.g. after less than 10 ms, e.g. after less than 5 ms.

The impact mitigating structure may be any suitable and desirable desired impact mitigating (e.g. absorbing) structure arranged to mitigate forces in (e.g. absorb energy from) an impact. While the above aspects and embodiments have been described primarily with respect to helmets, the Applicant has appreciated that the impact mitigating structure of the helmet may be applicable for other types of impact mitigating structures.

Thus when viewed from a further aspect the invention provides an impact mitigating structure comprising:

- a first inner layer;
- a second outer layer; and
- a reactive layer positioned between the first inner layer and the second outer layer, the reactive layer comprising a plurality of elements held between the first inner layer and second outer layer;
- wherein the reactive layer is arranged such that, when the second layer is subject to an impact, the plurality of elements of the reactive layer are configured to roll to facilitate movement of the first inner layer and the second outer layer with respect to each other.

When viewed from a further aspect the invention provides an impact mitigating structure comprising:

- an inner impact absorbing layer; and
- an outer reactive layer positioned over at least a portion of the impact absorbing layer;
- wherein the reactive layer comprises a support structure and/or a retaining structure and a plurality of elements held in the support structure and/or the retaining structure; and
- wherein the support structure and/or the retaining structure is configured such that, when the reactive layer is subject to an impact, the plurality of elements of the reactive layer are configured to roll to facilitate movement of the reactive layer and the impact absorbing layer with respect to each other.

It will be appreciated that the impact mitigating structure of these aspects of the invention may comprise any (e.g. all) of the optional and preferred features outlined herein with regard to any of the other aspects and embodiments of the invention. Similarly, the invention provides impact mitigating structures corresponding to all the other aspects directed to helmets.

The impact mitigating structure may be (e.g. form part of) vehicle armour. However, in at least preferred embodiments, the impact mitigating structure is wearable. A wearable impact mitigating structure is preferably arranged to protect the wearer from injury when subject to an impact. For example, the impact mitigating structure may be configured to be fitted to (e.g. worn by) a person or object (e.g. a vehicle) to provide protection against an impact to which the impact mitigating structure is subject. The impact mitigating structure may therefore form part of a piece of clothing or body armour. In such embodiments, preferably the first layer is arranged to be closest (e.g. fitted) to the person or object (e.g. vehicle) and the disruption of the plurality of elements facilitates the movement of the second layer (or the reactive layer) with respect to the first layer.

In embodiments wherein the impact mitigating structure is a helmet, the first layer is preferably an inner layer of the helmet and the second layer is preferably an outer layer of the helmet. When the impact mitigating structure comprises an outer shell, preferably the outer shell comprises an outer layer of the helmet. The layers are preferably curved, e.g. approximately hemispherical, to improve the fit of the layers to a head and to help increase the protection from injury provided by the helmet. These features apply equally to other pieces of body armour, for example, that fit to other parts of a body.

It will be appreciated that in embodiments in which the impact mitigating structure comprises a helmet, the invention may reduce the rotation of the head of the user and the transfer of rotational forces when the helmet is subject to an impact, as the second (and/or reactive) layer may translate (e.g. slide or rotate) with respect to the first layer and the head of the user. Reducing tangential forces experienced by a user's head further reduces the risk of neck injuries and brain injuries as a result of impacts to the head.

Certain embodiments of the invention will now be described, by way of example only, with reference to the accompanying drawings in which.

Impact mitigating structures act to protect a user or an object by absorbing and/or deflecting energy from an impact. In oblique impacts, which are a common form of impact, the impact mitigating structure may be subjected to significant linear and tangential forces. These forces can cause a rapid deceleration of the user and/or object, which may cause serious damage. Embodiments of the present invention aim to provide an improved impact mitigating structure which reduces the risk of serious damage during an impact.

FIGS. 1 to 37 show impact mitigating structures according to various embodiments of the present invention.

Figure 1:
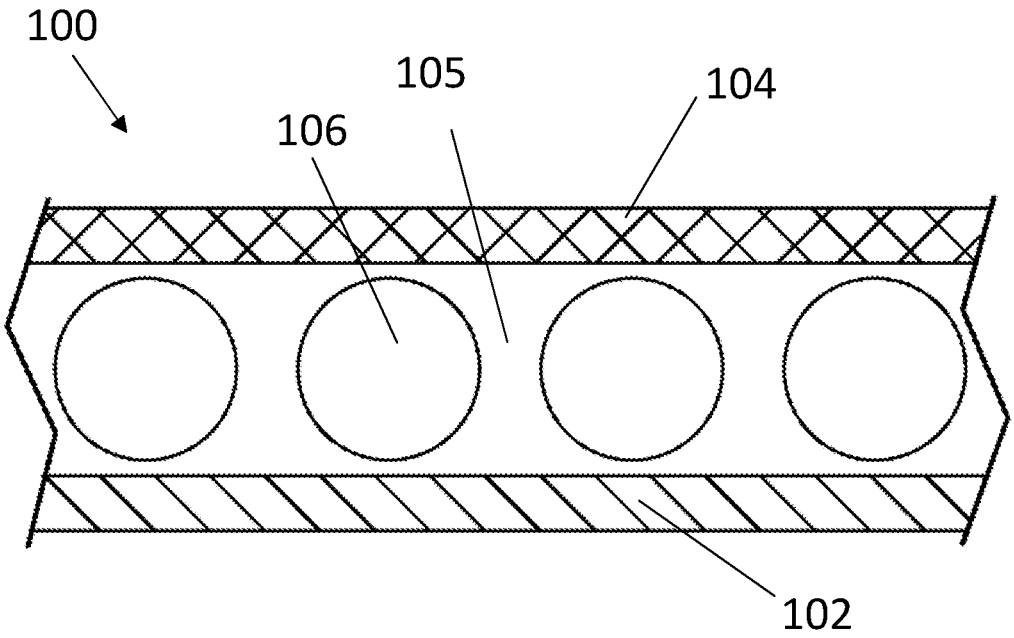
FIG. 1 shows a schematic cross-sectional view of an impact mitigating structure in accordance with an embodiment of the present invention.

FIG. 1 shows a schematic cross-section through a portion of an impact mitigating structure 100. The impact mitigating structure 100 has the following components: a first layer 102, a second layer 104 and a reactive layer 105. The reactive layer 105 is formed from multiple discrete elements 106, and is positioned between the first layer 102 and the second layer 104. The multiple discrete elements 106 are held in a particular arrangement (e.g. regular array) in the reactive layer 105 between the first layer 102 the second layer 104.

The first layer 102 may be an energy absorbing layer and the second layer 104 may be a rigid outer shell, e.g. of a helmet. In one particular example, the first layer 102 is an expanded polystyrene liner with a polycarbonate shell coating and the second layer 104 is a polycarbonate shell. However, it will be appreciated that there are number of different materials suitable for the first layer 102 and a second layer 104, e.g. depending on the application for the impact mitigating structure 100.

In FIG. 1 the discrete elements are spheres (e.g. balls) 106. Although FIG. 1 only shows four spheres 106, it will be appreciated that the impact mitigating structure 100 extends beyond the portion shown in FIG. 1, such that the reactive layer 105 may comprise any suitable number of spheres 106. While the spheres 106 shown in FIG. 1 are spherical, the reactive layer 105 could also be formed from other types of spheroids or rounded discrete elements.

The first layer 102 and the second layer 104 are formed so as to contain the spheres 106 between the first layer 102 and the second layer 104. The first layer 102 and the second layer 104 form a support structure, housing or container for the spheres 106. This holds the spheres 106 in a particular, 'quasi-fixed' arrangement. In this arrangement the spheres 106 have a degree of freedom of movement, while the reactive layer 105 as a whole is fixed between the first layer 102 and the second layer 104. For example, each sphere 106 may move a certain distance with respect to its neighbouring spheres within the arrangement. However, owing to the diameter of the spheres 106 compared with the separation of (e.g. distance between) the first layer 102 and the second layer 104, the spheres 106 cannot swap (e.g. change) their respective positions.

In use, when the (e.g. second (e.g. outer) layer of the) impact mitigating structure 100 is subject to an impact having a force exceeding a particular, threshold force, the first layer 102, the second layer 104 and the reactive layer 105 experience the force, such that they are no longer able to provide the support structure, housing or container for the spheres 106. This may occur as a result of the second layer 104 being displaced, fractured or ejected by the force of the impact. The spheres 106 are disrupted from their particular arrangement in the reactive layer 105 such that they are no longer held in their arrangement between the first layer 102 and the second layer 104. The behaviours of the spheres 106, the first layer 102, the second layer 104 and the reactive layer 105 following an impact will be described in more detail in relation to FIG. 11.

Figure 2:
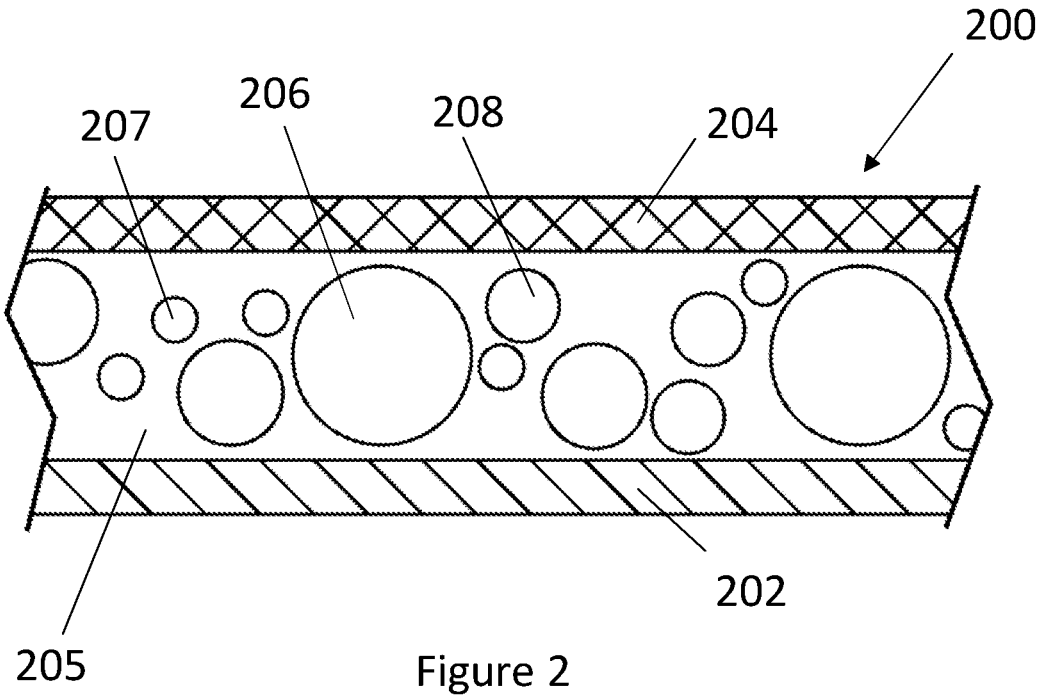
FIG. 2 shows a schematic cross-sectional view of an impact mitigating structure in accordance with another embodiment of the present invention.

FIG. 2 shows a schematic cross-section through a portion of an impact mitigating structure 200 according to another embodiment of the present invention. Similarly to the impact mitigating structure 100 shown in FIG. 1, the impact mitigating structure 200 shown in FIG. 2 comprises a first layer 202, a second layer 204 and a reactive layer 205. Moreover, the arrangement of these layers with respect to each other is the same as shown in FIG. 1.

In contrast to the embodiments shown in FIG. 1, the discrete elements of the reactive layer 205 of the impact mitigating structure 200 are spheres 206, 207, 208 of different diameters. In particular, the reactive layer 205 is formed from plurality of spheres 206, 207, 208 of three different diameters.

The first layer 202 and the second layer 204 form a support structure, housing or container for the spheres 206, 207, 208 in the same manner as described in relation to FIG. 1. However, owing to their differences in size, the spheres 206, 207, 208 shown in FIG. 2 may have a greater freedom of movement than the spheres 106 shown in FIG. 1, particularly when subject to an impact. However, the spheres are still maintained in a quasi-fixed arrangement between the first layer 202 and the second layer 204.

Figure 3:
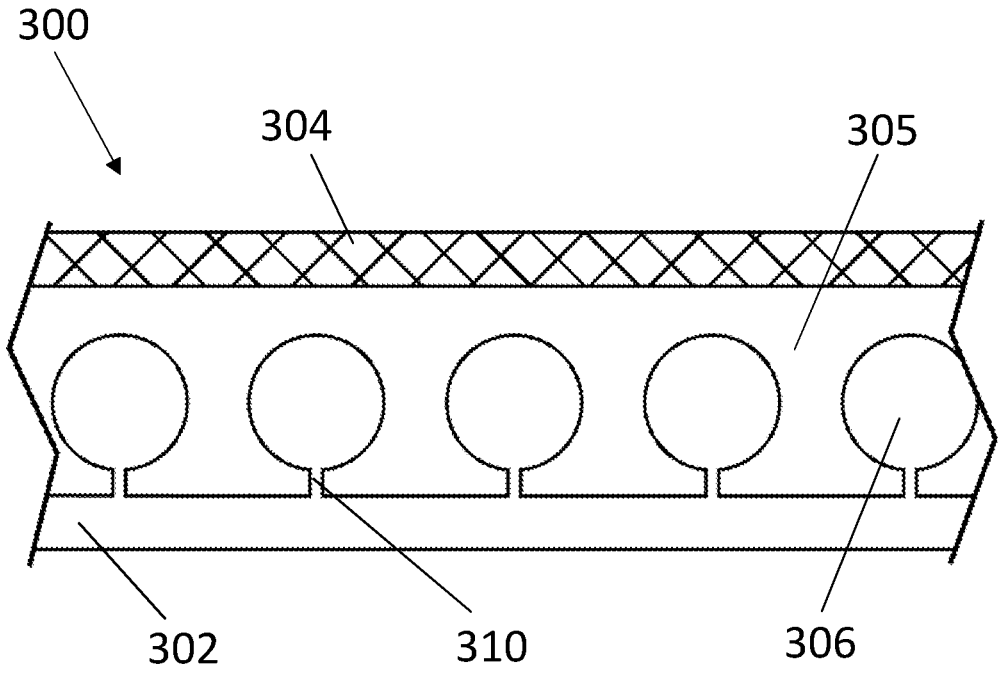
FIG. 3 shows a schematic cross-sectional view of an impact mitigating structure in accordance with another embodiment of the present invention.

FIG. 3 shows a schematic cross-section through a portion of an impact mitigating structure 300 according to another embodiment of the present invention. Similarly to the impact mitigating structure 100 shown in FIG. 1, the impact mitigating structure 300 of FIG. 3 includes a first layer 302, a second layer 304 and a plurality of spheres 306 forming a reactive layer 305.

However, in FIG. 3 each sphere 306 is connected to the first layer 302 by a connector 310. Each connector 310 hold the corresponding sphere 306 in a fixed position, allowing the plurality of spheres to be held in a fixed arrangement. The connectors 310 and the spheres 306 are made from the same material as the first layer 302 and are formed integrally on the first layer 320. When the impact mitigating structure is subject to an impact exceeding a particular, threshold force, the connectors 310 are arranged to fracture to allow the spheres 306 to be freed and to move from their previously fixed position.

Figure 4:
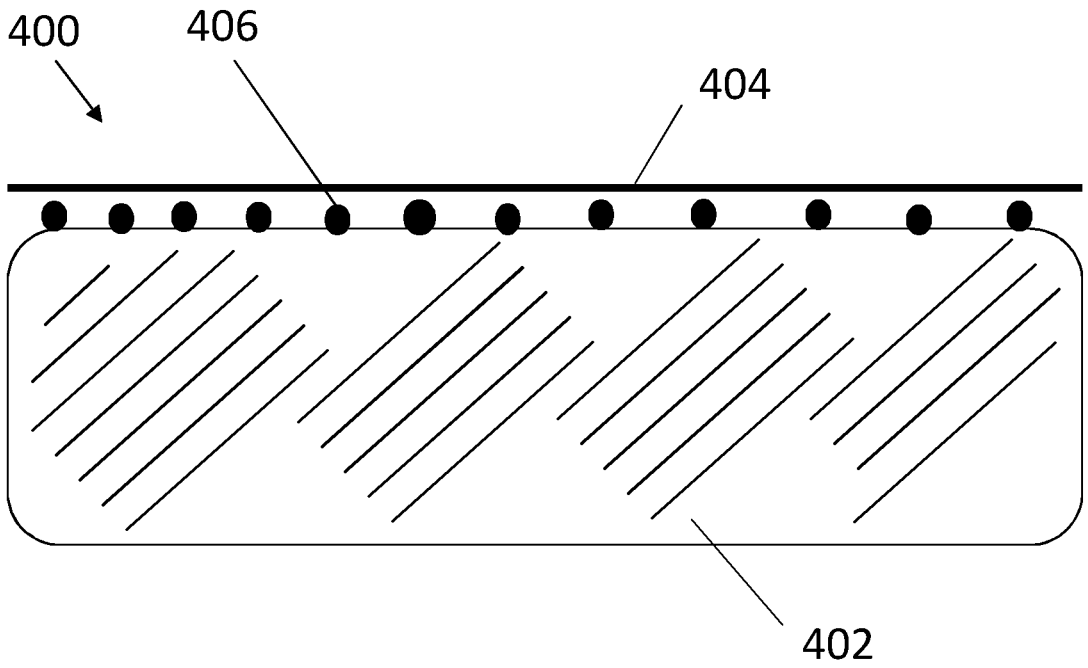
FIG. 4 shows a schematic cross-sectional view of an impact mitigating structure in accordance with another embodiment of the present invention.
Figure 5:
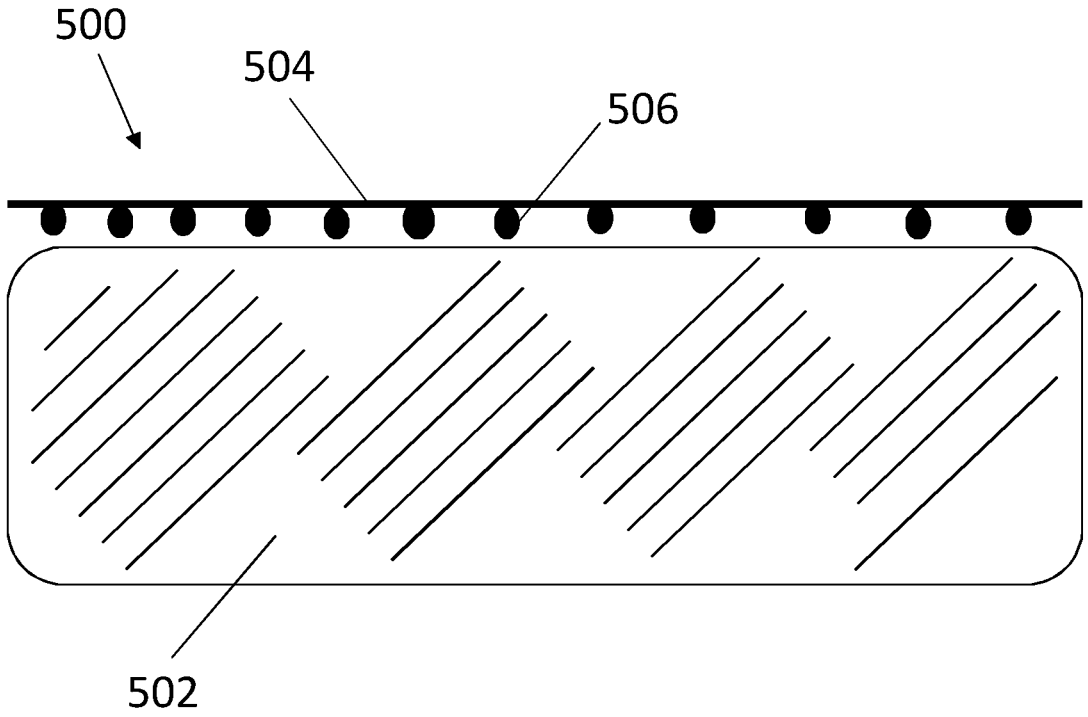
FIG. 5 shows a schematic cross-sectional view of an impact mitigating structure in accordance with another embodiment of the present invention.

FIGS. 4 and 5 show schematic cross-sections through portions of impact mitigating structures 400, 500 according to other embodiments of the present invention.

Similarly to the impact mitigating structure 100 shown in FIG. 1, in the embodiment shown in FIG. 4, the impact mitigating structure 400 includes a first (e.g. impact absorbing) layer 402, a second (e.g. outer shell) layer 404 and a plurality of spheres 406 forming a reactive layer. However, an additional mechanism is provided for holding the spheres 406 in a particular arrangement.

The first layer 402 comprises a number of 'dimples', e.g. indentations or recesses, in the surface of the first layer 402. The dimples are sized such that each dimple holds a single sphere 406 in a fixed position. The dimples may be arranged at regular (e.g. uniform) distances from each across the first layer 402 in order to provide a uniform arrangement (e.g. array) of the spheres 406 across the reactive layer. They may also be arranged according to a geometrical distribution.

When the impact mitigating structure is subject to an impact exceeding a particular, threshold force, sufficient energy is imparted to the spheres to displace them from the dimples in the first layer 402 to free them from their fixed arrangement in the reactive layer.

Additionally or alternatively, in some embodiments, the spheres 406 may be chemically and/or physically bonded to the first layer 402. This may help to provide an increased threshold force required to disrupt and displace the spheres from their fixed positions.

FIG. 5 shows another impacting mitigating structure 500 with includes a first layer 502, a second layer 504 and a plurality of spheres 506 (forming a reactive layer), in a similar manner to the embodiment shown in FIG. 4. The spheres 506 are impregnated in or bonded to the second layer 504 to hold the spheres 506 in a particular arrangement.

When the impact mitigating is subject to an impact exceeding a particular, threshold force, sufficient energy is imparted to overcome the chemical and/or physical bond of the spheres 506 to the second layer 504 to free them from their fixed arrangement in the reactive layer. The spheres 506 can then move from their previously fixed arrangement.

Figure 6A:
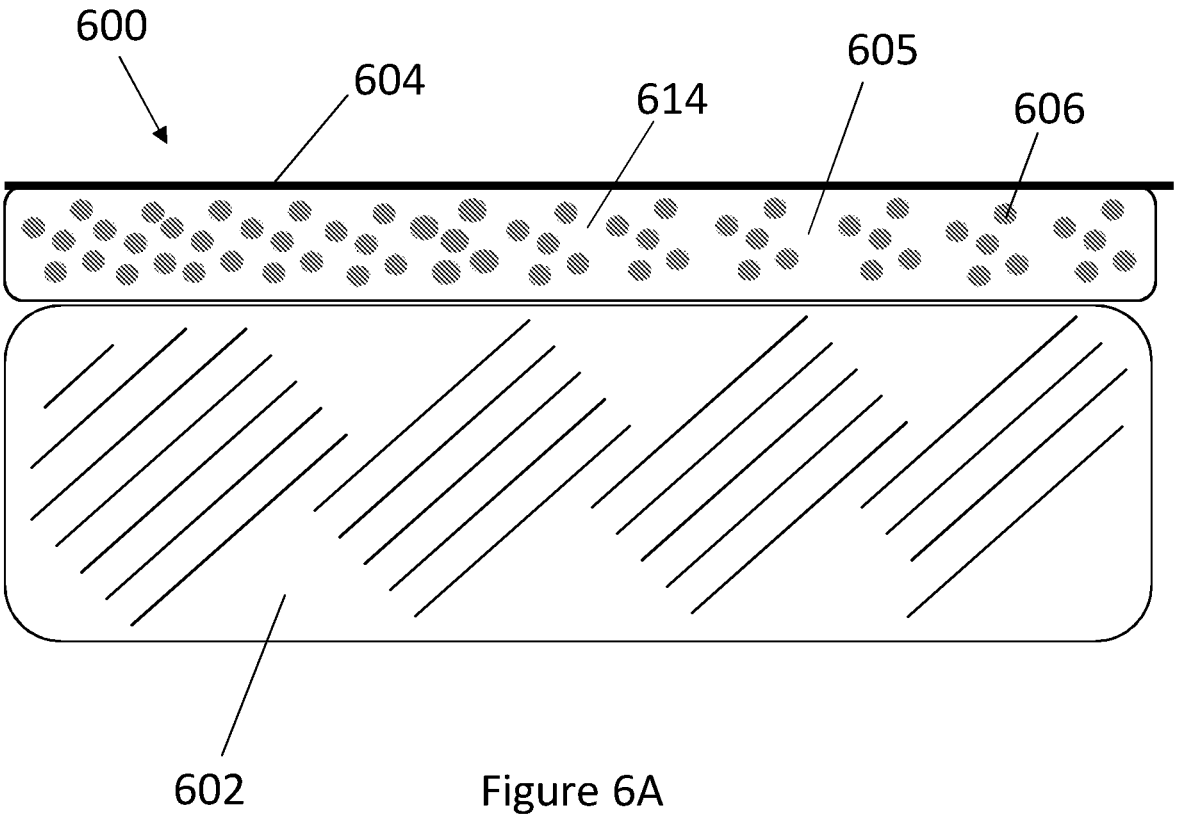
FIG. 6A shows a schematic cross-sectional view of an impact mitigating structure in accordance with another embodiment of the present invention.

FIG. 6A shows a schematic cross-section through a portion of an impact mitigating structure 600 according to another embodiment of the present invention. Similarly to the impact mitigating structure shown in the previous Figures, the impact mitigating structure 600 comprises a first (e.g. impact absorbing) layer 602, a second (e.g. outer shell) layer 604 and a reactive layer 605.

The reactive layer 605 shown in FIG. 6A is formed from a plurality of spheres 606 and a gel structure 614 into which the spheres 606 are embedded. The spheres 606 are smaller than those seen in the previously Figures, such that there are multiple spheres 606 positioned through the gel structure 104. It will be appreciated that various different sizes of spheres 606 are within the scope of this embodiment.

The spheres 606 are suspended in the gel structure 614. By suspending the spheres 606 in the gel structure 614, the spheres 606 are held in a fixed arrangement between the first layer 602 and the second layer 604. However the spheres 606 may maintain a degree of freedom of movement within the gel structure 614, e.g. owing to the flexibility of the gel.

When the impact mitigating is subject to an impact exceeding a particular, threshold force, the gel structure 614 will rupture or disintegrate, which allows the spheres 606 to free them from their fixed arrangement in the reactive layer. The spheres 606 can then move from their previously fixed arrangement.

In some embodiments, instead of a gel structure 614, the reactive layer 605 could comprise an adhesive or a flexible liner (e.g. a plastic wrapping) which holds the spheres 606 in a fixed arrangement between the first layer 602 and the second layer 604.

Figure 6B:
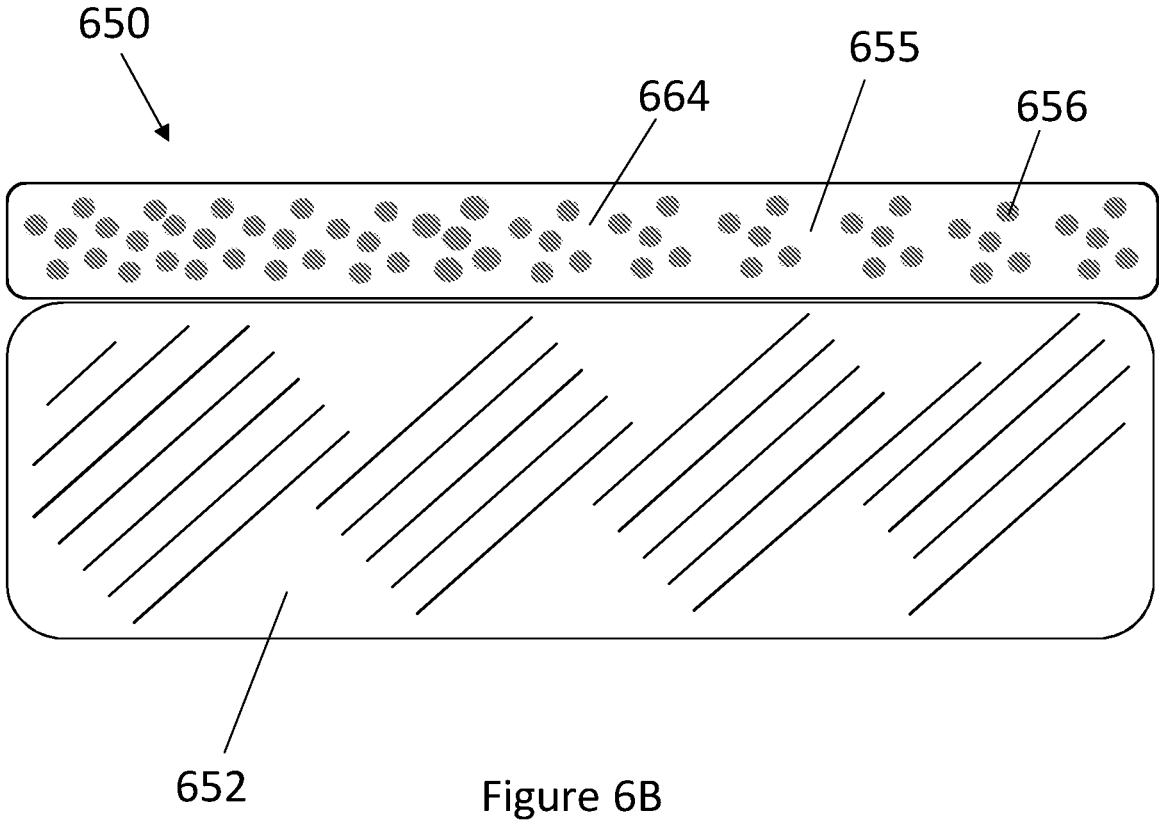
FIG. 6B shows a schematic cross-sectional view of an impact mitigating structure in accordance with another embodiment of the present invention.

FIG. 6B shows an impact mitigating structure 650 similar to that seen in FIG. 6A. The impact mitigating structure 650 comprises a first layer 652 and a reactive layer 605 formed from a plurality of spheres 656 and a gel structure 664. However, the impact mitigating structure 650 does not comprise an outer layer.

When the impact mitigating is subject to an impact on the reactive layer 605, the gel structure 614 will rupture or disintegrate such that the spheres 656 are freed and ejected from the impact mitigating structure 650. The spheres 656 can then move away from the impact mitigating structure 650, taking with them a portion of the energy applied to the structure 650 during the impact.

It will also be appreciated that some of the structures and features for holding the discrete elements in a particular arrangement in the embodiments previously described herein (for example, the connectors in FIG. 5) may also be suitable for embodiments in which the impact mitigating structure comprises a first layer and a reactive layer, but no second layer. Embodiments having any suitable and combination of such features may also be provided.

Figure 7:
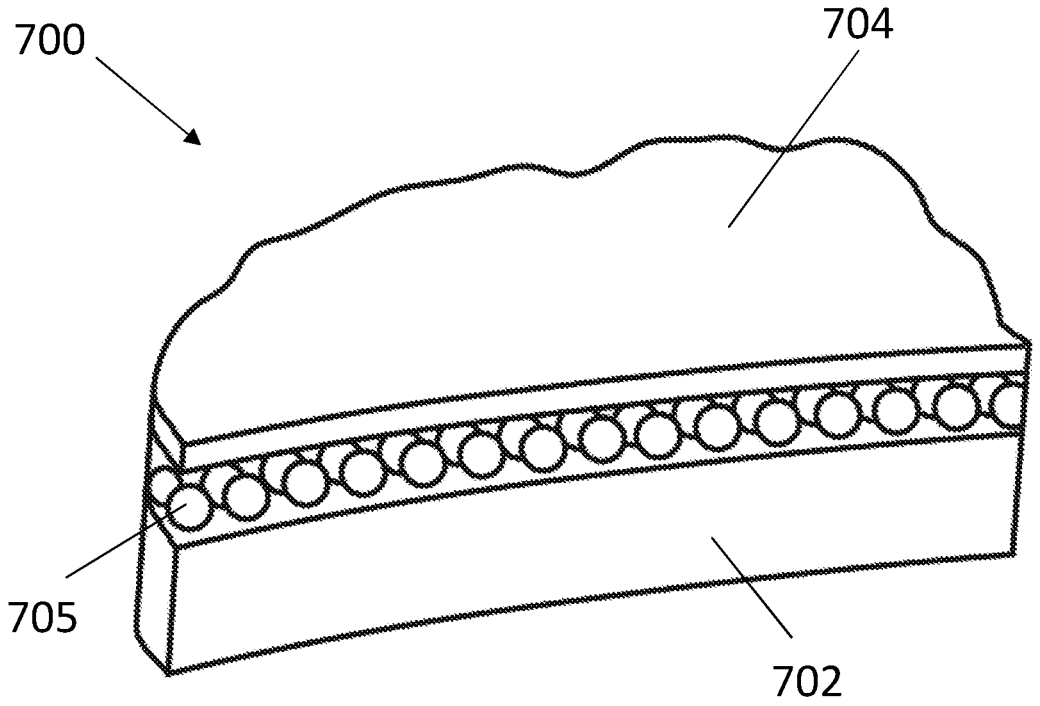
FIG. 7 shows a schematic view of an impact mitigating structure in accordance with an embodiment of the present invention.

FIG. 7 shows a schematic view of a section of an impact mitigating structure 700 according to an embodiment of the present invention. The impact mitigating structure 700 is formed from a reactive layer 705 which is positioned in between an expanded polystyrene layer with a polycarbonate coating 702 and a polycarbonate outer shell 704. The reactive layer 705 may be provided in any suitable and desired arrangement, for example, as shown in any one (or combination) of FIGS. 1 to 6B.

FIGS. 1 to 7 show embodiments of impact mitigating structures principally comprising a first layer, a second layer and a reactive layer. In the embodiments shown in FIGS. 8 to 10, the impact mitigating structure comprises additional layers. Again, in these Figures, the reactive layers may be provided in any suitable and desired arrangement, for example, as shown in any one (or combination) of FIGS. 1 to 6B.

Figure 8:
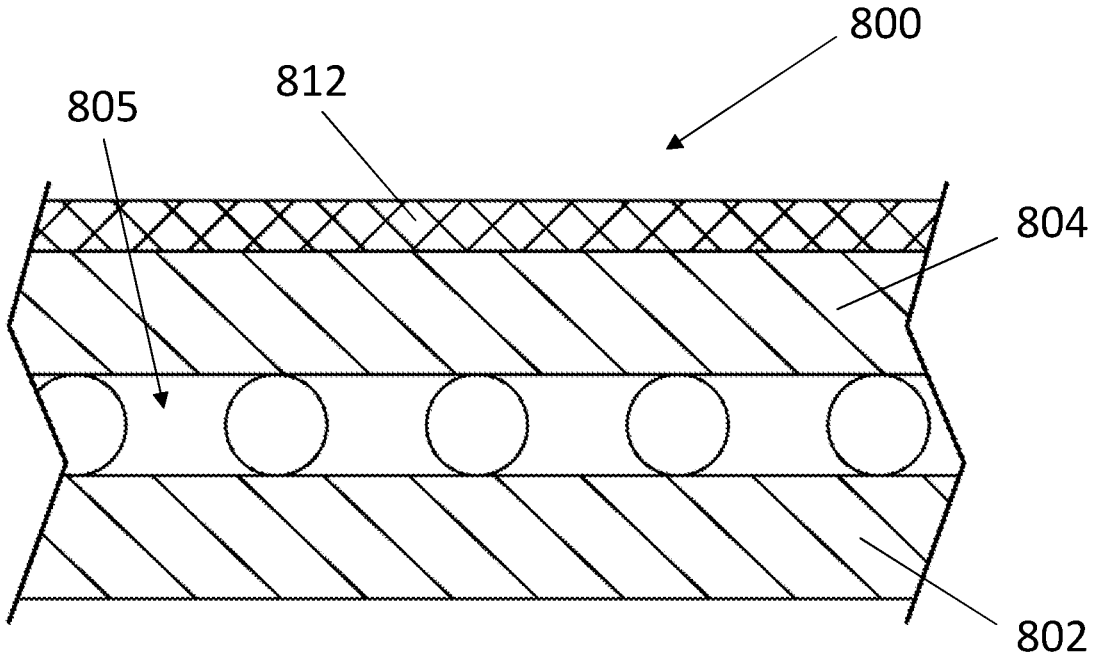
FIG. 8 shows a schematic cross-sectional view of an impact mitigating structure in accordance with another embodiment of the present invention.

In FIG. 8, the impact mitigating structure 800 comprises a first layer 802 and a second layer 804. The first layer 802 and the second layer 804 are both energy absorbing layers, e.g. are arranged to absorb energy imparted in an impact. The reactive layer 805 is positioned between the impact absorbing layers 802, 804. The first layer 802 and/or the second layer 804 may have a hard (e.g. polycarbonate) coating on their surface which is in contact with the reactive layer 805. The impact mitigating structure 800 additionally includes a hard outer layer 812, e.g. bonded to the second layer 804.

When the impact mitigating structure 800 is subject to an impact, the hard outer layer 812 may stay in position on the second layer 804, while the first layer 802 and the second layer 804 move with respect to each other. In other embodiments, the hard outer layer 812 may be ejected from the second layer 804 in an impact.

Figure 9:
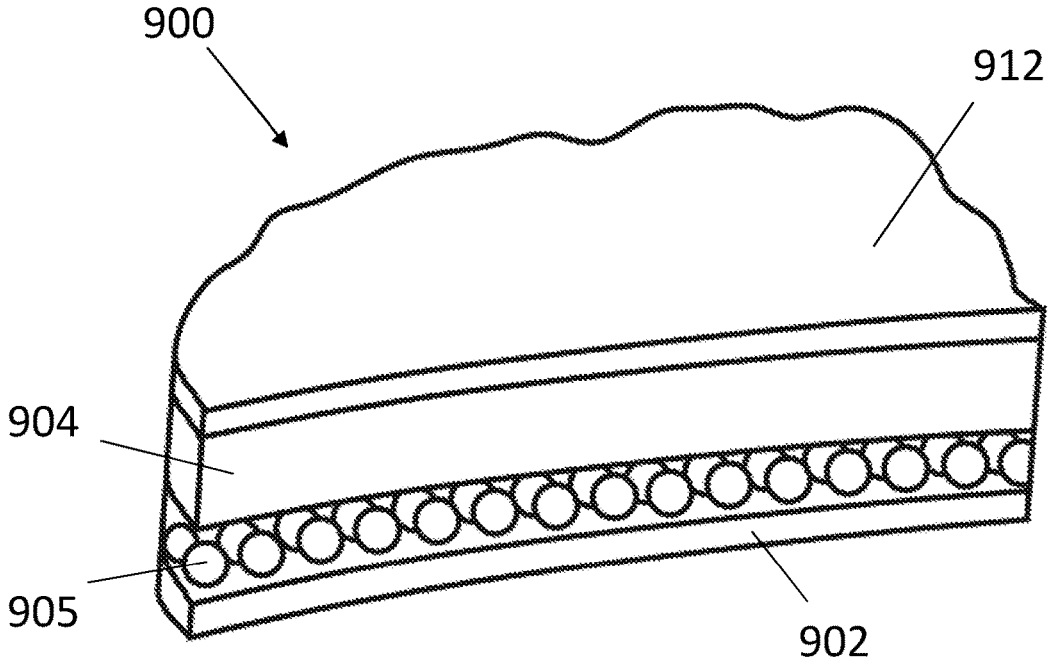
FIG. 9 shows a schematic view of an impact mitigating structure in accordance with another embodiment of the present invention.

In FIG. 9, the impact mitigating structure 900 includes a first layer 902 which is a cellular (e.g. honeycomb) structure comprising a plurality of tessellating cells. The impact mitigating structure 900 also includes a second layer 904, e.g. formed from an expanded polystyrene that acts as an impact absorbing layer. The reactive layer 905 is position in between these two layers. Both the cellular structure first layer 902 and the expanded polystyrene layer 904 may include a hard (e.g. polycarbonate) coating on their surface which is in contact with the reactive layer 905. A polycarbonate shell 912 is positioned on the outside of the second layer 904.

Figure 10:
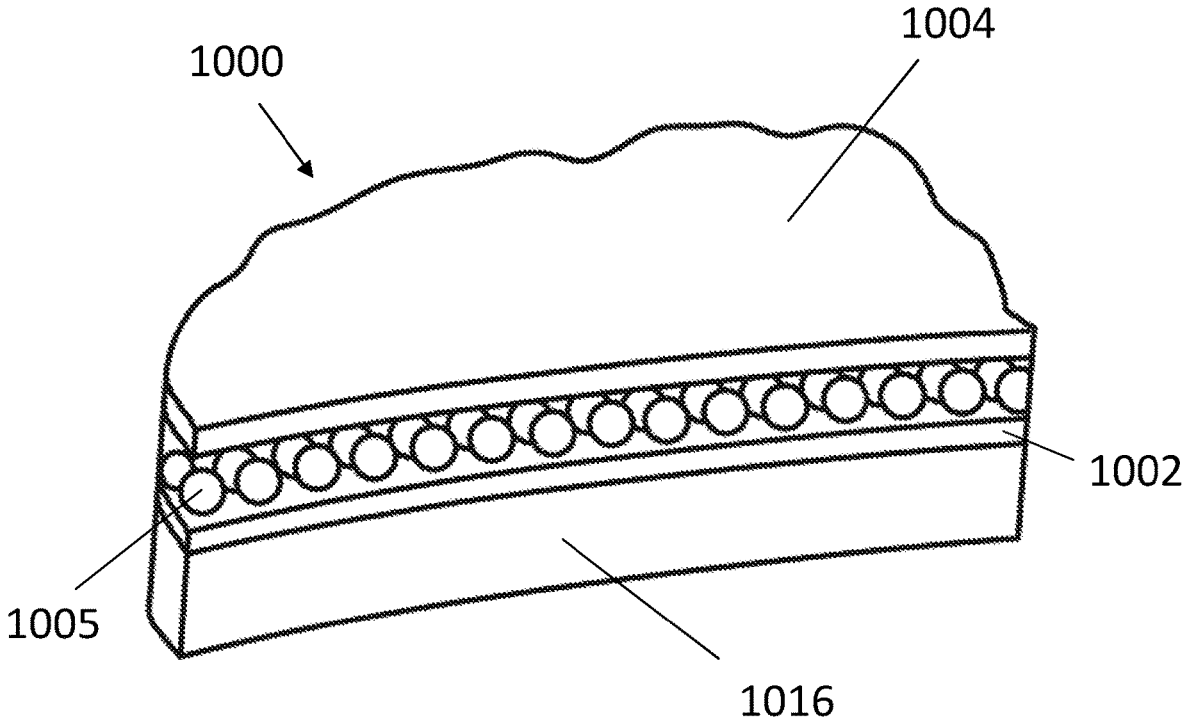
FIG. 10 shows a schematic view of an impact mitigating structure in accordance with another embodiment of the present invention.

In FIG. 10, the impact mitigating structure 1000 comprises a first polycarbonate layer 1002 and a second polycarbonate layer 1004. The reactive layer 1005 is located between these polycarbonate layers 1002, 1004. The impact mitigating structure 1000 additionally includes an impact absorbing layer 1016 (e.g. an expanded polystyrene layer or a cellular structure having a plurality of tessellating cells), which is located below the polycarbonate layers 1002, 1004 and the reactive layer 1005.

The cellular structures 902, 1016 (when provided) may be arranged to provide protection against forces exerted in an impact (e.g. act as impact absorbing structures).

Figure 11:
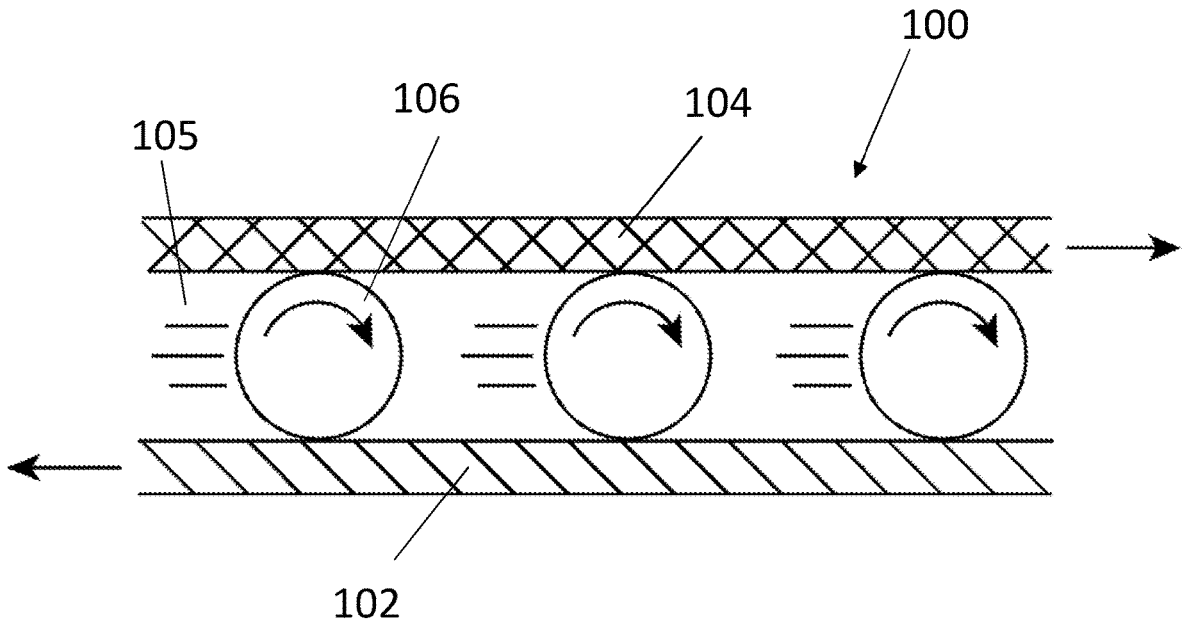
FIG. 11 is a diagram demonstrating the movement of various components of an impact mitigating structure in accordance with an embodiment of the present invention.
Figure 12:
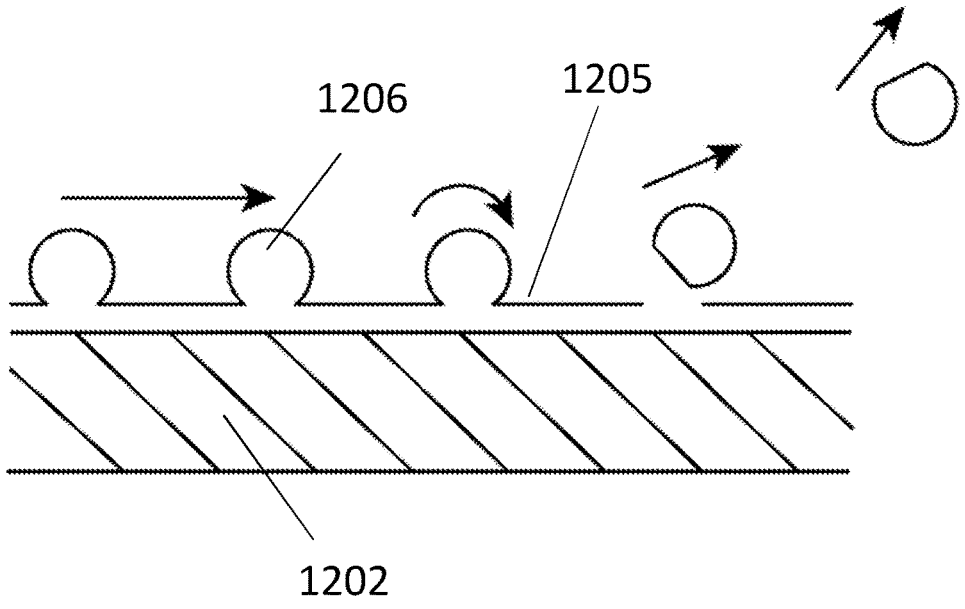
FIG. 12 is a diagram showing the movement of various components of an impact mitigating structure in accordance with another embodiment of the present invention.

FIGS. 11 and 12 demonstrate the behaviour of the impact mitigating structure during and/or after being subject to an impact exceeding the particular, threshold force.

FIG. 11 shows the impact mitigating structure 100 as seen in FIG. 1. Upon an impact on the outer second layer 104, energy from the impact is transferred to the first layer 102, the second layer 104 and the reactive layer 105. The force of the impact disrupts the arrangement of the spheres 106 in the reactive layer 105. The spheres 106 can then rotate and roll with increased freedom as shown by the arrows in FIG. 11.

The rotation and rolling of the spheres 106 helps the first layer 102 and the second layer 104 slide and to move with respect to each other. In FIG. 11, the first layer 102 and the second layer 104 move in different directions relative to each other as shown by the arrows in FIG. 11 indicating the directions of movement. This results in a well-controlled movement of the first layer 102 and the second layer 104 with respect to each other. The first layer 102 and the second layer 104 may move relative to each over a distance of between 40 mm and 50 mm, for example, depending on the magnitude of the impact.

It will be appreciated that the relative movement of the first layer 102 and the second layer 104 relative to each other, owing to the disruption and movement of the spheres 106 in the reactive layer 105, helps to carry away some of the energy from the impact, particularly in an oblique impact on the second layer 104. This helps to reduce the energy from the impact that is transferred through to the rest of the impact mitigating structure 100, thus helping to reduce the effect of the impact, e.g. on the body that is being protected by the impact mitigating structure 100.

FIG. 12 shows an impact mitigating structure formed from a first layer 1202 and a reactive layer 1205. The discrete elements 1206 of the reactive layer 1205 are held in a particular arrangement by a flexible material (e.g. similar to the arrangement shown in FIGS. 6A and 6B). In other examples, the discrete element may be held in a particular arrangement using connectors (e.g. similar to the arrangement shown in FIG. 3). When subject to an impact having a force above a particular, threshold force, the discrete elements 1206 begin to rotate, fracture from the rest of the reactive layer 1205 and are released from the first layer 1202. The discrete elements 1206 transfer energy from the impact away from the first layer 1200, which reduces the energy transferred to the first layer and to e.g. a person or object fitted with the impact mitigating structure.

Figure 13:
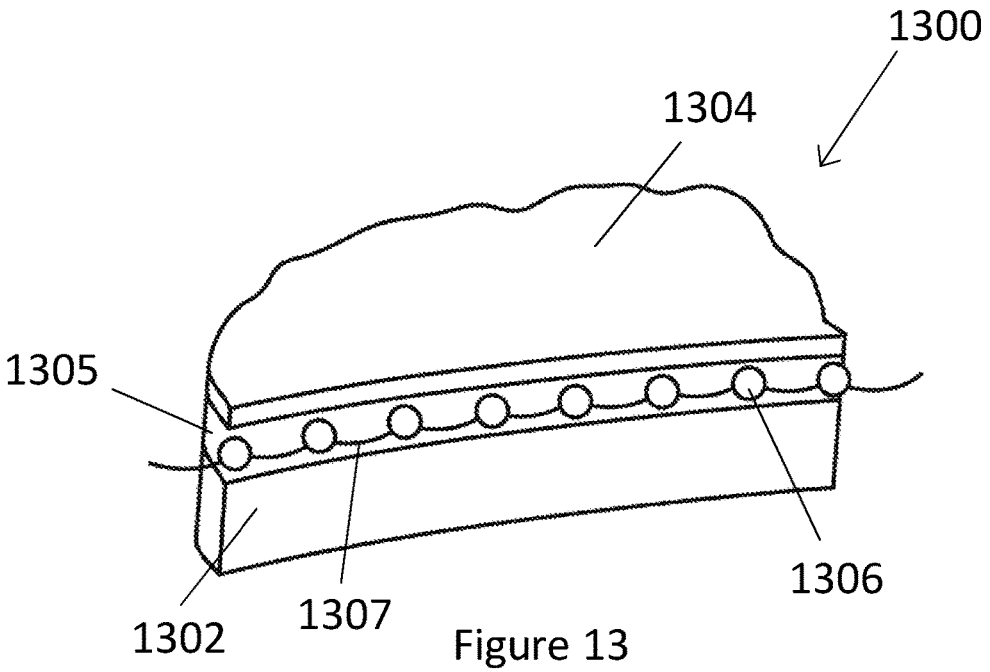
FIG. 13 shows a schematic view of an impact mitigating structure in accordance with another embodiment of the present invention.

FIG. 13 shows schematically a portion of an impacting mitigating structure 1300 in which the elements 1306 of the reactive later 1305 that are located between the first inner layer 1302 and the second outer layer 1304 are connected together by a series of connections 1307. As shown in FIG. 13, the elements 1306 are connected together in a linear string. Embodiments are envisaged in which the elements 1306 are connected together in a 2D or 3D array.

Figure 14:
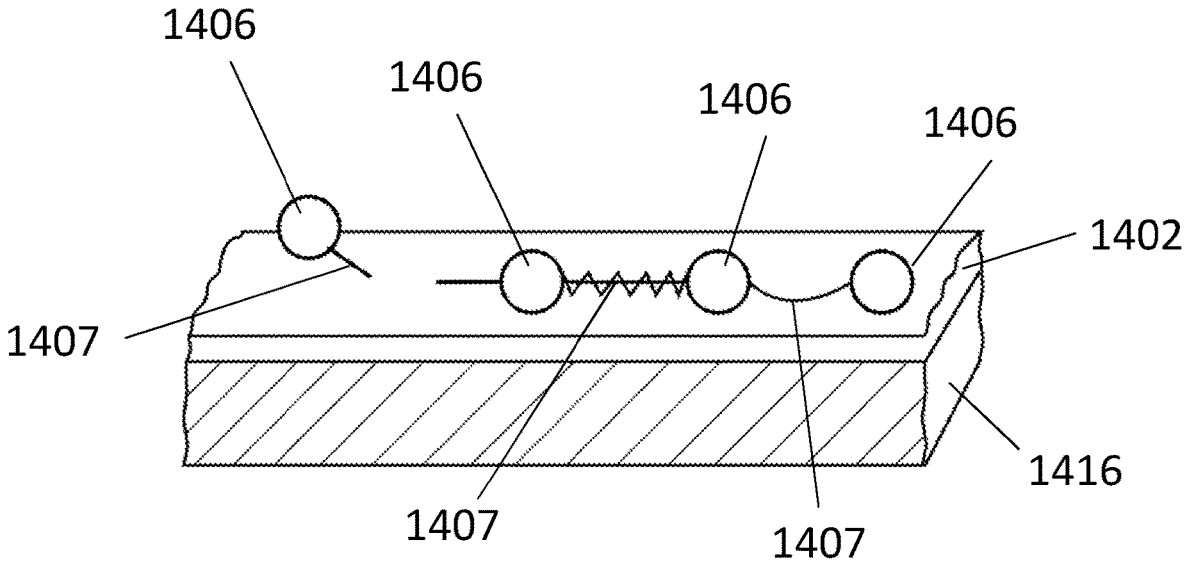
FIGS. 14, 15 and 16 show schematically how connections of a reactive layer may be arranged in accordance with embodiments of the present invention.

FIG. 14 shows schematically how connections 1407, 1408, 1409 between elements 1406 of a reactive layer may be arranged, e.g. relative to an impact absorbing layer 1416 having a shell layer 1402. A connection 1407 may be rigid and brittle, such that it breaks apart upon impact. A connection 1408 may be sprung or elastic, such that it stretches upon impact and, for example, returns to its original state thereafter. A connection 1409 may be slack, such that it is tightened upon impact. It will thus be seen that when an impact mitigating structure containing a reactive layer having elements that are connected together by connections undergoes an impact, the connections are disrupted (e.g. stretched, broken or tightened) in order to allow the elements to move, which thus facilitates movement of the layers of the impact mitigating structure relative to each other.

Figure 15:
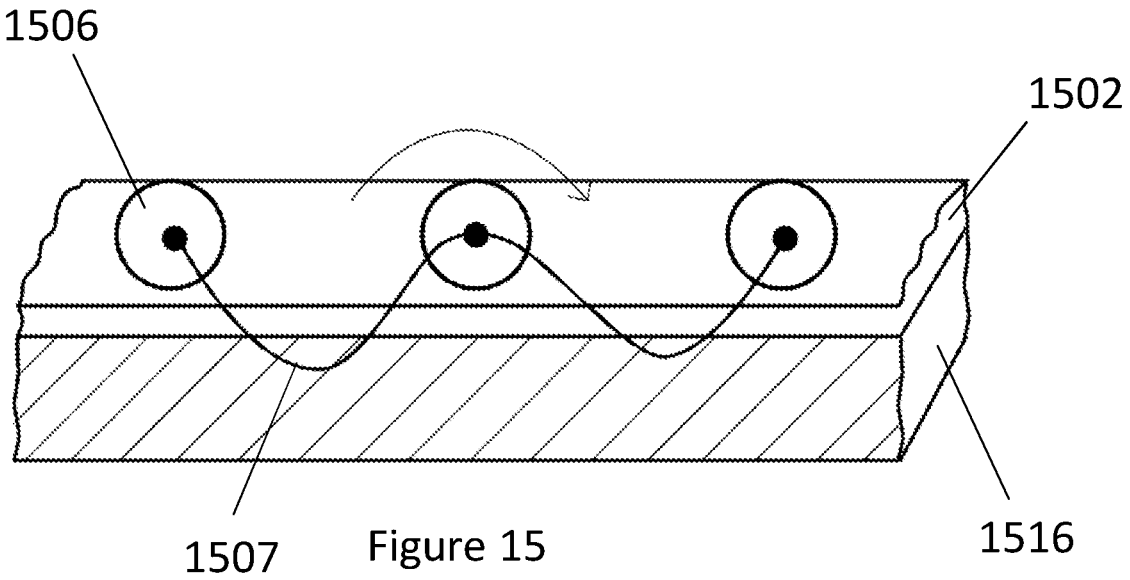

FIG. 15 shows schematically how connections 1507 between elements 1506 of a reactive layer may be connected to an impact absorbing layer 1516 having a shell layer 1502. As shown, the connections 1507 between the elements 1506, which form a string of the elements 1506 and connections 1507, pass through the impact absorbing layer 1516 and the shell layer 1502. In operation, the connections 1507 may break free from the impact absorbing layer 1516 and the shell layer 1502, and/or themselves break, in order to allow the elements 1506 to move, which thus facilitates movement of the layers of the impact mitigating structure relative to each other.

Figure 16:
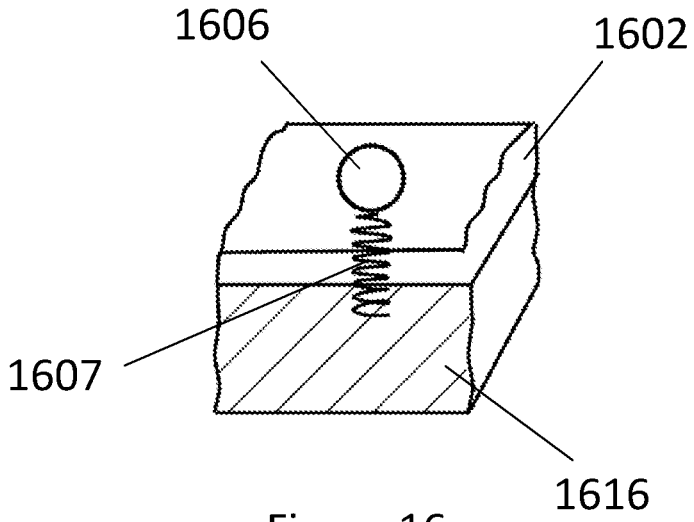

FIG. 16 shows schematically an element 1606 that is individually connected, e.g. via a sprung connection 1607, to an impact absorbing layer 1616 having a shell layer 1602. As shown, the connection 1607 between the element 1606 passes through the impact absorbing layer 1616 and the shell layer 1602. In operation, the connection 1607 may stretch and/or break free from the impact absorbing layer 1616 and the shell layer 1602, and/or itself break, in order to allow the element 1606 to move, which thus facilitates movement of the layers of the impact mitigating structure relative to each other.

Figure 17:
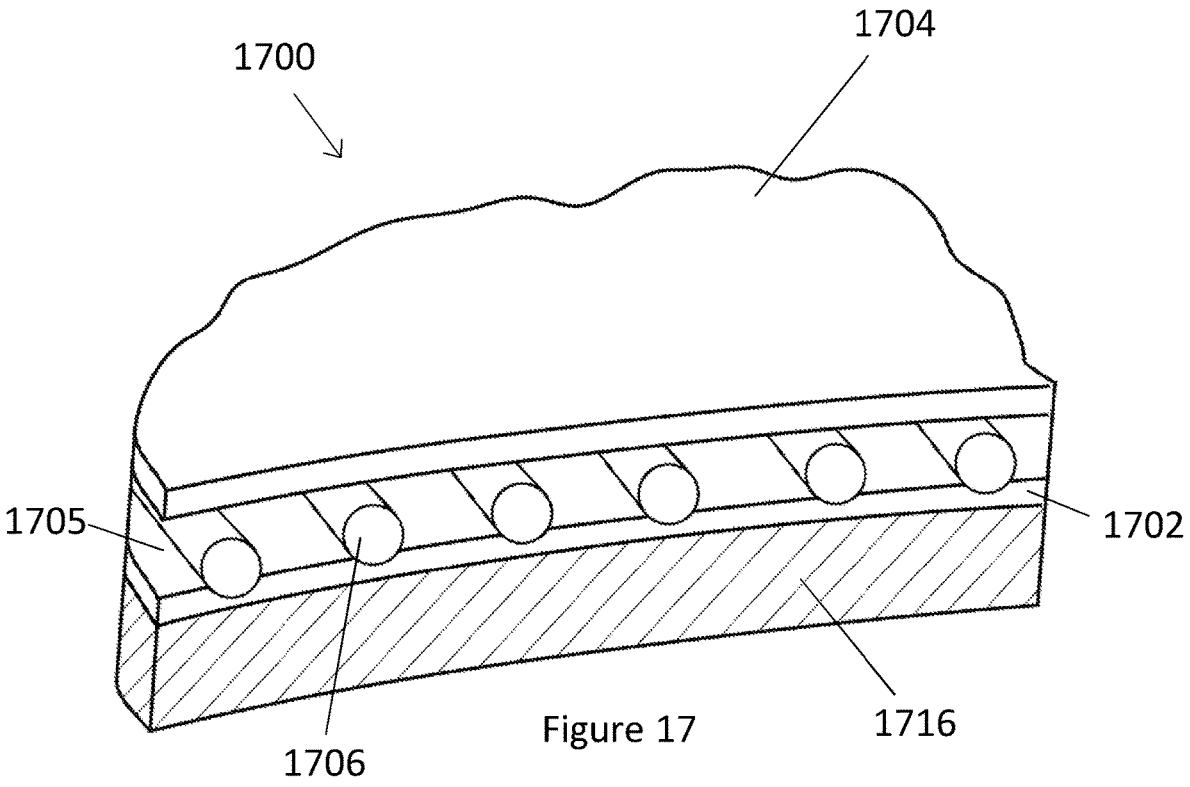
FIG. 17 shows a schematic view of an impact mitigating structure in accordance with another embodiment of the present invention.

FIG. 17 shows schematically an impact mitigating structure 1700 having a reactive layer 1705 between an outer layer 1704 and a shell layer 1702 that covers an energy absorbing layer 1716. In the reactive layer 1705 the elements 1706 are cylindrical. When subject to an impact on the impact mitigating structure 1700 that causes the elements 1706 of the reactive layer 1705 to roll (thus facilitating movement of the outer layer 1704 and the shell layer 1702 relative to each other), the cylindrical elements 1706 roll preferentially in the direction perpendicular to their axis of symmetry.

Figure 18:
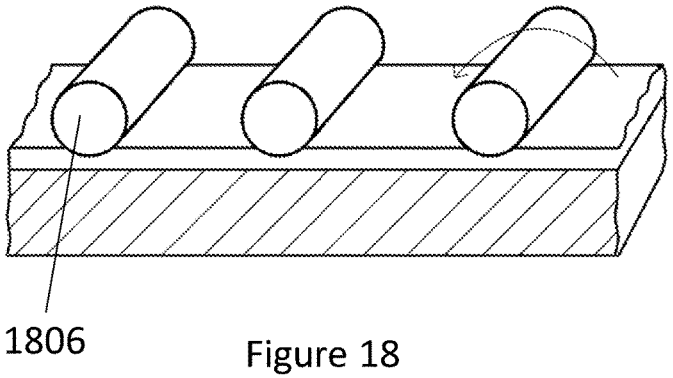
FIGS. 18, 19 and 20 show schematically how cylindrical elements of a reactive layer may be arranged in accordance with embodiments of the present invention.

FIG. 18 shows schematically the rolling of cylindrical elements 1806 of a reactive layer, upon impact of an impact mitigating structure. As shown, the cylindrical elements 1806 roll in the direction perpendicular to their axis of symmetry.

Figure 19:
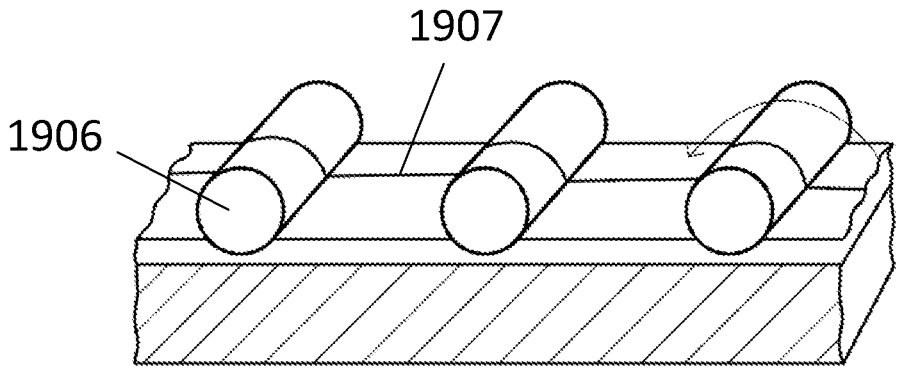

FIG. 19 shows schematically, in a similar manner to the elements of the reactive layer shown in FIG. 13, for example, that the cylindrical elements 1906 of a reactive layer may be connected together by (e.g. a string of) connections 1907.

Figure 20:
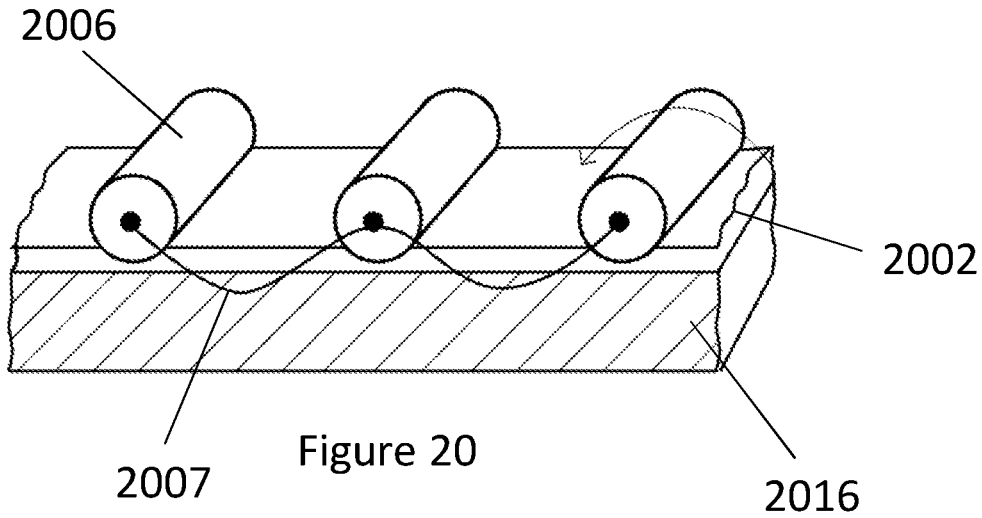

FIG. 20 shows schematically, in a similar manner to the elements of the reactive layer shown in FIG. 15, for example, that the cylindrical elements 2006 of a reactive layer may be connected together by (e.g. a string of) connections 2007 that pass through an impact absorbing layer 1516 and a shell layer 1502 of the impact mitigating structure.

Figure 21:
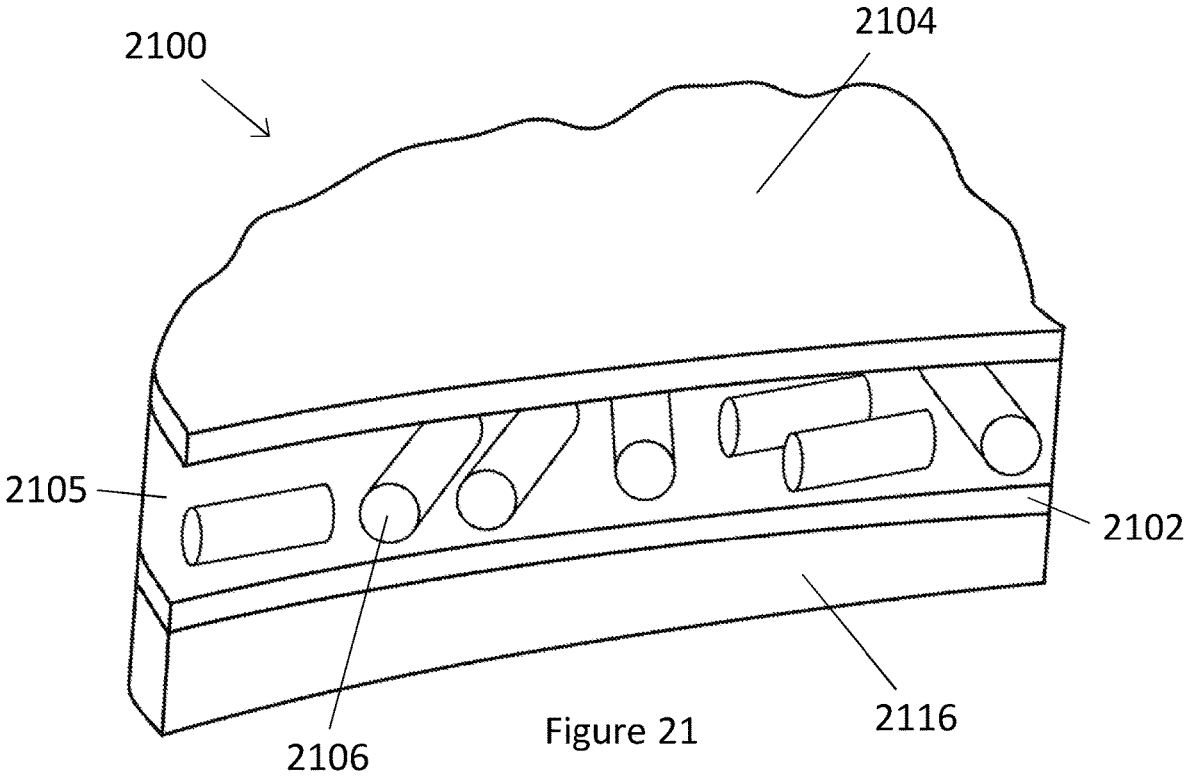
FIG. 21 shows a schematic view of an impact mitigating structure in accordance with another embodiment of the present invention.

FIG. 21 shows schematically an impact mitigating structure 2100 having a reactive layer 2105 between an outer layer 2104 and a shell layer 2102 that covers an energy absorbing layer 2116. Similar to the impact mitigating structure shown in FIG. 17, in the reactive layer 2105 the elements 2106 are cylindrical. However, as shown in FIG. 21, the cylindrical elements 2106 are arranged with their axes not all aligned to each other. Thus, when subject to an impact on the impact mitigating structure 2100 that causes the elements 2106 of the reactive layer 2105 to roll (thus facilitating movement of the outer layer 2104 and the shell layer 2102 relative to each other), the cylindrical elements 2106 roll in multiple different directions. This helps to control the friction between the outer layer 2104 and the shell layer 2102 that are moving relative to each other.

Figure 22:
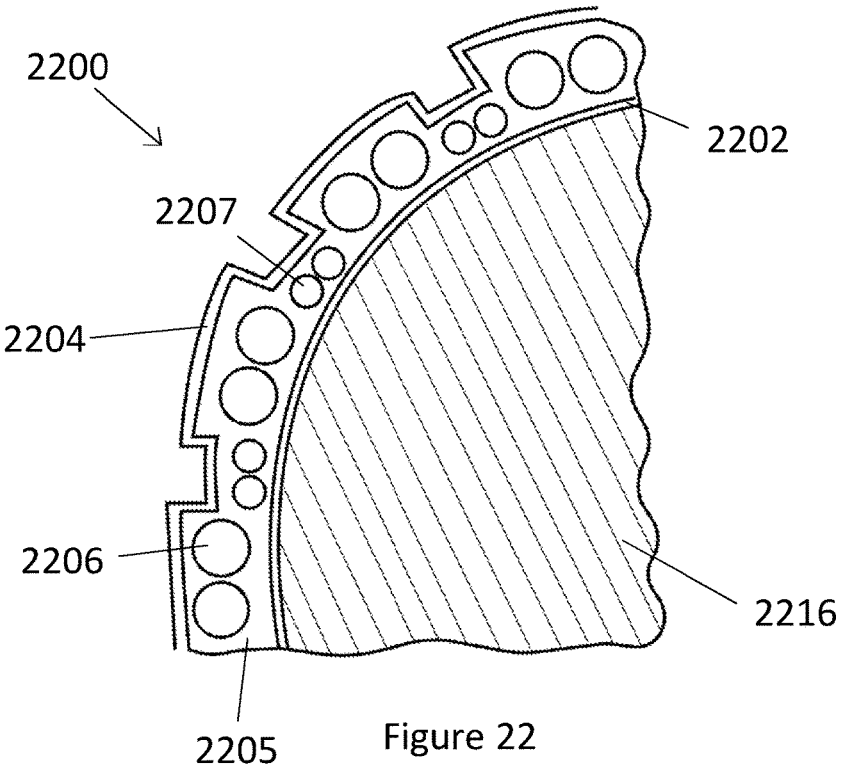
FIG. 22 shows a schematic cross-sectional view of an impact mitigating structure in accordance with another embodiment of the present invention.

FIG. 22 shows schematically a cross-sectional view through an impact mitigating structure 2200. The impact mitigating structure 2200 has a shell layer 2202 that covers an energy absorbing layer 2216, and a reactive layer 2205 between an outer layer 2204 and the shell layer 2202. The outer layer 2204 includes a number of undulations, such that it has portions that project outwards and recesses that project inwards. Thus the spacing between the outer layer 2204 and the shell layer 2202 varies over the reactive layer 2205. To accommodate the varying spacing between the outer layer 2204 and the shell layer 2202, the elements 2206, 2207 of the reactive layer 2205 are of multiple different sizes, that match the spacing of the between the outer layer 2204 and the shell layer 2202. For example, the reactive layer 2205 includes larger elements 2206 when the spacing between the outer layer 2204 and the shell layer 2202 is larger and smaller elements 2207 when the spacing between the outer layer 2204 and the shell layer 2202 is smaller.

Figure 23:
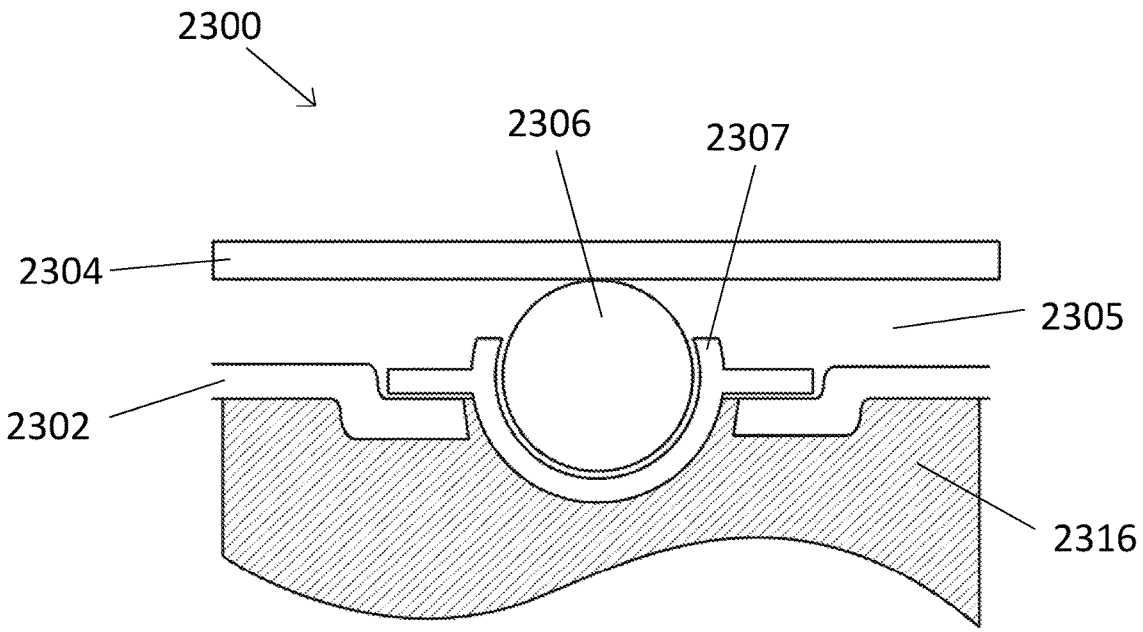
FIG. 23 shows a schematic cross-sectional view of an impact mitigating structure in accordance with another embodiment of the present invention.

FIG. 23 shows schematically a cross-sectional view through an impact mitigating structure 2300. The impact mitigating structure 2300 has a shell layer 2302 that covers an energy absorbing layer 2316, and a reactive layer 2305 between an outer layer 2304 and the shell layer 2302. The reactive layer 2305 includes a housing 2307 for one (or more) rolling elements 2306. The housing 2307 partially contains the rolling element 2306 so that a portion of the rolling element 2306 is exposed. In operation, when the impact mitigating structure 2300 is subject to an impact, the exposed portion of the rolling element 2306 contacts the outer layer 2304, facilitating movement of the outer layer 2304 relative to the shell layer 2302, owing to rolling of the element 2306 in the housing 2307.

Figure 24A:
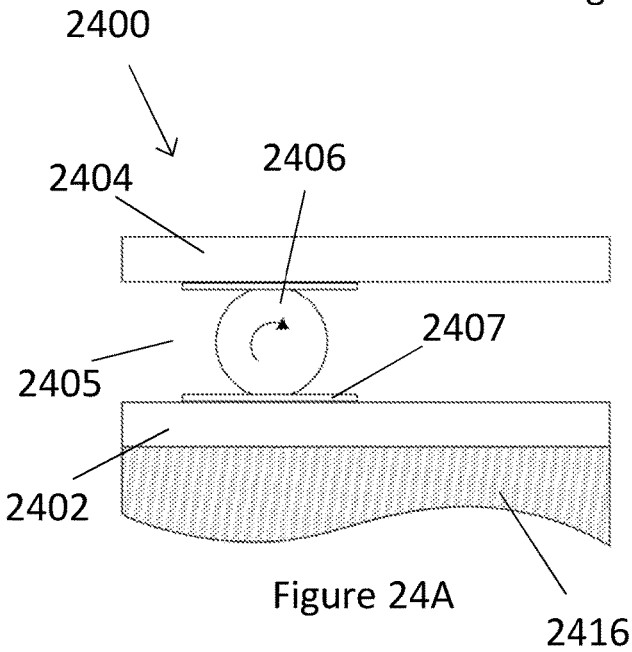
FIGS. 24A and 24B shows a schematic cross-sectional view of an impact mitigating structure in accordance with another embodiment of the present invention.
Figure 24B:
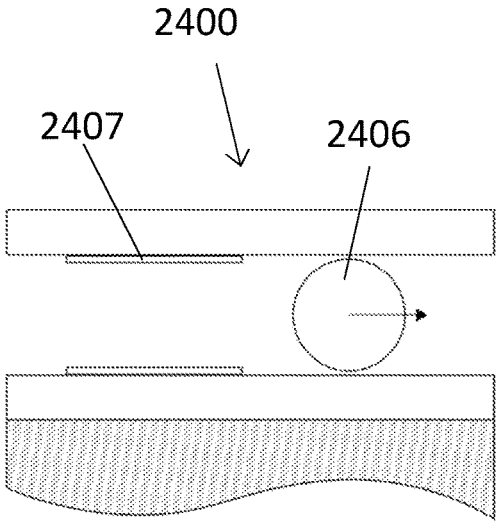

FIGS. 24A and 24B show schematically a cross-sectional view through an impact mitigating structure 2400. The impact mitigating structure 2400 has a shell layer 2402 that covers an energy absorbing layer 2416, and a reactive layer 2405 between an outer layer 2404 and the shell layer 2402. In the reactive layer 2405, elements 2406 are held in place (during normal use) between the shell layer 2402 and the outer layer 2404 by patches of adhesive 2407. In operation, when the impact mitigating structure 2400 is subject to an impact (as shown in FIG. 24B), the elements 2406 are released by rolling (e.g. peeling) away from the patches of adhesive 2407, so that they are free to roll, thus facilitating movement of the outer layer 2404 relative to the shell layer 2402.

Figure 25:
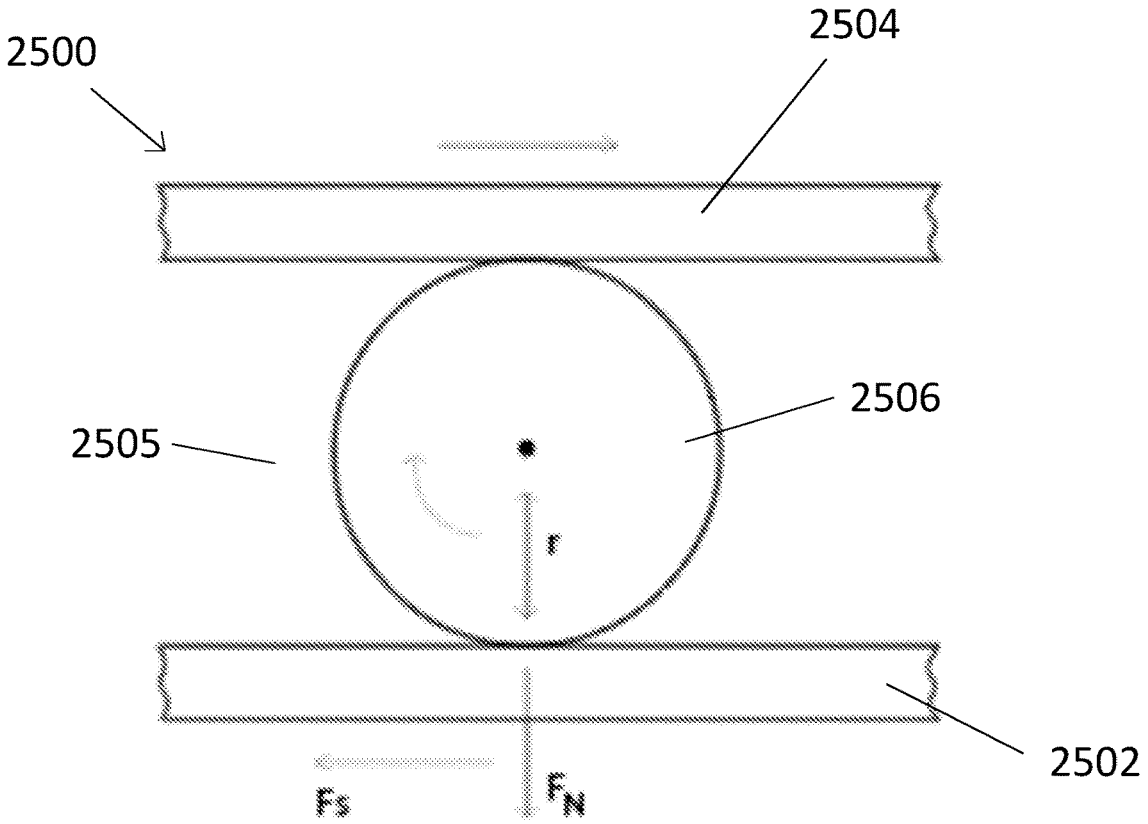
FIG. 25 shows a schematic cross-sectional view of an impact mitigating structure in accordance with another embodiment of the present invention.

FIG. 25 shows schematically a cross-sectional view through an impact mitigating structure 2500. The impact mitigating structure 2500 has a reactive layer 2505 between an outer layer 2504 and an inner layer 2502. The reactive layer 2505 has rolling elements 2506. One or more (e.g. all) of the inner layer 2502, the outer layer 2504 and the rolling elements 2506 have a high friction surface. In operation, when the impact mitigating structure 2500 is subject to an impact, the friction between the elements 2506 and one or both of the inner layer 2502 and the outer layer 2504 creates a torque that causes the elements 2506 to roll, thus facilitating movement of the outer layer 2504 relative to the inner layer 2502.

Figure 26:
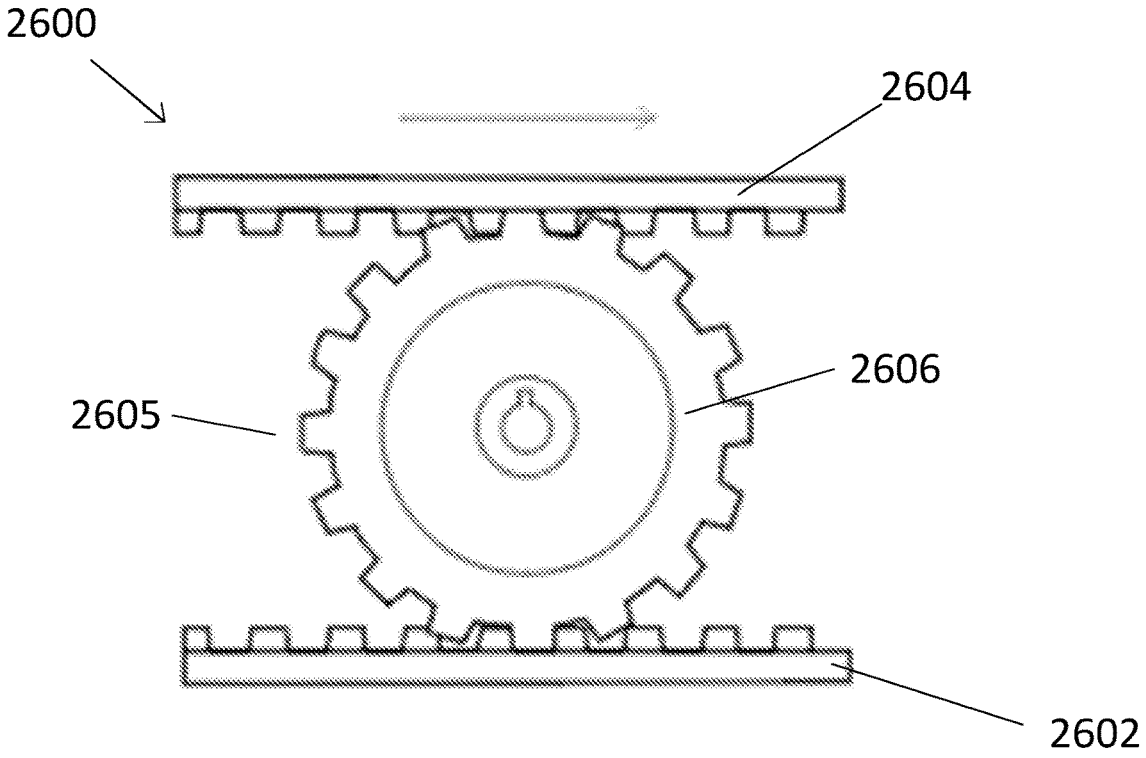
FIG. 26 shows a schematic cross-sectional view of an impact mitigating structure in accordance with another embodiment of the present invention.

FIG. 26 shows schematically a cross-sectional view through an impact mitigating structure 2600. The impact mitigating structure 2600 has a reactive layer 2605 between an outer layer 2604 and an inner layer 2602. The reactive layer 2605 has rolling elements 2606. The inner layer 2602, the outer layer 2604 and the rolling elements 2606 have interlinking notches formed in their respective surfaces. In operation, when the impact mitigating structure 2600 is subject to an impact, the interlinking notches between the elements 2506 and the inner layer 2602 and the outer layer 264 acts like a rack and pinion to create a torque that causes the elements 2606 to roll, thus facilitating movement of the outer layer 2604 relative to the inner layer 2602.

Figure 27:
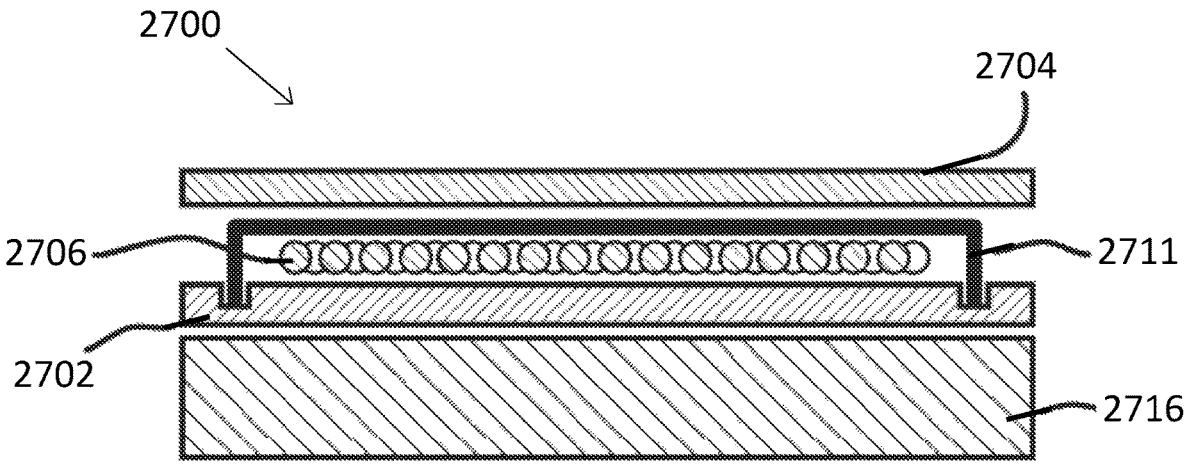
FIG. 27 shows a schematic cross-sectional view of an impact mitigating structure in accordance with another embodiment of the present invention.

FIG. 27 shows schematically a cross-sectional view through an impact mitigating structure 2700. The impact mitigating structure 2700 is similar to that shown in FIG. 10, in that it includes two thin layers 2702, 2704 either side of multiple rolling elements 2706 of the reactive layer, as well as a thicker inner impact absorbing layer 2716. The thin layers 2702, 2704 (e.g. made from polycarbonate) are harder than the inner impact absorbing layer 2716 (e.g. made from EPS).

The reactive layer also includes a flexible (e.g. textile) layer 2711 that is bonded to the thin layer 2702 next to the impact absorbing layer 2716. The flexible layer 2711 holds the multiple rolling elements 2706 in place in the reactive layer and retains the multiple rolling elements 2706 between the flexible layer 2711 and the thin layer 2702 in an impact.

Figure 28:
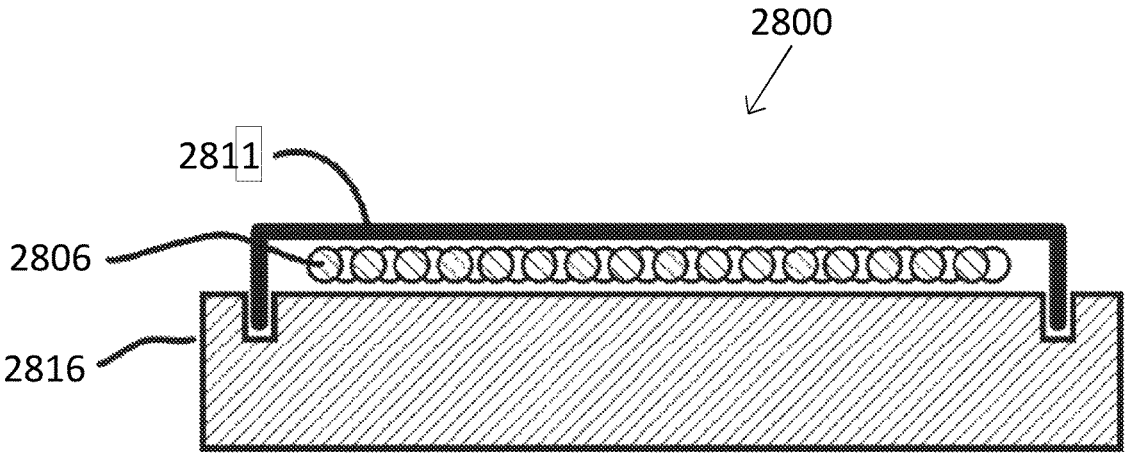
FIG. 28 shows a schematic cross-sectional view of an impact mitigating structure in accordance with another embodiment of the present invention.

FIG. 28 shows schematically a cross-sectional view through an impact mitigating structure 2800. The impact mitigating structure 2800 is similar to that shown in FIG. 27, in that it includes a flexible layer 2811 that retains multiple rolling elements 2806 of a reactive layer. In this impact mitigating structure 2800, the flexible layer 2811 is the outermost layer of the impact mitigating structure 2800, and does not include a further outer (e.g. hard) layer. The flexible layer 2811 is bonded directly into the impact absorbing layer 2816, rather than to any intermediate (hard) thinner layer, which is not present in this embodiment.

Figure 29:
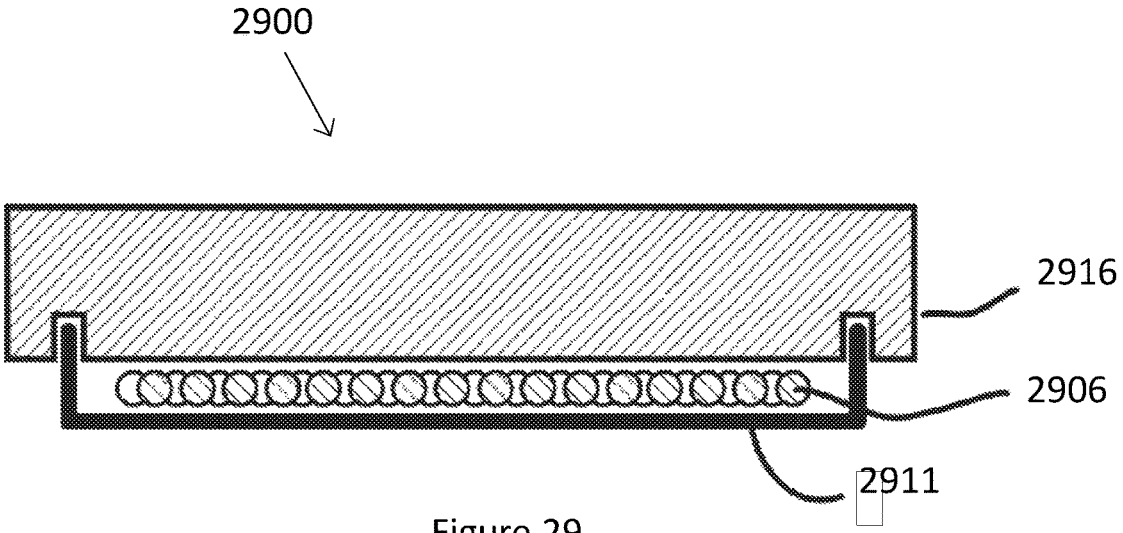
FIG. 29 shows a schematic cross-sectional view of an impact mitigating structure in accordance with another embodiment of the present invention.

FIG. 29 shows schematically a cross-sectional view through an impact mitigating structure 2900. The impact mitigating structure 2900 is similar to that shown in FIG. 28, in that it has the same components: an impact absorbing layer 2916, a flexible layer 2911 and multiple rolling elements 2906 of a reactive layer that are held between the impact absorbing layer 2916 and the flexible layer 2911. However, in the embodiment shown in FIG. 29, the ordering of the layers is reversed: the flexible layer 2911 is the innermost layer (e.g. arranged to be adjacent to the head of a wearer of a helmet incorporating the impact mitigating structure 2900) and the impact absorbing layer 2916 is on the outside.

Figure 30A:
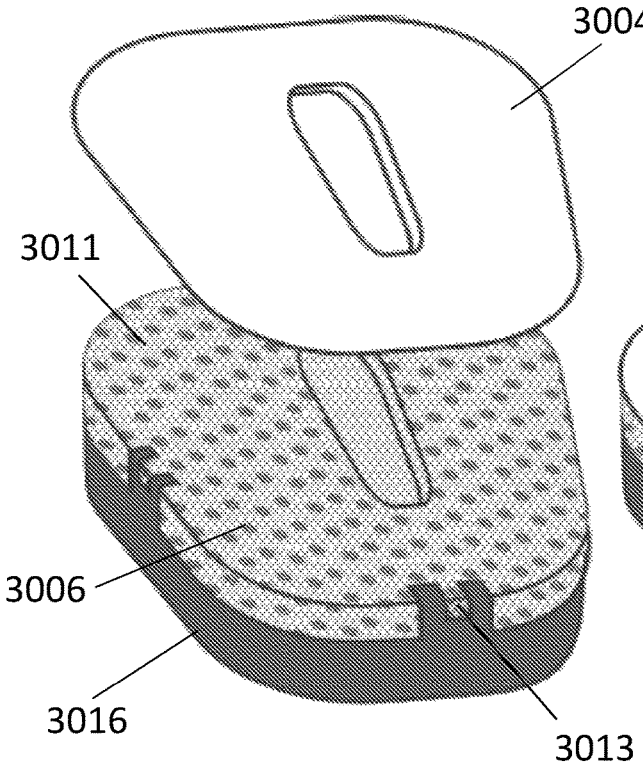
FIGS. 30A and 30B show schematic views of an impact mitigating structure in accordance with another embodiment of the present invention.
Figure 30B:
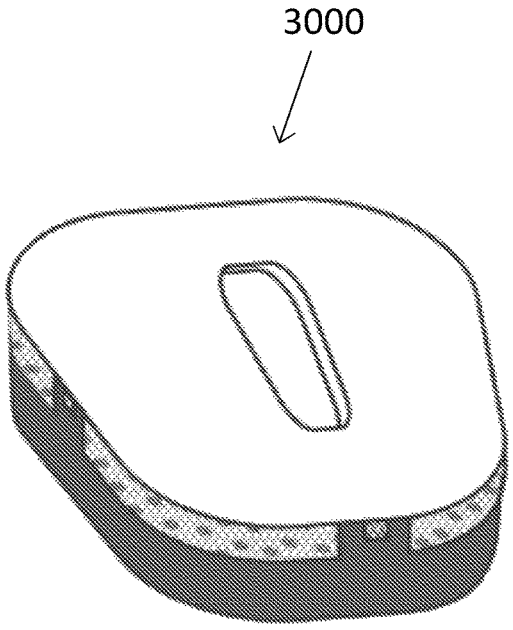

FIGS. 30A and 30B show schematic views of an impact mitigating structure 3000, with FIG. 30A showing a partly exploded view. The impact mitigating structure 3000 is similar to that shown in FIG. 27 in that it includes an impact absorbing layer 3016, an outer (hard, thin) layer 3004 and an intermediate reactive layer that includes multiple rolling elements 3006 that are retained by a flexible layer 3011.

The flexible layer 3011 is attached to the impact absorbing layer 3016 by interlinking notches 3013 in the impact absorbing layer 3016 and the reactive layer.

Figure 31:
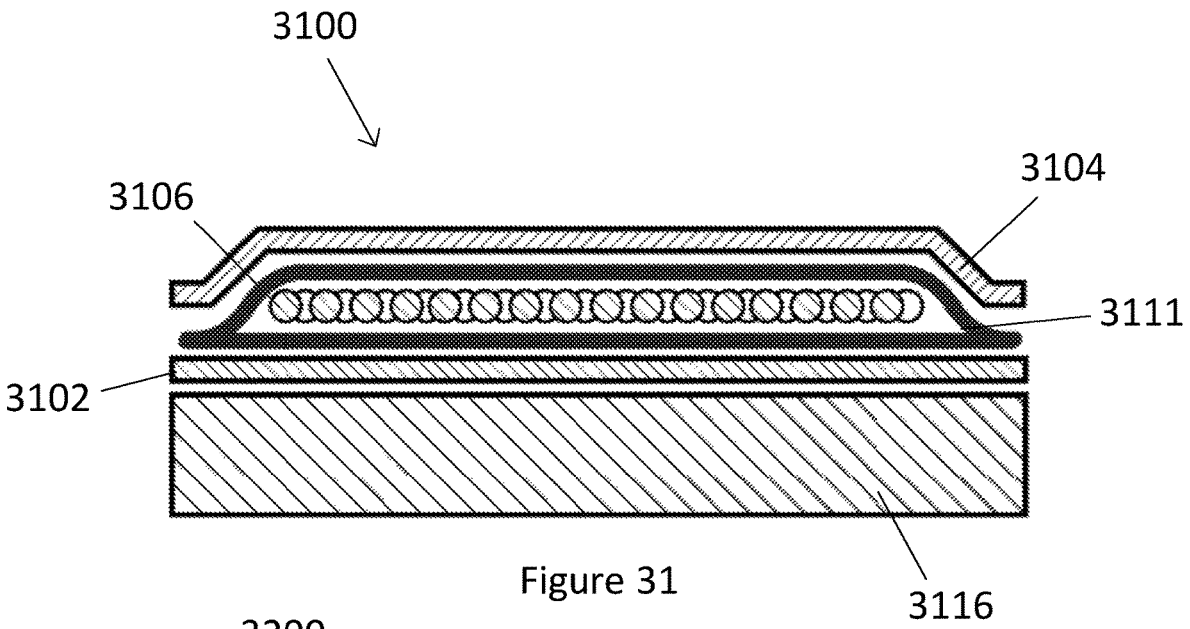
FIG. 31 shows a schematic cross-sectional view of an impact mitigating structure in accordance with another embodiment of the present invention.

FIG. 31 shows schematically a cross-sectional view through an impact mitigating structure 3100. The impact mitigating structure 3100 is similar to that shown in FIG. 27, in that it includes two thin layers 3102, 3104 either side of multiple rolling elements 3106 of a reactive layer, as well as a thicker inner impact absorbing layer 3116. The thin layers 3102, 3104 (e.g. made from polycarbonate) are harder than the inner impact absorbing layer 3116 (e.g. made from EPS).

The reactive layer also includes a flexible (e.g. textile) layer 3111 that surrounds and encapsulates the multiple rolling elements 3106. The flexible layer 3111 holds the multiple rolling elements 3106 in place in the reactive layer and retains the multiple rolling elements 3106 within the flexible layer 3111 in an impact.

Figure 32A:
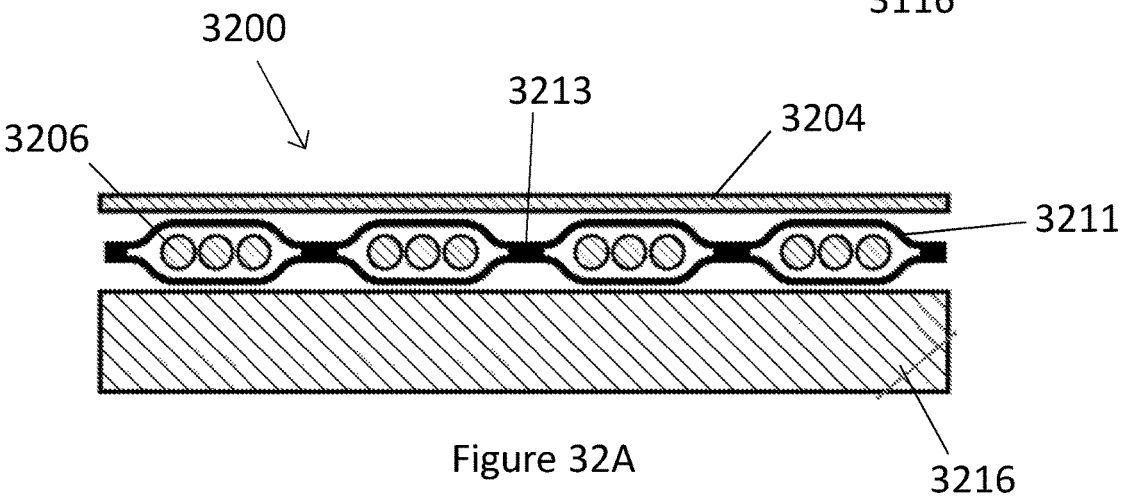
FIGS. 32A and 32B show a schematic cross-sectional view of an impact mitigating structure in accordance with another embodiment of the present invention.
Figure 32B:
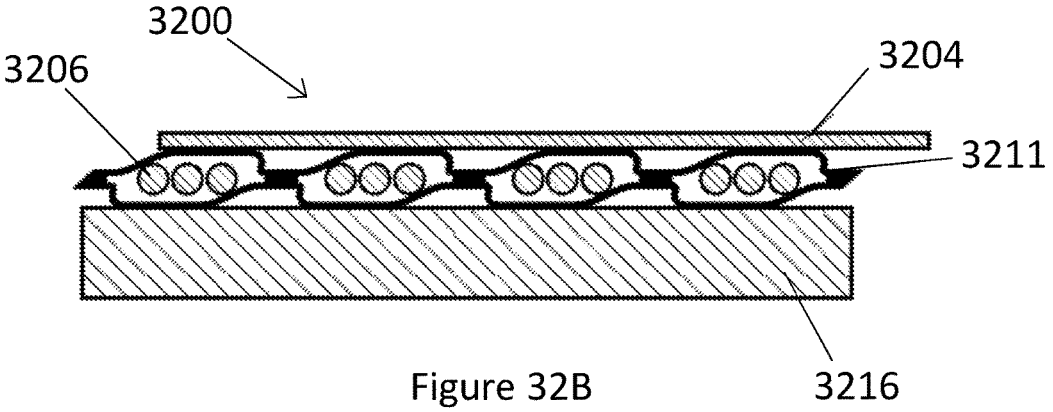

FIGS. 32A and 32B show schematically a cross-sectional view through an impact mitigating structure 3200. The impact mitigating structure 3200 is similar to that shown in FIG. 31, in that it includes a flexible (e.g. textile) layer 3211 that surrounds and encapsulates multiple rolling elements 3206 of a reactive layer.

The flexible layer 3211 is attached (e.g. using adhesive) on either side to a thin outer layer 3204 and an inner impact absorbing layer 3216. The flexible layer 3211 has multiple hinge lines 3213 at which the two sides of flexible layer 3211 are attached to each other. This separates the multiple rolling elements 3206 into multiple discrete portions of the reactive layer.

FIG. 32B shows operation of the impact mitigating structure 3200 when it is subject to an impact having a tangential component (parallel to the plane of the outer layer 3204). In a first phase of the impact, the outer layer 3204 is displaced relative to the inner impact absorbing layer 3216. Owing to the flexible layer 3211 being attached to the outer layer 3204 and the inner impact absorbing layer 3216, the flexible layer 3211 deforms and stretches, but does not rupture.

The impact also causes the outer layer 3204 and the inner impact absorbing layer 3216 to contact the multiple rolling elements 3206 via the respective sides of the flexible layer 3211. This causes the multiple rolling elements 3206 to roll, owing to the friction between the contact points of the outer layer 3204, the flexible layer 3211, the inner impact absorbing layer 3216 and the multiple rolling elements 3206. This facilitates the movement of the outer layer 3204 relative to the inner impact absorbing layer 3216.

The hinge lines 3213 in the flexible layer 3211 allow the reactive layer to flex such that during displacement of the outer layer 3204 relative to the inner impact absorbing layer 3216, the reactive layer is able to conform to this displacement, particularly when the outer layer 3204 and the inner impact absorbing layer 3216 have doubly curved surfaces.

If the impact has a force that is less than a particular, threshold force, the outer layer 3204 remains attached to the flexible layer 3211. After the impact, the flexible layer 3211, and thus the outer layer 3204, return to their original positions. If the impact has a force exceeding a particular, threshold force, the outer layer 3204 detaches from the flexible layer 3211 and separates from the remainder of the impact mitigating structure 3200. The release of the outer layer 3204 from the flexible layer 3211 allows the flexible layer 3211 to return to its original position, retaining the multiple rolling elements 3206.

Figure 33A:
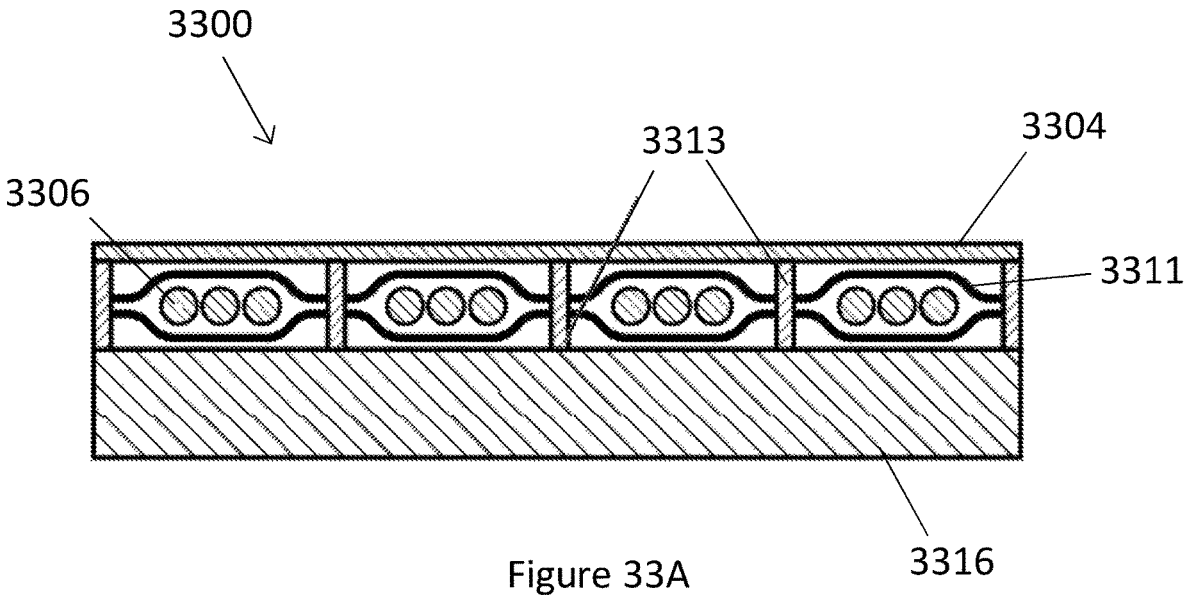
FIGS. 33A and 33B show a schematic cross-sectional view of an impact mitigating structure in accordance with another embodiment of the present invention.
Figure 33B:
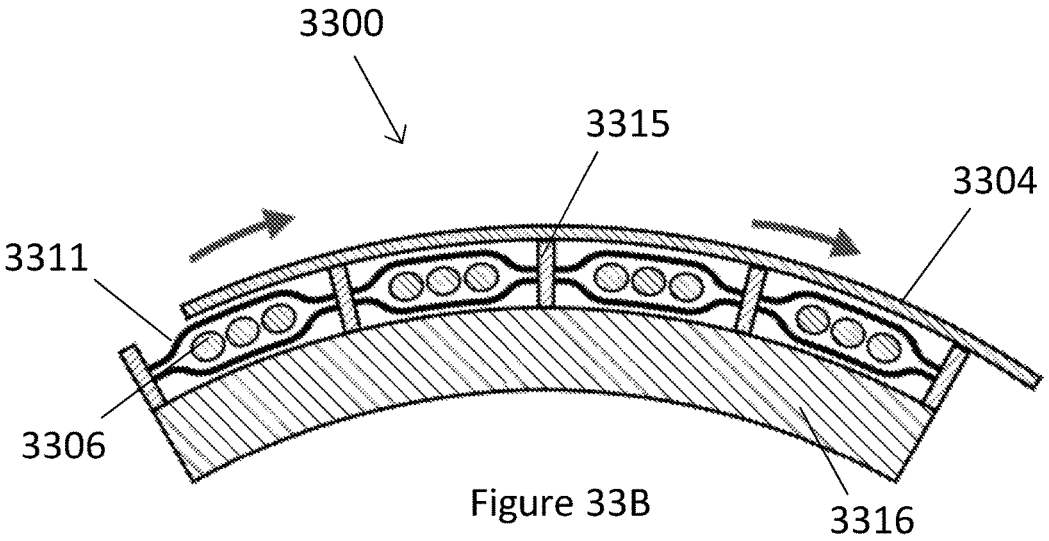

FIGS. 33A and 33B show schematically a cross-sectional view through an impact mitigating structure 3300. The impact mitigating structure 3300 is similar to that shown in FIGS. 32A and 32B, in that it includes a flexible (e.g. textile) layer 3311 that surrounds and encapsulates multiple rolling elements 3306 of a reactive layer between a thin outer layer 3304 and an inner impact absorbing layer 3316. Multiple struts 3315 connect the thin outer layer 3304 to the inner impact absorbing layer 3316.

The struts 3315 pass through the flexible layer 3311 and thus divide the reactive layer into multiple discrete portions, each including multiple rolling elements 3306. The struts 3315 are arranged to pivot (e.g. at the points at which they attach to the outer layer 3304 and the inner impact absorbing layer 3316) when the impact mitigating structure 3300 is subject to an impact that displaces the outer layer 3304 with respect to the inner impact absorbing layer 3316.

The pivoting of the struts 3315 helps to allow the reactive layer to move between the (e.g. doubly curved) surfaces of the outer layer 3304 and the inner impact absorbing layer 3316, when the outer layer 3304 is displaced relative to the inner impact absorbing layer 3316, as shown in FIG. 33B.

Figure 34:
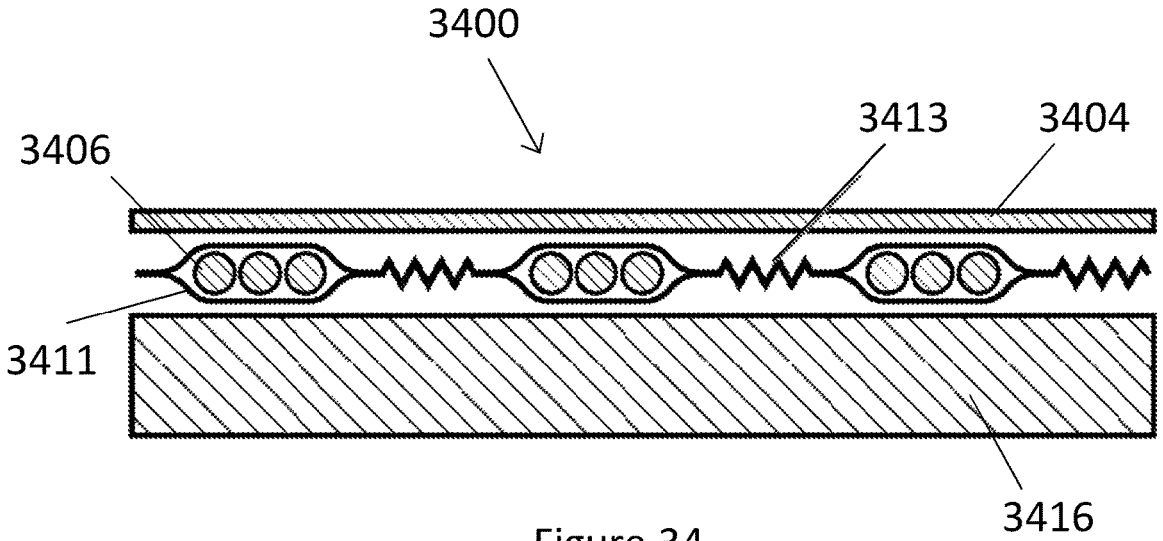
FIG. 34 shows a schematic cross-sectional view of an impact mitigating structure in accordance with another embodiment of the present invention.

FIG. 34 shows schematically a cross-sectional view through an impact mitigating structure 3400. The impact mitigating structure 3400 is similar to that shown in FIGS. 32A and 32B, in that it includes a flexible (e.g. textile) layer 3411 that surrounds and encapsulates multiple rolling elements 3406 of a reactive layer between a thin outer layer 3404 and an inner impact absorbing layer 3416.

The flexible layer 3411 has multiple hinge lines 3413 at which the two sides of flexible layer 3411 are attached to each other. This separates the multiple rolling elements 3406 into multiple discrete portions of the reactive layer. The hinge lines 3413 are formed by crimping the flexible layer 3411 into springs. This allows the reactive layer to stretch as well as flex, when the impact mitigating structure 3400 is subject to an impact, again helping it to conform to the moving surfaces of the outer layer 3404 and the inner impact absorbing layer 3416.

Figure 35A:
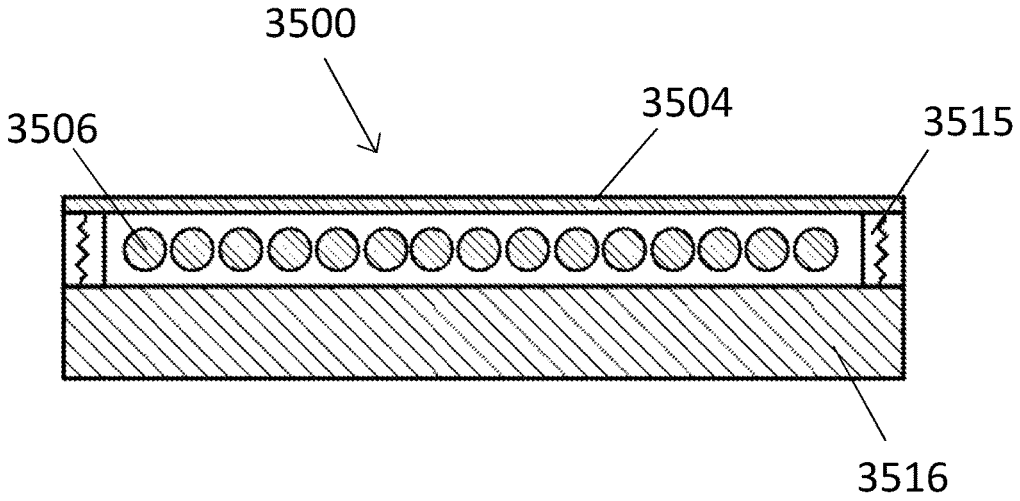
FIGS. 35A and 35B show a schematic cross-sectional view of an impact mitigating structure in accordance with another embodiment of the present invention.
Figure 35B:
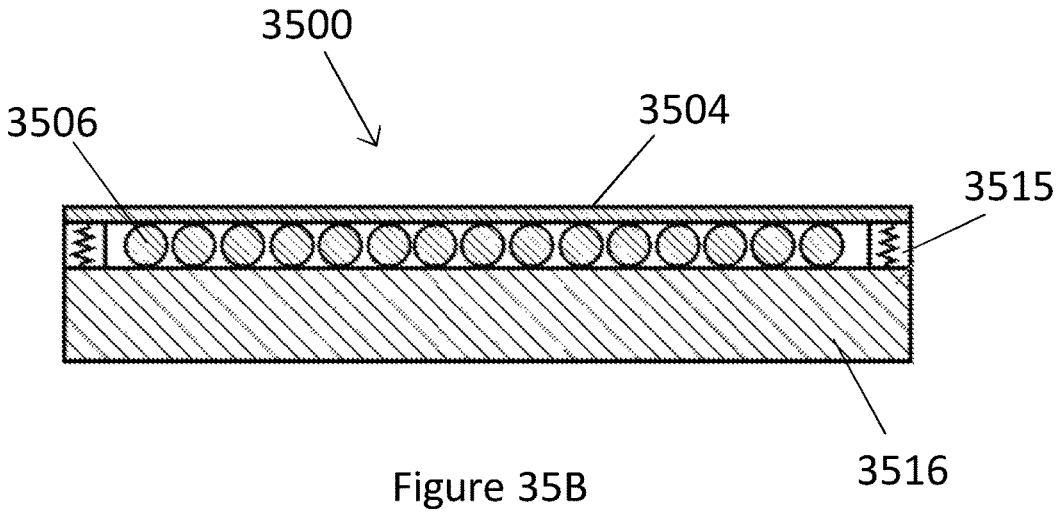

FIGS. 35A and 35B show schematically a cross-sectional view through an impact mitigating structure 3500. The impact mitigating structure 3500 is similar to that shown in FIG. 7 in that it includes a thin outer layer 3504 and an inner impact absorbing layer 3516, between which are arranged multiple rolling elements 3506 of a reactive layer.

The outer layer 3504 and the inner impact absorbing layer 3516 are attached to each other around their respective perimeters by a compressible foam tape 3515. In operation, as shown in FIG. 35B, when the impact mitigating structure 3500 is subject to an impact, the impact causes the compressible foam tape 3515 to compress, such that the outer layer 3504 and the inner impact absorbing layer 3516 contact the respective sides of the multiple rolling elements 3506. This contact of the outer layer 3504 and the inner impact absorbing layer 3516 with the multiple rolling elements 3506 causes the multiple rolling elements 3506 to roll, thus facilitating movement of the outer layer 3504 and the inner impact absorbing layer 3516 relative to each other.

The compressible foam tape 3515 prevents the outer layer 3504 and the inner impact absorbing layer 3516 from contacting each other, which helps to reduce the friction between outer layer 3504 and the inner impact absorbing layer 3516, and helps to prevent geometric locking between the outer layer 3504 and the inner impact absorbing layer 3516.

Figure 36:
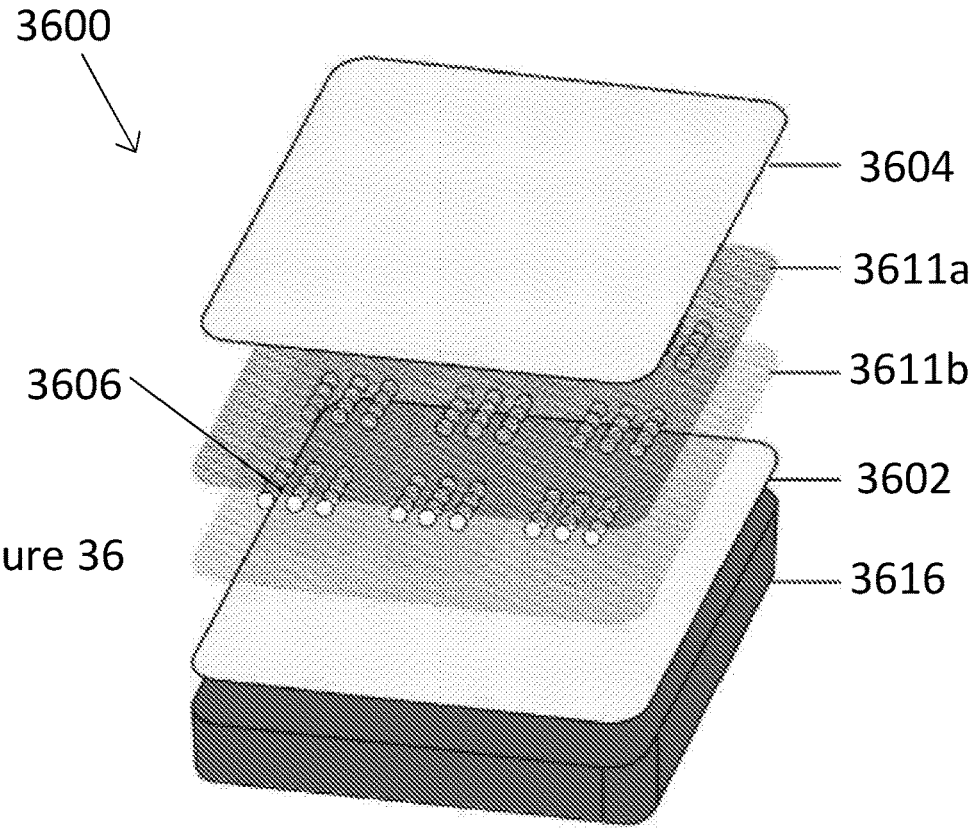
FIG. 36 shows a schematic exploded view of an impact mitigating structure in accordance with another embodiment of the present invention.

FIG. 36 shows schematically an exploded view of an impact mitigating structure 3600. The impact mitigating structure 3600 is similar to that shown in FIG. 31 in that it includes two thin layers 3602, 3604 either side of multiple rolling elements 3606 of a reactive layer, as well as a thicker inner impact absorbing layer 3616. The thin layers 3602, 3604 (e.g. made from polycarbonate) are harder than the inner impact absorbing layer 3616 (e.g. made from EPS).

The reactive layer also includes a flexible (e.g. textile) layer 3611*a*, 3611*b* that surrounds and encapsulates the multiple rolling elements 3606. The flexible layer 3611*a*, 3611*b* holds the multiple rolling elements 3606 in place in the reactive layer and retains the multiple rolling elements 3606 within the flexible layer 3611*a*, 3611*b* in an impact.

The flexible layer 3611*a*, 3611*b* is formed from an upper flexible layer 3611*a* and a lower flexible layer 3611*b*. When the impact mitigating structure 3600 is assembled, e.g. by heat pressing the upper flexible layer 3611*a* and the lower flexible layer 3611*b* together at multiple different hinge lines, the multiple rolling elements 3606 are separated out into discrete portions, e.g. as shown in FIGS. 32A and 32B.

Figure 37:
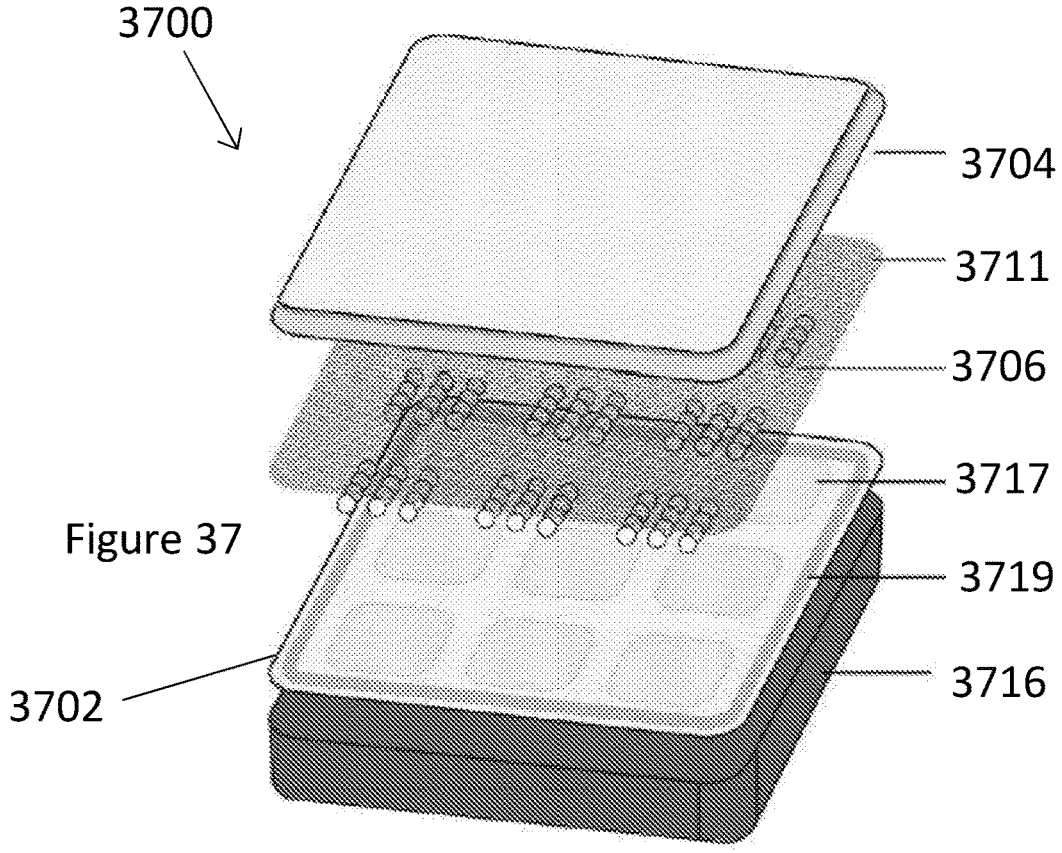
FIG. 37 shows a schematic exploded view of an impact mitigating structure in accordance with another embodiment of the present invention.

FIG. 37 shows schematically an exploded view of an impact mitigating structure 3700. The impact mitigating structure 3700 is similar to that shown in FIG. 27 in that it includes two thin layers 3702, 3704 either side of multiple rolling elements 3706 of a reactive layer, as well as a thicker inner impact absorbing layer 3716. The thin layers 3702, 3704 (e.g. made from polycarbonate) are harder than the inner impact absorbing layer 3716 (e.g. made from EPS).

The reactive layer also includes a flexible (e.g. textile) layer 3700 that is bonded to the thin layer 3702 next to the impact absorbing layer 3716. The flexible layer 3711 holds the multiple rolling elements 3706 in place in the reactive layer and retains the multiple rolling elements 3706 between the flexible layer 3711 and the thin layer 3702 in an impact.

A layer of adhesive 3171 is coated on the inner thin layer 3702 such that when the impact mitigating structure 3600 is assembled, the flexible layer 3711 is bonded to the thin layer 3702. Furthermore, owing to the distribution of the multiple rolling elements 3706 over the thin layer 3702, the multiple rolling elements 3706 are separated out into discrete portions, e.g. as shown in FIGS. 32A and 32B.

The two thin layers 3702, 3704 are connected together by heat pressing, at a line 3719 around the respective perimeters of the two thin layers 3702, 3704.

Figure 38:
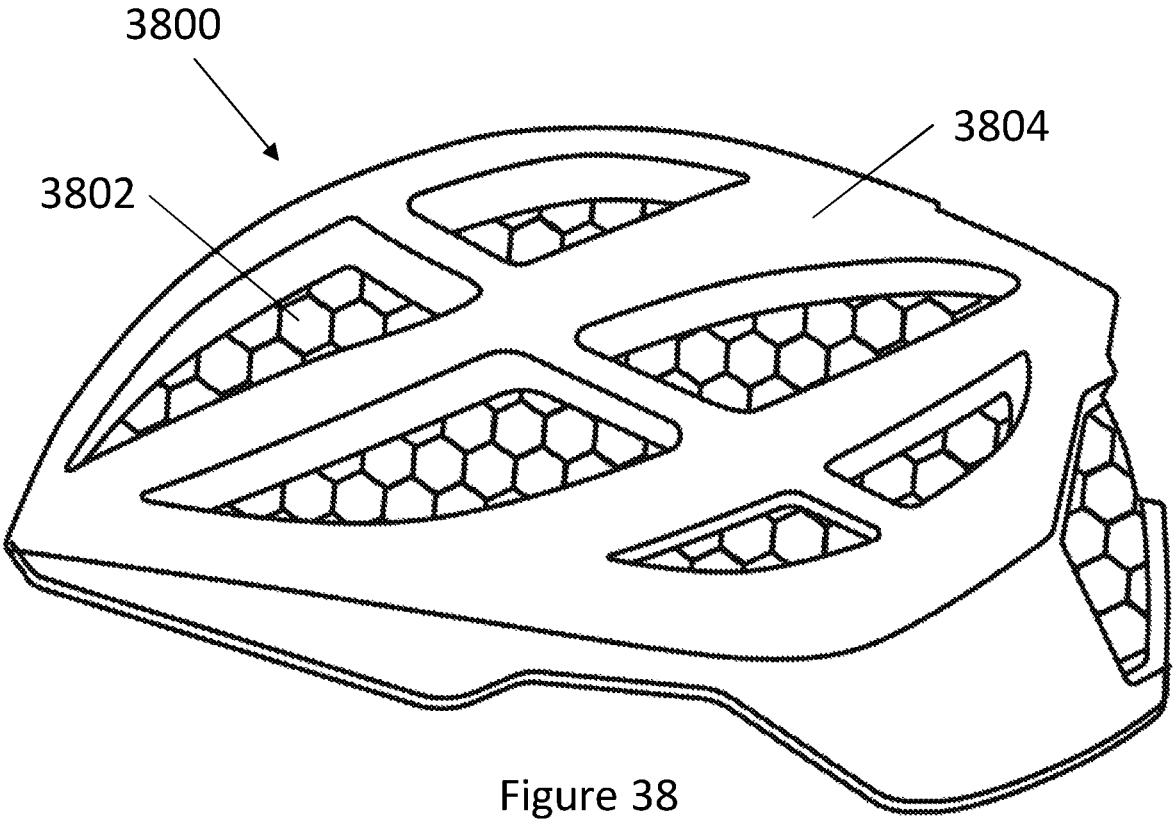
FIGS. 38 and 39 show schematic views of helmets formed from an impact mitigating structure according to an embodiment of the present invention.
Figure 39:
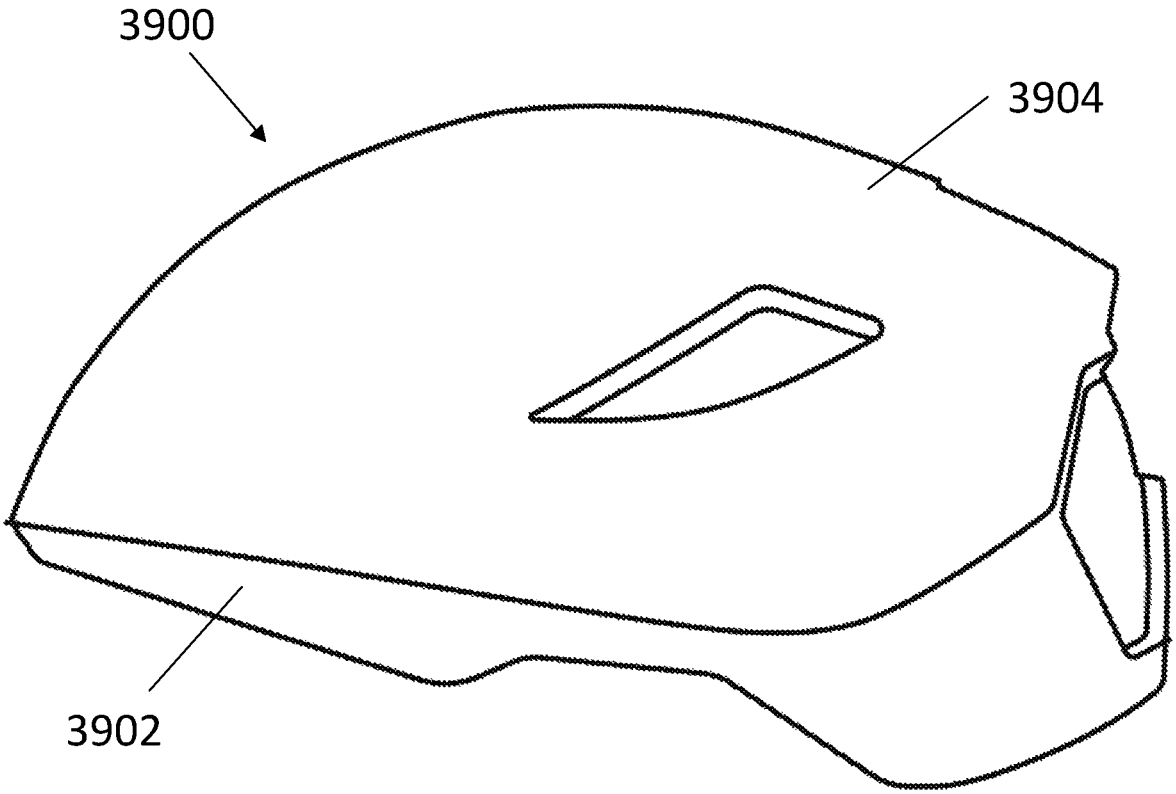

FIGS. 38 and 39 demonstrate how the impact mitigating structures of the present invention can be formed into a helmet 3800, 3900. In the helmet 3800 shown in FIG. 38, an outer (e.g. shell and/or impact absorbing) layer 3804 and an inner cellular structure 3802 can be seen. The reactive layer is not shown for clarity but is positioned between the first (inner cellular structure) layer 3802 and the second (outer) layer 3804. The reactive layer may be provided in any suitable and desired arrangement, for example, as shown in any one (or combination) of FIGS. 1 to 37; however, it will be appreciated that the various layers are provided in a curved form to provide the shape of the helmet 3800.

In FIG. 39, the helmet 3900 comprises a first (inner, impact absorbing) layer 3202 formed from expanded polystyrene that is substantially covered by a second (outer shell) layer 3904 formed from a hard polycarbonate. The first (inner, impact absorbing) layer 3902 may also include a hard coating on the surface which comes in contact with the reactive layer. The reactive layer is not shown for clarity but is positioned between the first (inner) layer 3902 and the second (outer) layer 3904. The reactive layer may be provided in any suitable and desired arrangement, for example, as shown in any one (or combination) of FIGS. 1 to 37; however, it will be appreciated that the various layers are provided in a curved form to provide the shape of the helmet 3900.

Thus it will be appreciated by those skilled in the art that an impact mitigating structure according to embodiments of the present invention, in which the arrangement of a plurality of elements is disrupted during an impact to facilitate the movement of a first layer and a second layer with respect to the each other, helps to reduce the forces transferred through the impact mitigating structure, e.g. to a user or object being protected by the structure. This may provide benefits over known impact mitigating structures and, particularly when the impact mitigating structure is a helmet, provide significant benefits over known helmets, e.g. in helping to reduce brain injuries.

It will further be appreciated however that many variations of the specific arrangements described herein are possible within the scope of the invention. For example, while the cross sections shown in the Figures, which are schematic representations of embodiments of the invention, show flat layers of the impact mitigating structures (for the purposes of clarity), it will be appreciated that, in at least preferred embodiments, the layers of the impact mitigating structures are (e.g. doubly) curved.

The invention claimed is:

1. A helmet comprising an impact mitigating structure, the impact mitigating structure comprising:

a first inner layer;

a second outer layer; and a reactive layer positioned between the first inner layer and the second outer layer, the reactive layer comprising a plurality of elements held between the first inner layer and second outer layer;

wherein the reactive layer is arranged such that, when the second layer is subject to an impact, the plurality of elements of the reactive layer are configured to roll to facilitate movement of the first inner layer and the second outer layer with respect to each other, and wherein the second outer layer is attached to a remainder of the impact mitigating structure such that, when the impact mitigating structure is subject to an impact, the second outer layer is configured to detach from the remainder of the impact mitigating structure.

2. The helmet as claimed in claim 1, wherein the reactive layer, the first inner layer and/or the second outer layer are configured to move substantially freely relative to each other, when the impact mitigating structure is subject to an impact.

3. The helmet as claimed in claim 1, wherein the first inner layer, the second outer layer and/or the reactive layer are configured such that, when the impact mitigating structure is subject to an impact, the majority of the rotational energy of the impact is transferred to the reactive layer.

4. The helmet as claimed in claim 1, wherein the first inner layer, the second outer layer and/or the reactive layer are configured to substantially decouple and/or isolate the first inner layer from the second outer layer.

5. The helmet as claimed in claim 1, wherein the first inner layer and the second outer layer are arranged to completely separate when the impact mitigating structure is subject to an impact.

6. The helmet as claimed in claim 1, wherein the reactive layer is arranged to allow the plurality of elements to roll when the impact mitigating structure is subject to an impact having at least a predetermined threshold force.

7. The helmet as claimed in claim 6, wherein the predetermined threshold force is one of: between 10 and 100 N, between 30 N and 70 N, 50 N.

8. The helmet as claimed in claim 1, wherein the reactive layer is configured such that, when the impact mitigating structure is subject to an impact, the plurality of elements are substantially not constrained and are able to move freely.

9. The helmet as claimed in claim 1, wherein the reactive layer is configured such that, when the impact mitigating structure is subject to an impact, the plurality of elements have substantially random and disordered free motion.

10. The helmet as claimed in claim 1, wherein the reactive layer is configured such that, when the impact mitigating structure is subject to an impact, the plurality of elements are free to move in three dimensions when the plurality of elements are freed by the impact.

11. The helmet as claimed in claim 1, wherein the reactive layer is configured such that, when the impact mitigating structure is subject to an impact, the plurality of elements substantially prevent geometric locking of the inner and/or outer layers.

12. The helmet as claimed in claim 1, wherein the reactive layer is configured such that, when the impact mitigating structure is subject to an impact, the plurality of elements are released with a maximum speed of 200 $ms^{-1}$ and/or an average speed of 80 $ms^{-1}$.

13. The helmet as claimed in claim 1, wherein the plurality of elements are held in a particular arrangement between the first inner layer and second outer layer;

wherein at least some of the plurality of elements are released from the arrangement when the impact mitigating structure is subject to an impact; and wherein the released elements are configured to facilitate movement of the first inner layer and second outer layer with respect to each other.

14. The helmet as claimed in claim 1, wherein the reactive layer, the first inner layer and/or the second outer layer are configured such that, when the impact mitigating structure is subject to an impact, the second outer layer detaches from the remainder of the impact mitigating structure after one of: less than 50 ms, less than 20 ms, less than 10 ms, less than 5 ms.

15. The helmet as claimed in claim 1, wherein the number of elements of the plurality of elements is between one of: 5 and 100,000, 50 and 10,000, 100 and 1,000.

16. The helmet as claimed in claim 1, wherein the ratio of the surface area of the reactive layer over which the plurality of elements are provided to the surface area of the reactive layer is one of: between 0.05 and 0.5, between 0.1 and 0.4, 0.25.

17. The helmet as claimed in claim 1, wherein the plurality of elements have a size that is greater than a quarter of the thickness of the reactive layer.

18. The helmet as claimed in claim 1, wherein the plurality of elements are formed from a material having a Shore A hardness of one of: greater than 50, greater than 100.

19. The helmet as claimed in claim 1, wherein one or more of the plurality of elements, the first layer and the second layer comprise a high friction material and/or coating such that, when the impact mitigating structure is subject to an impact, the plurality of elements are configured to contact one or both first inner layer and the second outer layer, such that the high friction material causes the plurality of elements to roll to facilitate movement of the first inner layer and the second outer layer with respect to each other.

20. The helmet as claimed in claim 1, wherein the hardness of the plurality elements is greater than the hardness of the first layer and/or the second layer.

21. The helmet as claimed in claim 1, wherein the plurality of elements are held in an arrangement between the first and second layers, wherein the arrangement of the plurality of elements of the reactive layer is configured to be disrupted when the second layer is subject to an impact to facilitate movement of the first inner layer and the second outer layer with respect to each other, wherein particularly the impact mitigating structure comprises a support structure arranged to hold the plurality of elements in the arrangement and to release the plurality of elements when the impact mitigating structure is subject to an impact.

22. The helmet as claimed in claim 1, wherein the surfaces of the first layer and/or the second layer, between which the reactive layer is positioned, comprise a hard coating or layer.

23. The helmet as claimed in claim 1, wherein the impact mitigating structure comprises a retaining structure arranged to hold the plurality of elements between the first and second layers;

wherein the retaining structure is arranged to retain the plurality of elements when the impact mitigating structure is subject to an impact, and wherein particularly the retaining structure substantially fully encapsulates and/or surrounds the plurality of elements.

24. The helmet as claimed in claim 23, wherein the retaining structure comprises a flexible layer that at least partially encapsulates and/or surrounds the plurality of elements, wherein the flexible layer is at least one of: arranged to stretch when the impact mitigating structure is subject to an impact, arranged to not tear, fracture, rupture and/or break, when the impact mitigating structure is subject to an impact, attached to the first inner layer and/or to the second outer layer by an adhesive.

25. The helmet as claimed in claim 1, wherein the first and second layers are attached to each other by one or more struts and/or one or more spacers that extend between the first and second layers, wherein the one or more struts and/or the one or more spacers are compressible and are configured to be compressed when the impact mitigating structure is subject to an impact.

26. The helmet as claimed in claim 1, wherein the reactive layer comprises one or more hinge lines extending across at least part of the reactive layer, wherein the reactive layer is arranged to bend at at least some of the one or more hinge lines, when the impact mitigating structure is subject to an impact.

27. A helmet comprising an impact mitigating structure, the impact mitigating structure comprising:

a first inner layer;

a second outer layer; and a reactive layer positioned between the first inner layer and the second outer layer, the reactive layer comprising a plurality of elements held between the first inner layer and second outer layer;

wherein the reactive layer is arranged such that, when the second layer is subject to an impact, the plurality of elements of the reactive layer are configured to roll to facilitate movement of the first inner layer and the second outer layer with respect to each other, and wherein the reactive layer is configured such that, when the impact mitigating structure is subject to an impact, the plurality of elements are released with a maximum speed of 200 $ms^{-1}$ and/or an average speed of 80 $ms^{-1}$; and/or the reactive layer, the first inner layer and/or the second outer layer are configured such that, when the impact mitigating structure is subject to an impact, the second outer layer detaches from the remainder of the impact mitigating structure after one of: less than 50 ms, less than 20 ms, less than 10 ms, less than 5 ms.

28. A helmet comprising an impact mitigating structure, the impact mitigating structure comprising:

a first inner layer;

a second outer layer; and a reactive layer positioned between the first inner layer and the second outer layer, the reactive layer comprising a plurality of elements held between the first inner layer and second outer layer;

wherein the reactive layer is arranged such that, when the second layer is subject to an impact, the plurality of elements of the reactive layer are configured to roll to facilitate movement of the first inner layer and the second outer layer with respect to each other, and wherein the plurality of elements are held in an arrangement between the first and second layers, wherein the arrangement of the plurality of elements of the reactive layer is configured to be disrupted when the second layer is subject to an impact to facilitate movement of the first inner layer and the second outer layer with respect to each other, wherein the impact mitigating structure comprises a support structure arranged to hold the plurality of elements in the arrangement and to release the plurality of elements when the impact mitigating structure is subject to an impact.

29. A helmet comprising an impact mitigating structure, the impact mitigating structure comprising:

a first inner layer;

a second outer layer; and a reactive layer positioned between the first inner layer and the second outer layer, the reactive layer comprising a plurality of elements held between the first inner layer and second outer layer;

wherein the reactive layer is arranged such that, when the second layer is subject to an impact, the plurality of elements of the reactive layer are configured to roll to facilitate movement of the first inner layer and the second outer layer with respect to each other, and wherein the reactive layer comprises one or more hinge lines extending across at least part of the reactive layer, wherein the reactive layer is arranged to bend at at least some of the one or more hinge lines, when the impact mitigating structure is subject to an impact.

* * * * *